US012582242B2

(12) United States Patent
Mountz et al.

(10) Patent No.: US 12,582,242 B2
(45) Date of Patent: Mar. 24, 2026

(54) SWING APPARATUS WITH MAGNETIC DRIVE AND CONTROL

(71) Applicants: Jonathan K. Mountz, Birdsboro, PA (US); Ethan M. Snyder, Birdsboro, PA (US); Wonderland Switzerland AG, Steinhausen (CH)

(72) Inventors: Jonathan K. Mountz, Birdsboro, PA (US); Ethan M. Snyder, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 714 days.

(21) Appl. No.: 17/906,331

(22) PCT Filed: Mar. 29, 2021

(86) PCT No.: PCT/US2021/024560
§ 371 (c)(1),
(2) Date: Sep. 14, 2022

(87) PCT Pub. No.: WO2021/195606
PCT Pub. Date: Sep. 30, 2021

(65) Prior Publication Data

US 2023/0346135 A1 Nov. 2, 2023

Related U.S. Application Data

(60) Provisional application No. 63/127,575, filed on Dec. 18, 2020, provisional application No. 63/041,172, (Continued)

(51) Int. Cl.

| | |
|---|---|
| ***A47D 13/10*** | (2006.01) |
| ***A47D 9/00*** | (2006.01) |
| ***A47D 9/02*** | (2006.01) |

(52) U.S. Cl.
CPC ..... *A47D 13/105* (2013.01); *A47D 9/016* (2022.08); *A47D 9/057* (2022.08)

(58) Field of Classification Search
CPC ..... A47D 13/105; A47D 9/016
(Continued)

(56) References Cited

U.S. PATENT DOCUMENTS

| | | | |
|---|---|---|---|
| 6,059,667 | A | 5/2000 | Pinch |
| 8,011,727 | B1 | 9/2011 | Martinez |

(Continued)

FOREIGN PATENT DOCUMENTS

| | | | |
|---|---|---|---|
| CN | 1559329 | A | 1/2005 |
| CN | 104055355 | A | 9/2014 |

(Continued)

OTHER PUBLICATIONS

JP Notice of Allowance from the related JP Patent Application No. 2022-558245, Jan. 15, 2024, 3 sheets.

*Primary Examiner* — Allyson N Trail
(74) *Attorney, Agent, or Firm* — Fay Kaplun & Marcin, LLP

(57) ABSTRACT

A swing apparatus includes an arm assembly including a seat, and a frame assembly coupled to the arm assembly. The frame assembly defines a pivot axis about which the arm assembly rotates during operation of the swing apparatus. The swing apparatus also includes an electromagnet disposed on the frame assembly, and a plurality of permanent magnets disposed on the arm assembly and positioned to define an arc centered on the pivot axis. The electromagnet has an angular offset about the pivot axis relative to the plurality of permanent magnets positioned along the arc when the swing apparatus is in a neutral position.

23 Claims, 47 Drawing Sheets

Related U.S. Application Data filed on Jun. 19, 2020, provisional application No. 63/012,999, filed on Apr. 21, 2020, provisional application No. 63/000,743, filed on Mar. 27, 2020.

(58) Field of Classification Search
USPC ..... 472/119
See application file for complete search history.

(56) References Cited

U.S. PATENT DOCUMENTS

| | | | | |
|---|---|---|---|---|
| 8,932,143 | B2 * | 1/2015 | Pyrce | A47D 13/105 5/108 |
| D979,259 | S * | 2/2023 | McMillan | D6/348 |
| 2003/0056288 | A1 | 3/2003 | Morita et al. | |
| 2003/0181249 | A1 | 9/2003 | Meade | |
| 2008/0194349 | A1 | 8/2008 | Kwon | |
| 2009/0017928 | A1 | 1/2009 | Tidmarsh et al. | |
| 2010/0151951 | A1 * | 6/2010 | Gilbert | A63G 9/16 700/275 |
| 2010/0201171 | A1 | 8/2010 | Velderman et al. | |
| 2010/0298058 | A1 | 11/2010 | Ting et al. | |
| 2012/0062004 | A1 | 3/2012 | Ru et al. | |
| 2013/0026805 | A1 | 1/2013 | Sclare et al. | |
| 2013/0320726 | A1 | 12/2013 | Teng | |
| 2014/0106891 | A1 | 4/2014 | Pyrce et al. | |
| 2014/0287846 | A1 | 9/2014 | Mountz et al. | |
| 2014/0315650 | A1 | 10/2014 | Pyrce et al. | |
| 2015/0250330 | A1 | 9/2015 | Mountz et al. | |
| 2017/0014675 | A1 * | 1/2017 | Lai | A63B 22/0664 |
| 2017/0119172 | A1 | 5/2017 | Sclare et al. | |
| 2018/0354542 | A1 | 12/2018 | Zheng | |
| 2019/0059611 | A1 | 2/2019 | Burns et al. | |
| 2023/0346135 | A1 * | 11/2023 | Mountz | A47D 1/10 |

FOREIGN PATENT DOCUMENTS

| | | | |
|---|---|---|---|
| CN | 106175269 | A | 12/2016 |
| CN | 207803908 | U | 9/2018 |
| EP | 0 074 224 | A1 | 3/1983 |
| EP | 2 422 657 | A1 | 2/2012 |
| JP | 56-58259 | | 5/1981 |
| KR | 20170122566 | A | 11/2017 |
| TW | 402891 | U | 8/2000 |
| WO | 98/17150 | A2 | 4/1998 |

* cited by examiner

| | Angle between Magnets (Degrees) | Left Swing Limit Angle (Degrees from Zero) | Right Swing Limit Angle (Degrees from Zero) |
|---|---|---|---|
| | $\theta_M$° | $\theta_L$° | $\theta_R$° |
| Max | 60 | -30 | 30 |
| Min | 30 | -15 | 15 |

SWING APPARATUS WITH MAGNETIC DRIVE AND CONTROL

CROSS-REFERENCE TO RELATED APPLICATIONS

This application is a National Phase application of PCT Application No. PCT/US2021/024560 filed on Mar. 29, 2021; which claims priority to U.S. Provisional Application No. 63/000,743 filed Mar. 27, 2020, U.S. Provisional Application No. 63/012,999 filed Apr. 21, 2020, U.S. Provisional Application No. 63/041,172 filed Jun. 19, 2020, and U.S. Provisional Application No. 63/127,575 filed Dec. 18, 2020. The entire contents of each of these applications are incorporated herein by reference.

BACKGROUND

A child swing is designed to provide a safe, elevated seating area for a child, along with the soothing benefit of a natural, pendulum motion. Conventional swings, however, suffer from various shortcomings. As an example, conventional swings are generally powered by a DC power supply and a gearbox. Gearbox-based swings tend to be noisy due to mechanical operation, and tend to get noisier over time due to mechanical wear. Gearbox-based swings also tend to be inefficient with regard to power consumption, and also have a higher potential for part failure given the multiplicity of different parts (e.g., multiple gears, pins, grease, bearings, and/or the like). As a result, gearbox-based swings tend to fail earlier than normal wear and tear would otherwise permit.

As another example, gearbox-based swings also have bulky drives due to the mechanical size of the gearbox components, which in turn make the swing heavy, and/or can interfere with swing operation such as caregiver access to swing controls, impeding placement and removal of a child in the swing, and/or the like.

As yet another example, some conventional swings also require a caregiver to manually push the swing to initiate motion. This can be problematic for when the swing requires a caregiver to apply significant force to initiate motion, when the caregiver is unable (e.g., disabled or elderly) to apply the required force, and (conversely) when the caregiver may be overtly aggressive, resulting in potential hard to the child/user in the swing.

As yet another example, some conventional swings control the swing motion by estimating when the swing passes through a center of the swing motion, with the assumption that this is the same position of the swing when at rest. However, swings are often placed on uneven surface (e.g., a carpet), which can result in erroneous estimation of the center of swing motion (which is affected by gravity), and in turn lead to lopsided swinging and/or other performance issues.

Generally, designing swings to overcome these issues can be challenging, since child swings must meet strict safety and stability (regulatory) standards while delivering satisfactory range and speed of swing motion. One way such stability is achieved in conventional swings is by having a sizeable base to 'anchor' the swing, so that it does not tip over when swinging. Such a sizeable base, however, causes problems with packaging, assembly, and are unsuitable for smaller dwellings such as condominiums and apartments.

Some conventional swings incorporate magnetic drives to overcome some of these issues, particularly those related to the fragility of gearbox designs. These conventional magnetic swings too, however, tend to have bulky drives, often a result of at least some of the magnetic components (e.g., a permanent magnet and/or electromagnet) being positioned distant to an axis the swing motion such as, for example, being located on the seat of the swing itself, or adjacent thereto. This spacing from the axis of rotation places significant demand on magnet size, strength, and/or power consumption (for electromagnets). Additionally, several conventional magnetic swings still require the user to manually push the swing to initiate motion.

SUMMARY

Inventive implementations disclosed herein are directed to a swing apparatus having a magnetic drive that utilizes an array of permanent magnets together with electromagnets oriented between the permanent magnets. In various aspects, the magnetic drives of inventive swing apparatus according to the present disclosure are advantageously located proximate to a pivot axis of a swing arm of the swing apparatus, providing for a compact, light-weight, powerful, and significantly power-efficient drive that can self-start from a neutral rest position. The magnetic drives disclosed herein, have relatively fewer parts than mechanical drive mechanisms for conventional swing apparatuses (e.g., that employ DC motors and gearboxes or have magnetic components proximate or directly coupled to the seat of a swing), and generally provide for less noisy, more power efficient, and more reliable operation. In some aspects, a swing apparatus includes a magnetic drive that includes an electromagnet and a plurality of permanent magnets. The swing apparatus also includes a controller coupled to the electromagnet to activate the electromagnet by applying an activation current having a polarity selectable from a first polarity and a second polarity and thereby initiating a motion of at least a portion of the swing apparatus. The controller is configured to: A1) apply the activation current having one of the first polarity and the second polarity; A2) determine if at least the portion of the swing apparatus has moved at least a predetermined amount; A3) if, after a predetermined time period, at least the portion of the swing apparatus has not moved by at least the predetermined amount, then switch the polarity of the activation current to the other of the first polarity and the second polarity; and A4) repeat A2) and A3) until it is determined, at A2), that the swing apparatus has moved by at least the predetermined amount.

In some aspects, a swing apparatus includes an electromagnet and a plurality of permanent magnets positioned proximate to the electromagnet such that, upon electrical activation of the electromagnet, magnetic forces are generated between the electromagnet and each permanent magnet of the plurality of permanent magnets. The swing apparatus also includes a controller, coupled to the electromagnet, to electrically activate the electromagnet and thereby initiate swing motion of the swing apparatus without manual intervention by a user of the swing apparatus.

swing apparatus includes a controller to control a motion of at least a portion of the swing apparatus, and a plurality of optical sensors coupled to the controller. The plurality of optical sensors include a first light source to emit a first light beam propagating along a first optical path, and a first detector, spaced from the first light source and disposed in the first optical path to detect the first light beam. The plurality of optical sensors also include a second light source to emit a second light beam along a second optical path substantially parallel to the first optical path and offset from the first optical path by a separation distance. The plurality of optical sensors also include a second detector, spaced from the second light source and disposed in the second optical path to detect the second light beam. The swing apparatus further includes an optical encoder strip disposed in the first optical path and the second optical path to facilitate detection of the motion of at least the portion of the swing apparatus.

In some aspects, a swing apparatus includes a controller to control a motion of at least a portion of the swing apparatus, and a plurality of optical sensors coupled to the controller. The plurality of optical sensors include a first light source to emit a first light beam propagating along a first optical path and a first detector, spaced from the first light source and disposed in the first optical path to detect the first light beam. The plurality of optical sensors also include a second light source to emit a second light beam along a second optical path substantially parallel to the first optical path and offset from the first optical path by a separation distance. The plurality of optical sensors also include a second detector, spaced from the second light source and disposed in the second optical path to detect the second light beam. The swing apparatus further includes a slotted strip disposed in the first optical path and the second optical path to facilitate detection of the motion of at least the portion of the swing apparatus based on alternately blocking and unblocking of the first light beam and the second light beam. The slotted strip includes a plurality of optically transparent slots and a plurality of photointerrupters respectively disposed between successive slots of the plurality of optically transparent slots.

In some aspects, a swing apparatus includes an arm assembly including a seat, and a frame assembly coupled to the arm assembly and defining a pivot axis about which the arm assembly rotates during operation of the swing apparatus. The swing apparatus further includes an electromagnet disposed on the frame assembly, and a plurality of permanent magnets disposed on the arm assembly and positioned to define an arc centered on the pivot axis. The electromagnet has an angular offset about the pivot axis relative to the plurality of permanent magnets positioned along the arc when the swing apparatus is in a neutral position.

In some aspects, a swing apparatus includes an arm assembly including a seat, and a frame assembly coupled to the arm assembly and defining a pivot axis about which the arm assembly rotates during operation of the swing apparatus. The swing apparatus further includes an electromagnet disposed on the frame assembly, and a plurality of permanent magnets disposed on the arm assembly and positioned to define an arc centered on the pivot axis. When the swing apparatus is in a neutral position, the electromagnet and the plurality of permanent magnets are disposed on a first side of the pivot axis and the seat is disposed on a second side of the pivot axis.

In some aspects, a swing apparatus includes an arm assembly including a seat, and a frame assembly coupled to the arm assembly and defining a pivot axis about which the arm assembly rotates during operation of the swing apparatus. The swing apparatus also includes a plurality of permanent magnets disposed on the arm assembly and positioned to define an arc centered on the pivot axis, wherein a linear distance between each permanent magnet of the plurality of permanent magnets and the pivot axis is at most from about 0.5 inches to about 5 inches. The swing apparatus also includes an electromagnet disposed on the frame assembly.

In some aspects, a swing apparatus includes an arm assembly including a seat, and a frame assembly coupled to the arm assembly and defining a pivot axis about which the arm assembly rotates during operation of the swing apparatus. The swing apparatus also includes a plurality of permanent magnets disposed on the arm assembly and positioned to define an arc centered on the pivot axis. The swing apparatus also includes an electromagnet disposed on the frame assembly, wherein a linear distance between the electromagnet and the pivot axis is at most from about 1 inch to about 6 inches.

In some aspects, a swing apparatus includes an electromagnet and a plurality of permanent magnets positioned proximate to the electromagnet so as to generate a magnetic force upon electrical activation of the electromagnet and thereby control a swing motion of at least a portion of the swing apparatus. A separation gap between the electromagnet and a first permanent magnet of the plurality of permanent magnets, when in magnetic alignment during operation of the swing apparatus, is less than or equal to 0.15 inch.

In some aspects, a swing apparatus includes an arm assembly including a hub, a swing arm coupled to the hub, and a seat coupled to the swing arm. The swing apparatus also includes a frame assembly coupled to the hub and including a frame arm, the frame assembly defining a pivot axis about which the hub rotates during operation of the swing apparatus. The swing apparatus also includes an electromagnet disposed on the frame assembly, and a plurality of permanent magnets disposed on the hub and positioned to define an arc centered on the pivot axis. The swing apparatus also includes a housing enclosing the electromagnet and the plurality of permanent magnets.

In some aspects, a swing apparatus includes a controller to determine when at least a portion of the swing apparatus changes direction during a swing motion without detecting when the portion of the swing apparatus passes through a neutral position of the swing motion.

In some aspects, a swing apparatus includes a panel having a surface and including a dial to facilitate a user input specifying an extent of swing motion of at least a portion of the swing apparatus during use. The surface defines a hole and a recessed portion within the hole, and the dial is disposed in the recessed portion. The swing apparatus also includes a controller communicably coupled to the dial to control the swing motion based on the user input.

In some aspects, a kit includes components for assembly into a swing apparatus. The kit includes a first component that in turn includes a frame assembly, a magnetic drive coupled to the frame assembly, and a power delivery circuit to couple an external power supply to the magnetic drive. The kit also includes a second component that includes including a swing arm configured for coupling to the magnetic drive. The kit also includes a third component including a seat configured for coupling to the swing arm. The power delivery circuit is wholly contained within the first component.

In some aspects, a swing apparatus includes an arm assembly including a seat, and a frame assembly to support the swing apparatus on a ground surface during operation of the swing apparatus. The frame assembly is coupled to the arm assembly and defines a pivot axis about which the arm assembly swings during operation of the swing apparatus. The pivot axis forms an angle of from about 15 degrees to about 45 degrees with respect to a horizontal plane parallel to the ground surface. The swing apparatus also includes a drive, disposed about the pivot axis, to control a swing motion of the arm assembly about the pivot axis during operation of the swing apparatus.

In some aspects, a swing apparatus includes rest on a substantially level ground surface during operation of the swing apparatus, the base defining a vertical footprint of the base member on the ground surface. The swing apparatus also includes a frame assembly including a frame arm having a lower portion coupled to the base, the lower portion of the frame arm extending upward from the base and inclined from vertical such that the lower portion of the frame stalk extends away from the vertical footprint of the base and lies outside of the vertical footprint of the base. The swing apparatus also includes a swing arm assembly coupled to the frame assembly, the swing arm assembly including a seat to hold a child during operation of the swing apparatus.

In some aspects, a swing apparatus includes a base to rest on a ground surface during operation of the swing apparatus, the base having an outside perimeter with a curved shape. The swing apparatus also includes an arm assembly including a swing arm and a rotatable seat coupled to the swing arm to hold a child during operation of the swing apparatus, the rotatable seat having a rotation axis normal to the ground surface. The swing apparatus also includes a frame assembly, coupled to the arm assembly and the base, and defining a pivot axis about which the arm assembly swings during operation of the swing apparatus. The rotatable seat is positioned on the arm assembly such that a combined center of gravity of the swing apparatus and an anthropomorphic test device (ATD) disposed in the seat is laterally offset from the rotation axis of the rotatable seat by less than 1 inch.

In some aspects, a swing apparatus includes a base to rest on a horizontal surface during use, the base defining a vertical footprint. The swing apparatus also includes a frame assembly including a frame arm, the frame arm defining an upper portion and a lower portion, the lower portion of the frame arm coupled to the base via a stalk, and inclined at an angle with respect to the vertical footprint at a point of interconnection, such that the lower portion of the frame arm lies outside the vertical footprint. The swing apparatus also includes a swing arm assembly coupled to the frame assembly, the swing arm assembly including a seat to hold a child during use. wherein the lower portion and upper portion collectively define a curvature such that the upper portion of the frame arm intrudes into the vertical footprint.

In some aspects, a swing apparatus includes a base member to rest on a horizontal surface during use, the base member defining a vertical footprint. The swing apparatus also includes a frame assembly including a frame arm, the frame arm defining an upper portion and a lower portion. The lower portion of the frame arm is coupled to the base member via a stalk and inclined at an angle with respect to the vertical footprint at the point of interconnection, such that lower portion of the frame arm lies outside the vertical footprint. The swing apparatus also includes a drive coupled to the upper portion, where at least a portion of the drive lies inside the vertical footprint. The swing apparatus also includes a swing arm assembly coupled to the drive, the swing arm assembly including a seat to hold a child during use.

In some aspects, a swing apparatus includes a frame assembly and a hub rotatably coupled to the frame assembly at a pivot axis. The swing apparatus also includes a seat and a swing arm having a first end that is attached to the seat. A second end of the swing arm is attached to the hub such that rotation of the hub relative to the frame assembly about the pivot axis causes the swing arm and seat to rotate. The swing apparatus also includes at least one permanent magnet disposed on one of the frame assembly and the hub and at least one electromagnet being disposed on the other of the frame assembly and the hub. The at least one electromagnet and the at least one permanent magnet are configured to apply a magnetic force to one another so as to cause the hub to rotate about the pivot axis relative to the frame assembly.

In some aspects, a swing apparatus includes an arm assembly including a seat, and a frame assembly coupled to the arm assembly and defining a pivot axis about which the arm assembly rotates during operation of the swing apparatus. The swing apparatus also includes at least one permanent magnet disposed on one of the arm assembly and the frame assembly and positioned to define an arc centered on the pivot axis. The swing apparatus also includes an electromagnet disposed on another one of the arm assembly and the frame assembly. The at least one permanent magnet is arranged to have opposing polarities facing the electromagnet. The swing apparatus is configured such that, when the arm assembly is in a neutral position and the electromagnet is electrically activated, attractive magnetic forces and repulsive magnetic forces are concurrently generated between the electromagnet and the at least one permanent magnet.

In some aspects, a swing apparatus includes an arm assembly including a seat, and a frame assembly coupled to the arm assembly and defining a pivot axis about which the arm assembly rotates during operation of the swing apparatus. The swing apparatus also includes an electromagnet disposed on the frame assembly and at least one permanent magnet disposed on the arm assembly and positioned such that a north pole of the at least one permanent magnet and a south pole of the at least one permanent magnet can attain magnetic alignment with the electromagnet during operation of the swing apparatus. The electromagnet has an angular offset about the pivot axis relative to the north pole and the south pole of the at least one permanent magnet when the swing apparatus is in a neutral position.

All combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are part of the inventive subject matter disclosed herein. The terminology used herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Figure 1:
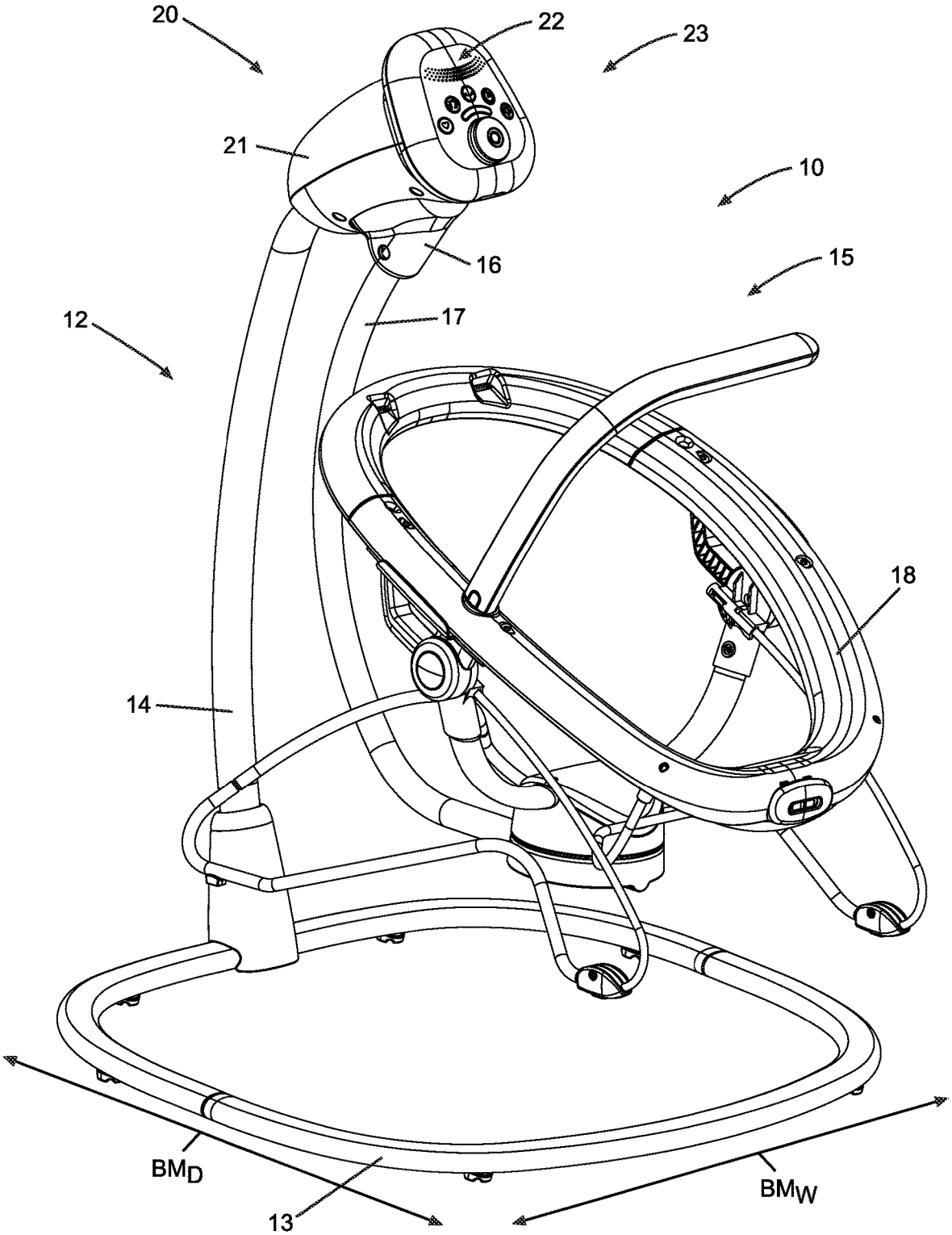
FIG. 1 is a perspective view of an inventive swing apparatus, according to one example implementation.

Following below are more detailed descriptions of various concepts related to, and implementations of, a swing apparatus with magnetic drive and control. It should be appreciated that various concepts introduced above and discussed in greater detail below may be implemented in multiple ways. Examples of specific implementations and applications are provided primarily for illustrative purposes so as to enable those skilled in the art to practice the implementations and alternatives apparent to those skilled in the art.

The figures and example implementations described below are not meant to limit the scope of the present implementations to a single embodiment. Other implementations are possible by way of interchange of some or all of the described or illustrated elements. Moreover, where certain elements of the disclosed example implementations may be partially or fully implemented using known components, in some instances only those portions of such known components that are necessary for an understanding of the present implementations are described, and detailed descriptions of other portions of such known components are omitted so as not to obscure the present implementations.

Aspects of the swing apparatuses disclosed herein encompass a compact magnetic drive and control that permits the swing to self-start, without user intervention. The magnetic components of the drive are disposed in the vicinity of the axis of swing (also referred to as a pivot axis), and hence provide for a compact, quiet/noiseless drive design with minimal components that is suitable for long term use. Being proximate to the axis, the magnetic components can be relatively closer to each other and to the axis than conventional approaches, which permits for flexible drive design, i.e., the use of smaller/weaker magnets to achieve the same swing operation as conventional approaches, or the use of the same/larger magnets to achieve a larger range of swing motion.

Aspects of the swing apparatuses disclosed herein also provide for control of swing motion using a dual optical sensing setup that can detect changes in swing direction, and without requiring detection of center of swing motion. In this manner, swing control is independent of strictly requiring the swing apparatus to be placed on a level surface.

Aspects of the swing apparatuses disclosed herein also provide for an improved user interface panel with a recessed dial for controlling swing parameters. The interface panel provides for single hand operation while protecting the dial, and the underlying control circuitry, from inadvertent damage due to the caregiver bumping the swing apparatus while moving it, due to the swing tipping over, and/or the like.

Aspects of the swing apparatuses disclosed herein also provide for a reduced base footprint with a single frame arm arising therefrom, thereby providing a smaller, material-saving design that is nevertheless structurally sound. The single frame arm is rigidly connected to the base via a stalk to prevent rotational loss during swing motion, and is curved to nevertheless maintain stable operation of the swing.

Aspects of the swing apparatuses disclosed herein also provide for modular design that in turn enable ease of assembly of the components by the average caregiver/user. The components are designed/configured such that no electrical assembly (e.g., connecting a power supply to the magnetic drive) is required by the caregiver, which prevents inadvertent damage to the magnetic drive due to caregiver mishandling/error.

These and several other benefits of the swing apparatuses disclosed herein, and their respective components, are now described in further detail.

Swing Apparatus

Figure 2:
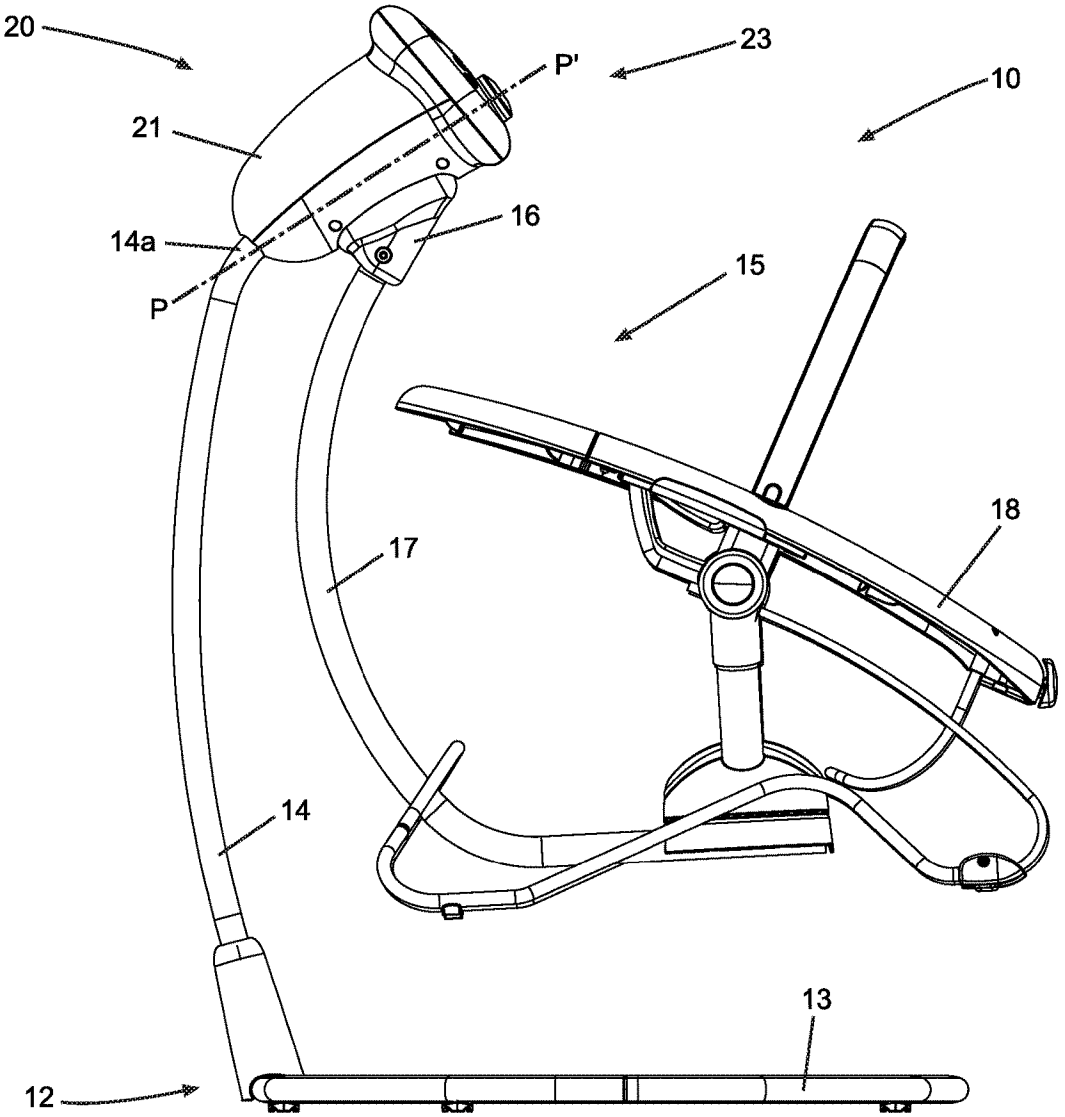
FIG. 2 is a side view of the swing apparatus of FIG. 1.

FIGS. 1-3 illustrate a swing apparatus 10 (also sometimes referred to just as a "swing") includes a swing frame assembly 12, a swing arm assembly 15 and a magnetic drive 20. The swing frame assembly 12 includes a base/base member 13 that is placed on a surface e.g., the ground) to provide stability for the motion of the swing arm assembly 15 during use. The base member 13 can have any suitable shape (e.g., oval, elliptical, square with rounded corners, etc.) and cross sectional area. The shape and/or cross sectional area can be selected based on factors such as, but not limited to, footprint, stability, material of the base member 13 and/or other portions of the apparatus 10, orientation with respect to portions of the apparatus 10, orientation with respect to a direction of swing motion, and/or the like.

The swing frame assembly 12 also includes a frame arm 14 (also sometimes referred to as a "swing frame arm", "frame support member" and variants thereof) that extends generally upwardly from the base 13 (i.e., away from the surface/ground that the apparatus 10 rests or is placed on). The frame arm 14 and/or other portions of the swing frame assembly 12 can be composed of any suitable structural composition or element such as, for example, iron tubing, aluminum tubing, and/or the like. In some cases, as illustrated in FIGS. 1-3, the frame arm 14 can have an intrinsic curvature along its length (i.e., is not straight). Such curvature can be beneficial for reducing end-to-end length of the frame arm 14, which in turn makes the overall height of the swing apparatus 10 amenable for use by the average adult user/caregiver. A reduced length also results in reduced material use to create the support member 14, and in turn reduced weight. In some cases, the frame arm 14 can be flexible such that a user putting some weight on the apparatus 10 (e.g., leaning on the housing 21) can result in the member 14 flexing without breaking. In some cases, the frame arm 14 can be rigid. In some cases, the frame arm 14 can be hollow and have an elliptical cross-section with its major axis facing towards the interior of the swing apparatus 10. A wall thickness of the frame arm 14 can be generally selected to balance strength, flexibility, and weight, and can be from about 1.2 mm to about 1.6 mm, including all values and sub-ranges in between.

A turning member 14*a* is coupled to the frame arm 14 at one end and to the drive apparatus 20 at the other end to mount the drive apparatus 20 onto the frame arm 14. In some cases, the turning member 14*a* can be integrally formed with the frame arm 14, with the drive 20, or both. The turning member 14*a* and the drive 20 can then collectively define a pivot axis P-P' about which the swing rotates, as explained in more detail herein.

Figures 24A, 24B, 24C:
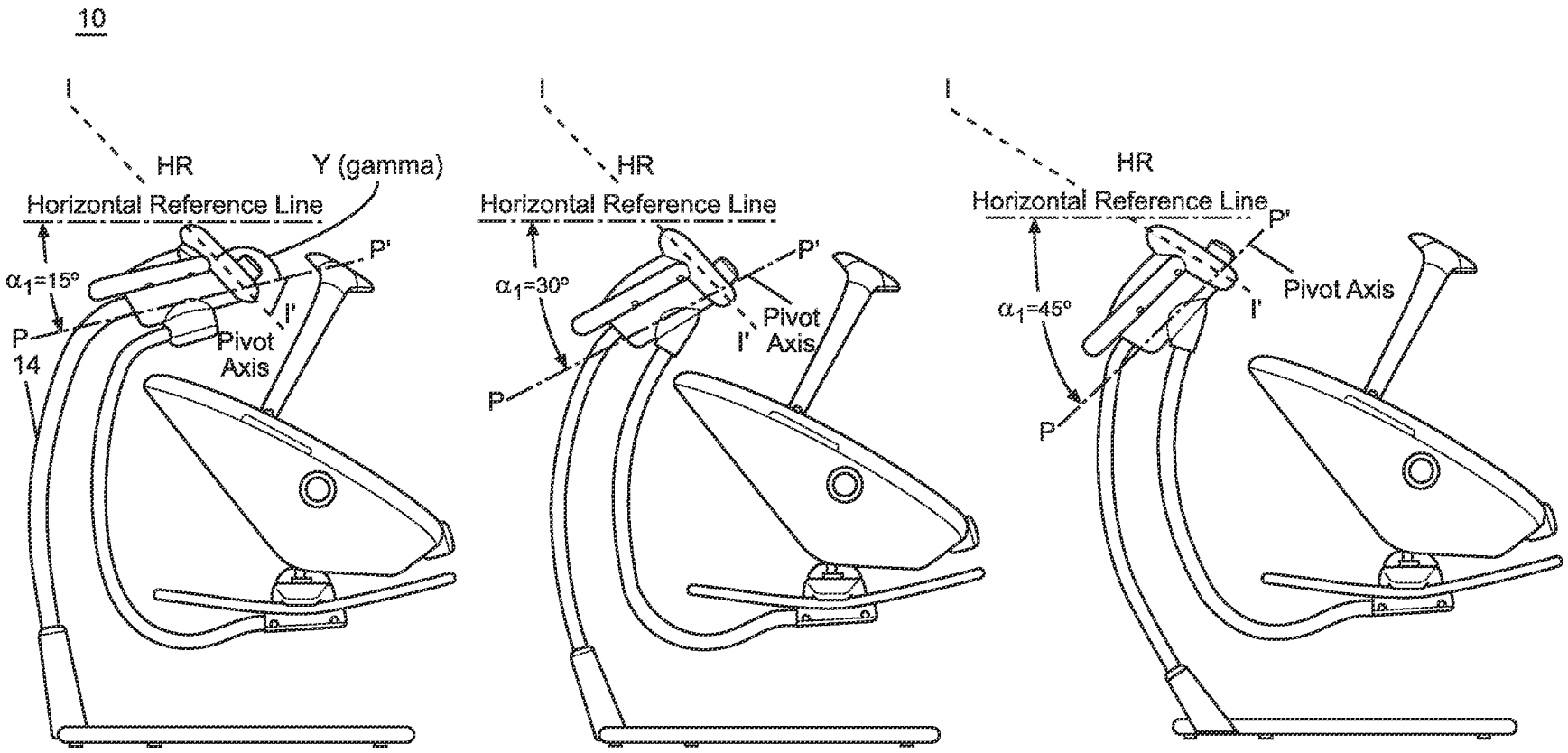
FIG. 24A illustrates a side view of the swing apparatus of FIGS. 1-2, and further illustrates a 15° orientation of the swing arm relative to a horizontal reference line/plane.
FIG. 24B illustrates a side view of the swing apparatus of FIGS. 1-2, and further illustrates a 30° orientation of the swing arm relative to the horizontal reference line/plane.
FIG. 24C illustrates a side view of the swing apparatus of FIGS. 1-2, and further illustrates a 45° orientation of the swing arm relative to the horizontal reference line/plane.

As best illustrated in FIGS. 24A-24C, the frame arm 14, turning member 14*a*, or both, can be shaped and/or otherwise configured such that the pivot axis P-P' can be oriented at any suitable angle $\alpha_1$ with respect to a horizontal reference line HR. The reference line HR can be generally parallel to a floor or surface that the apparatus 10 is placed on. FIG. 24A illustrates the apparatus 10 when $\alpha_1$ is about 15°. FIG. 24B illustrates the apparatus 10 when $\alpha_1$ is about 30°. FIG. 24C illustrates the apparatus 10 when $\alpha_1$ is about 45°. Generally, the angle $\alpha_1$ can be selected based on factors such as, for example a desired natural frequency and/or half-period of the swing motion, where a relatively higher value of $\alpha_1$ can provide for slower motion than a relatively lower value of $\alpha_1$. Another factor can be the experience of the swing motion for the child in the seat 18 (also sometimes referred to as a "seat frame", described in more detail below), where relatively higher value of $\alpha_1$ can result in more of a glide or sway-like motion being experienced by the child than a relatively lower value of $\alpha_1$, at which a more pendulum-like motion can be experienced.

As also illustrated in FIGS. 24A-24C, the user interface panel 22 can define an interface plane II' (shown here in side view) that in turn defines an interface angle $\gamma$ with respect to the pivot axis P-P'. The interface angle $\gamma$ can generally be selected to provide for ease of viewing and interaction with the user interface panel 22 by an adult caregiver, who is typically taller than the swing apparatus 10. The interface angle $\gamma$ can be about 90 degrees, about 100 degrees, about 110 degrees, about 120 degrees, about 130 degrees, about 140 degrees or more, including all values and sub-ranges in between.

Figure 3A:
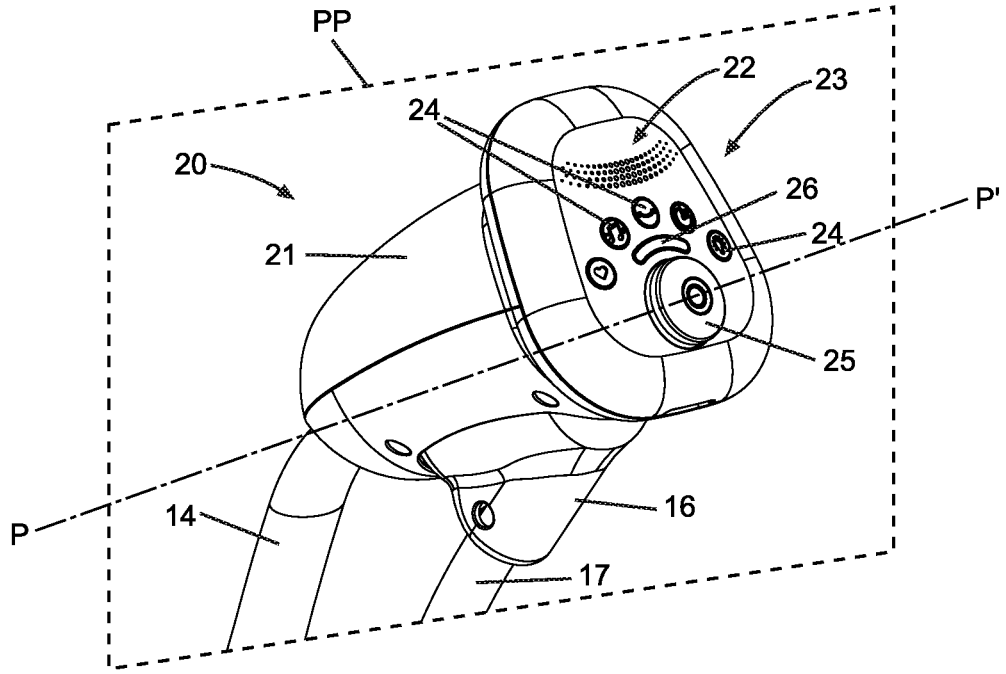
FIG. 3A is an enlarged view of the housing and controls for the magnetic drive of the swing apparatus of FIG. 1.

Referring to FIGS. 1-3 again, the swing arm assembly 15, which supports or holds (e.g., in suspension) a seat/seat frame 18 during use, includes a hub 16 mounted for pivoting motion about the pivot axis P-P'. FIG. 3A also illustrates a pivot plane PP that includes the pivot axis P-P'. The pivot plane PP can be a plane that passes through the pivot axis and can be generally perpendicular to a floor or surface that the apparatus 10 sits on. Specifically, the hub 16 mounts on to, is coupled to, and or otherwise attached to a pivot axis shaft 19 (best seen in FIG. 4) along the pivot axis P-P' that is carried by the frame arm 14 in a manner that permits rotation about the pivot axis. For example, the hub 16 can be rigidly mounted on the pivot axis shaft 19, which is rotatably coupled via ball bearings (not shown) to an end of the frame arm 14, so that the hub 16 and the shaft 19 can rotate about the pivot axis P-P'. As illustrated, the hub 16 can protrude outside a housing 21, such as through an opening formed in the housing 21. This can permit a caregiver, during assembly of the swing apparatus 10, to easily couple a swing arm 17 to the magnetic drive without compromising the integrity of the housing and the drive.

Figure 5:
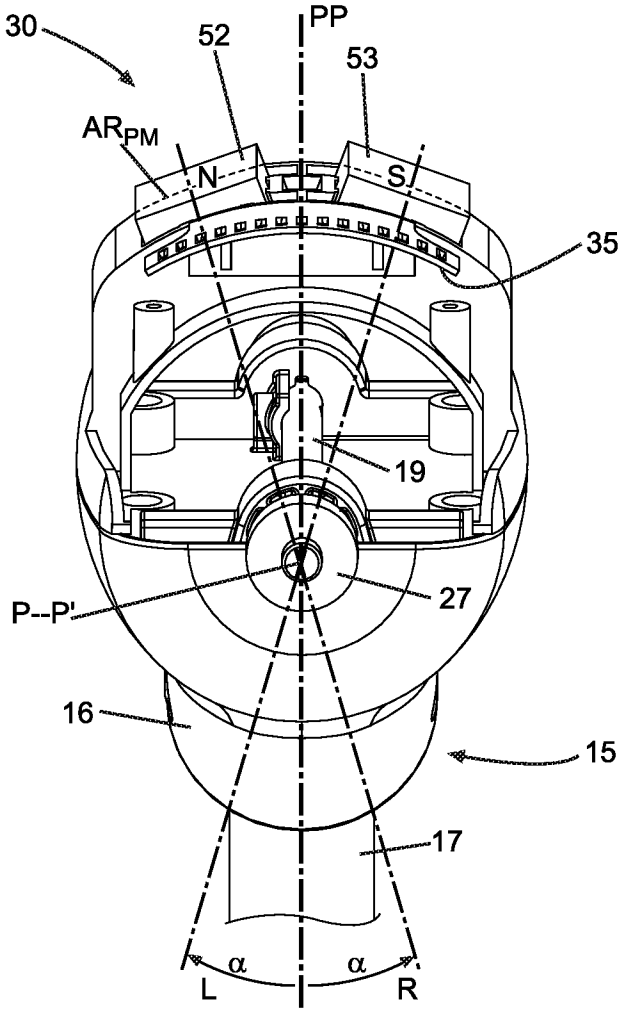
FIG. 5 is an enlarged front view of the portion of the magnetic drive of FIG. 4.

The swing arm 17 is coupled to the hub 16 outside the housing 21 and projects downwardly (i.e., towards the base member 13) from the hub 16, curves towards the middle of the apparatus 10, and then (optionally, as illustrated) curves upwards to couple to the seat frame 18. The coupling between the swing arm 17 and the seat 18 is explained in more detail with respect to FIGS. 25A-25D, 26A-26C. The seat frame 18 can hold any suitable hard and/or soft goods (not shown) to form a seat for the child to sit on. The swing arm 17 and the seat frame 18 depend from the hub 16 so that the swing arm 17 and the seat frame 18 can pivot/rotate back and forth in a left L to right R direction in an arc, circular, and/or generally pendulum-like motion about the pivot axis shaft 19 and the pivot axis P-P', as best illustrated in FIG. 5. The back and forth motion, interchangeably referred to as a swing motion, swinging motion, pendulum motion, and/or variants thereof, can characterize a swing angle $\alpha$ between the pivot axis P-P' and the L direction, and correspondingly between the pivot axis P-P' or the R direction. It is understood that the swing angle $\alpha$ can be different for the L and R directions such as when, for example, the apparatus 10 is not on a level surface and has a tilt, such that the extent of the swing motion in one direction can be different than the other. The swing angle $\alpha$ can be from about 2 degrees to about 20 degrees, including all values and sub-ranges in between. The maximum swing angle $\alpha$ during use can be one that is predetermined, specified by a caregiver, one limited by mechanical design of the apparatus 10, limited by weight of an infant in the seat 18, and/or the like.

Figure 3B:
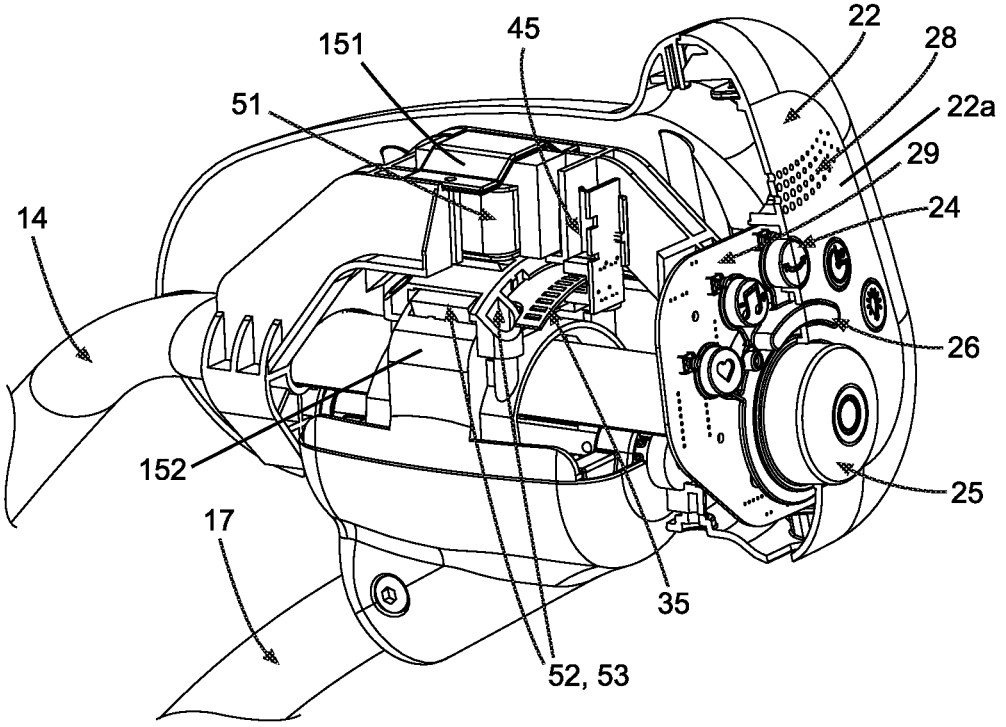
FIG. 3B is an enlarged cutaway view of the housing and controls for the magnetic drive of the swing apparatus of FIG. 1.

The housing 21 of the swing apparatus 10 can be shaped and sized to cover the moving parts of the magnetic drive mechanism and the swing arm assembly 15. FIGS. 3A, 3B illustrate a user interface panel 22 coupled to or integrally formed with the housing 21 that includes a set of controls 23. The controls 23 can include preset application or function selection buttons/switches 24 such as for, for example swing amplitude control (i.e., the degree or extent to which the swing rotates from its neutral or rest position), music, nature sounds, volume control, lighting (e.g., a nightlight, not shown, disposed on the hub or the seat frame 18 that can shine onto a child placed in the swing apparatus 10 during use), and/or the like. The controls 23 also include a dial 25 for selecting a parameter of the function selected. When a user selects swing amplitude control from the switches 24, the dial 25 can be subsequently used to select one of a number of preset values (also sometimes referred to as setpoints) of swing angle α. As an example, a user can select a representative value from 1 to 6, where a value 1 corresponds to a swing angle α of 3 degrees, a value 2 corresponds to a swing angle α of 6 degrees, a value 3 corresponds to a swing angle α of 9 degrees, a value 4 corresponds to a swing angle α of 12 degrees, a value 5 corresponds to a swing angle α of 15 degrees, and a value 6 corresponds to a swing angle α of 18 degrees. The magnitude and resolution of the swing angle made available to a user can be based on a number of factors including, but not limited to, child safety considerations, resolution of detection of the swing motion (i.e., via the optical sensor illustrated in FIGS. 8-11), and/or the like. In some cases, a user can be allowed to program and/or otherwise directly specify and set the swing angle α during use.

Rotating and pushing/clicking the dial 25 allows a user/caretaker to toggle through and select the apparatus parameter that is to be adjusted. For example, when the volume application is selected, rotating the dial 25 allows adjustment to the desired music volume, and so forth. The lighting can include visual indicators 26 (e.g., a light panel of a set of light emitting diodes (LEDs)) that provide a visual indication of a predetermined settings of swing amplitude, information regarding the selected range of each of the selected functions, and/or the like. FIG. 3B also illustrated a circuit board 29 on which the controls 23, as well as a speaker (to play music, ins and/or other sounds, not shown) are disposed. The panel 22 includes openings 28 formed in front of the speaker to permit the music and/or sounds to be transmitted to the user. The panel 22 in FIGS. 3A, 3B illustrates the dial 25 as being projected from a surface 22*a* of the panel 22, which permits ease of location and control for a user.

FIGS. 35A-35G illustrate another panel design, with a user panel 3522 coupled to a housing 3521 and that includes selection buttons 3524 (e.g., similar to the buttons 24), a light panel 3526 (e.g., similar to the visual indicators 26), and a dial 3525. The dial 3525, in contrast to the protruding dial 25, is recessed from the surface 3522*a*, in a hole, cavity or pocket 3530 of the surface 3522*a*, such that the surface 3522*a* includes a recessed portion 3535. The depth of the recessed portion 3535 from the surface 3522*a* can be about 0.25 inches, about 0.5 inches, about 1 inch, about 1.5 inches or more, including all values and sub-ranges in between. The dial 3525 can be sized and positioned such that it is flush, does not protrude, minimally protrudes, or protrudes by some extent (e.g., see FIGS. 35B, 35F, 35G) beyond the surface 3522*a*. In some cases, the surface 3522*a* has a curvature at least in the vicinity of the dial 3525, and a surface of the dial 3525 can also be curved to conform to that curvature. As also illustrated in FIGS. 35A-35G, the selection buttons 3524 and the light panel 3526 can also be disposed so as to be flush, not protrude, minimally protrude (e.g., feel like an indentation to a user), or protrude to some extent from the surface 3522*a*. A user can engage with the selection buttons 3524 by depressing them, and can engage with the dial 3525 by inserting their fingers into the cavity 3530 to grasp the side of the dial 3525. In the design of FIGS. 35A-35G, the likelihood of the buttons 3524 and/or the dial 3525 being pressed or even damaged due to accidental toppling, jostling, grazing against environmental elements during unpacking and/or assembly, etc. is minimized, thereby reducing the possibility that the swing apparatus, or some features of the apparatus, are rendered partly or wholly inoperable. When the buttons 3524 and the dial 3525 are physically coupled to the circuit board (as illustrated for FIG. 3B), the flush design also prevents or minimizes dislocation and/or damage to the underlying circuit board, which can also render some or all functionality of the swing apparatus inoperable.

Referring again to the view of FIG. 3B, also illustrated is an optical sensor 45, a strip 35 (also sometimes referred to as a "slotted strip", "optical encoder strip", and variants thereof), and a magnetic drive with one electromagnet 51 and two permanent magnets 52, 53, all explained in more detail in the following sections.

Magnetic Drive

Figure 4:
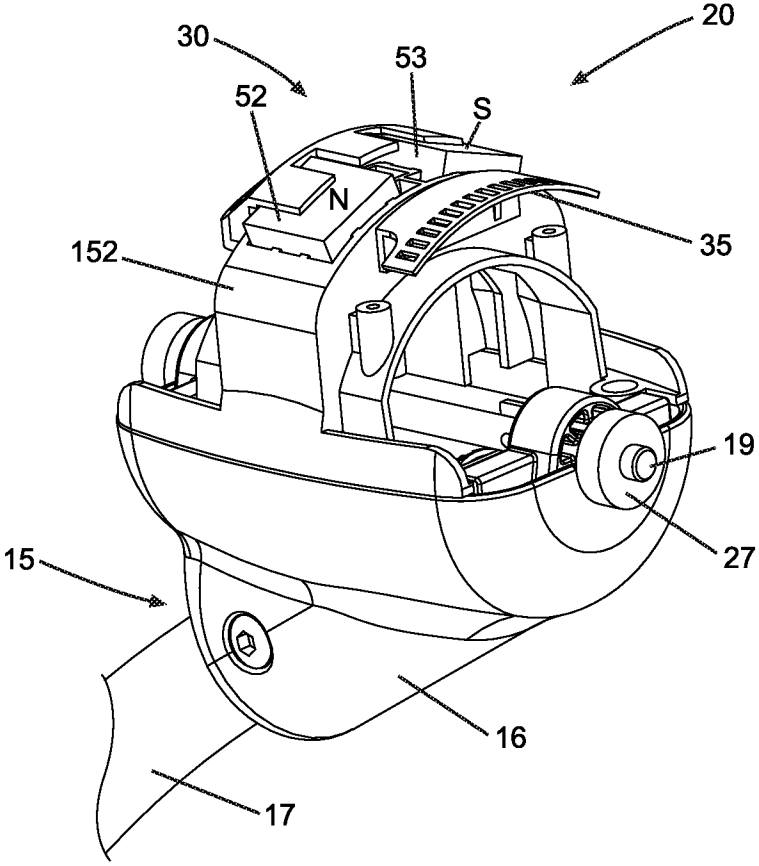
FIG. 4 is an enlarged perspective view of a portion of the magnetic drive of the swing apparatus of FIG. 1 coupled to the swing arm.

FIGS. 4-11 illustrate the magnetic drive 20 (sometimes also referred to as the "magnetic drive mechanism", the "drive", and variants thereof) of the swing apparatus 10. FIGS. 4 and 5 show the arrangement and configuration of a swing arm portion 30 of the magnetic drive 20, i.e., components of the magnetic drive 20 that are directly or indirectly coupled to the swing arm 17. Generally, these components of the swing arm portion 30 can undergo some form of motion (linear, rotary, and/or the like) during swing motion. The pivot axis shaft 19 is held in place, while permitting rotatability, by a frame arm portion 40 of the magnetic drive 20, i.e., components of the magnetic drive that are directly or indirectly coupled to the frame arm 14 (see FIGS. 6 and 7). Generally, these components of the frame arm portion 40 can be static during swing motion. The pivot axis shaft 19 also rotatably supports the swing arm assembly 15 by longitudinally spaced bearings 27 that can be mounted on an electromagnet or inductor bracket 151 that holds the electromagnet 51 in place. The swing arm portion 30 houses permanent magnets 52, 53 in an arc $AR_{PM}$ that is centered on the axis of rotation P-P', with each permanent magnet 52, 53 having a different angular separation from the pivot plane PP. However, as explained in greater detail with respect to FIGS. 31-34, any suitable number of permanent magnets can be employed. The permanent magnets 52, 53 are disposed on a permanent magnet bracket 152 that in turn is coupled to the hub 16 and the swing arm 17.

FIG. 5 illustrates that, for the example two-permanent magnet layout illustrated, the angular separation of the magnets 52, 53 from the pivot plane PP (e.g., based on the angular separation of a geometric center, a mass center, and/or other predetermined point of the magnet) and about the pivot axis P-P' can be substantially similar to the maximum swing angle α. The permanent magnets 52, 53 can be formed from ceramic ferrite. Alternatively, however, the permanent magnets 52, 53 can be constructed from neodymium or other equivalent materials.

Each of the permanent magnets 52, 53 defines a North pole and a South pole, and the magnets 52, 53 can be arranged such that they are oriented with alternating poles (also sometimes referred to as polarities) facing the pivot axis shaft 19. For example, the magnet 52 can have (as illustrated) its North pole facing away from the shaft 19, and its South pole facing towards from the shaft 19. The magnet 53 can have (as illustrated) its South pole facing away from the shaft 19, and its North pole facing the shaft 19. Alternatively, the permanent magnets 52, 53 can be arranged with the opposite polarities as noted above in the way of example.

The frame arm portion 40 can be fixed to an upper end of the upright frame support 14, e.g., to an end of the turning member 14*a*, or to the frame arm 14 itself. The frame arm portion 40 supports, is coupled to, and/or otherwise includes an electromagnet 51, although any suitable temporary magnet that can controllably switch its magnetic poles can be employed. The electromagnet 51 can be controlled (such as by, for example, via a controller such as the controller 2102, as explained in more detail with respect to FIGS. 21A-21D) to define two poles, North and South, that can be switched, and oriented such that one of these switchable poles faces the pivot axis shaft 19 and the magnets 52, 53, and the other faces away.

Figure 7:
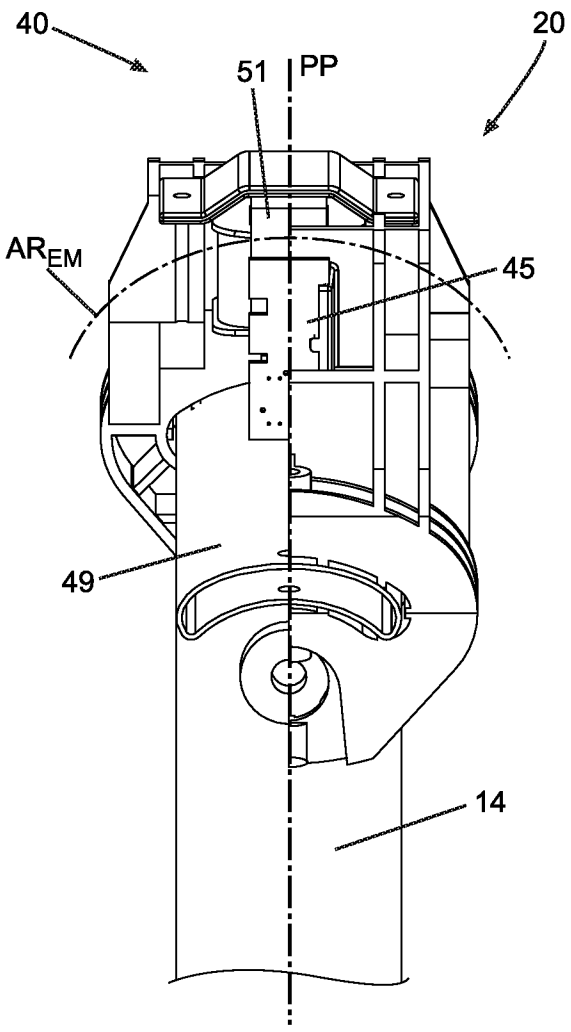
FIG. 7 is an enlarged top perspective view of the portion of the magnetic drive illustrated in FIG. 6.
Figure 6:
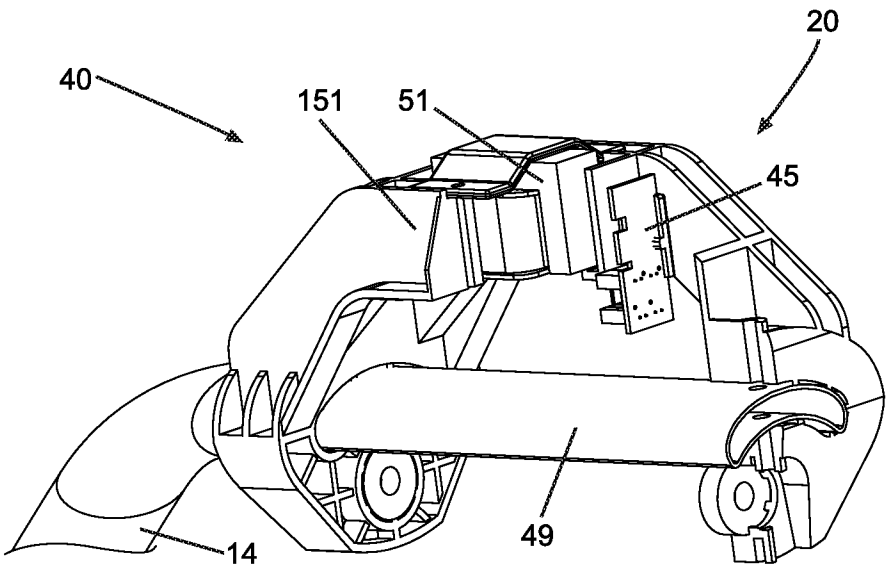
FIG. 6 is an enlarged side perspective view of a portion of the magnetic drive of the swing apparatus of FIG. 1, coupled to the frame arm and holding the electromagnet(s).

As best illustrated in FIGS. 8-11, an optical sensor 45 is fixedly secured to the frame arm portion 40, and is communicably coupled with the controller 2102. The optical sensor 45 is optical coupled to and/or engageable with, during use, a slotted strip 35 that is fixedly secured to the swing arm portion 30. The optical sensor 45 includes sensing brackets 46, 47 with corresponding sensing beams 46*a*, 47*a*, and can be centered about the pivot axis P-P', i.e., the plane PP can pass through the optical sensor 45, as illustrated in FIG. 7. For example, each bracket 46, 47 can include a light emitting diode (LED, not shown)) emitting its sensing beam 46*a*, 47*a*, that is detectable by a photodetector (e.g., a photodiode) opposedly disposed to its corresponding LED, on that bracket. The LEDs can continuously emit beams 46*a*, 47*a* during use and these beams can be continuously detectable by the photodetector. While illustrated here as collimated beams, it is understood that the beams 46*a*, 47*a* may exhibit some degree of convergence and/or divergence, i.e., be conically shaped. As explained in greater detail herein, the use of two sensing beams 46*a*, 47*a* can be useful for detecting change in swing direction. Additionally, the combination of each LED and its corresponding photodetector can be considered an optical sensor, such that the optical sensor 45 encompasses a pair of optical sensors as illustrated, and can generally include any suitable number of LED-photodetector pairs as optical sensors.

Figure 10:
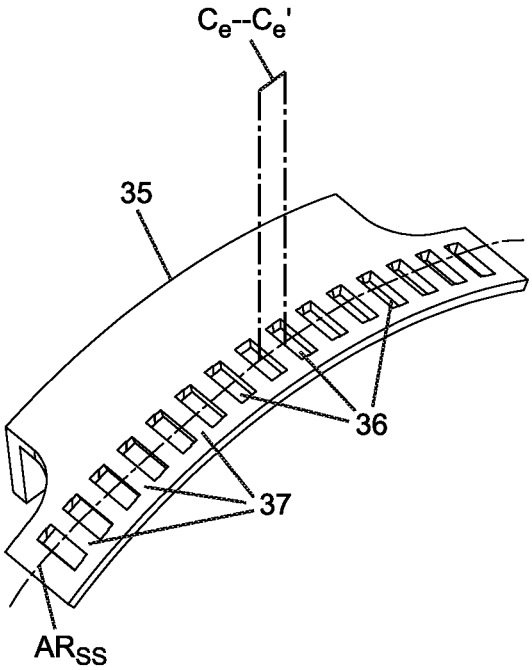
FIG. 10 is an enlarged view of the slotted encoder illustrated in FIG. 9.
Figure 11:
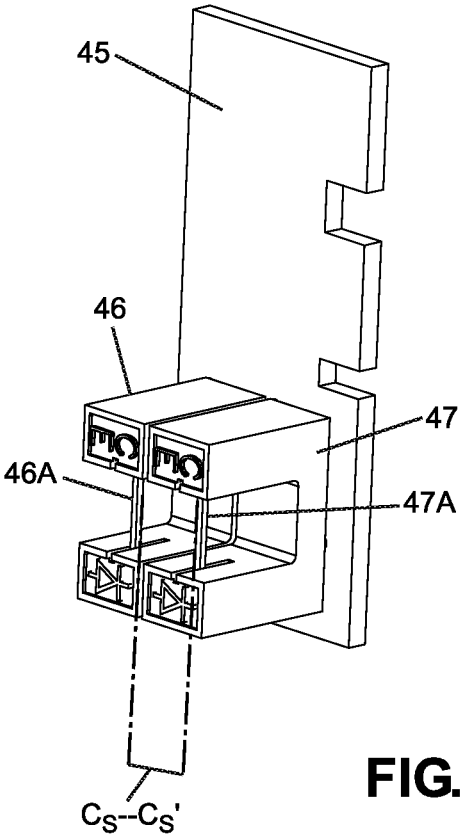
FIG. 11 is an enlarged view of the optic sensors illustrated in FIG. 9.

The slotted strip 35 (also sometimes referred to as an "encoder", "optical encoder", "optical strip", "encoder strip", and variants thereof), as illustrated in FIG. 10, includes slots 36 and a body portion 37. As illustrated, the slotted strip 35 may be generally curved in form, and define a curvature/arc $AR_{SS}$ that is that is centered about the pivot axis P-P'. The slotted strip 35 may include from about 6 to about 20 slots (reference number 36), including all values and sub-ranges in between. about 1 degree of swing angle to about 3 degrees of swing angle or greater at the pivot axis P-P', including all values and sub-ranges in between. A center-to-center separation $C_s$-$C_s$' between adjacent slots 36 (see FIG. 10) can be from about 0.15 inches, about 0.21 inches, about 0.3 inches, about 0.4 inches, to about 0.5 inches, including all values and sub-ranges in between. The slots 36 can be formed as cutouts in the strip 35. In some cases, the slots 36 can include a film, window, and/or other layer disposed thereof that is substantially optically transparent at the wavelength(s) of the sensing beams 46*a*, 47*a*. In contrast, the body portion 37 can be composed of any suitable material that is optically opaque to the wavelength(s) of the sensing beams 46*a*, 47*a*. The curvature of the strip 35 and the separation $C_s$-$C_s$' can be selected such that the angular separation between centers of adjacent slots (i.e., based on the angle subtended by the adjacent slots at the pivot axis P-P') can be from about 1 degree to about 3 degrees, including all values and sub-ranges in between. The number of slots can be selected such that the angular separation between the first and last slot 36 is at least equal to the maximum permissible swing angle $\alpha$.

The optical sensor 45 and the slotted strip 35 are positioned with respect to each other such that, when the swing arm portion 30 is in rotary motion about the P-P' axis, the slotted strip 35 passes through the sensing brackets 46, 47 and engages with the sensing beams 46*a*, 47*a*. While the slots 36 permit the beams 46*a*, 47*a* to pass through them, the body portion 37 blocks this continuity of the beams. Said another way, the sensor beams 46*a* and 47*a* can be 'tripped' by the body portion 37. It is generally understood that, depending on the beam width relative to the widths of the slots 36 and the body portion 37 between the slots, a sensing beam may not be completely blocked by the body portion 37. The body portion 37 between adjacent slots can also be referred to as a "photointerrupter", so that the strip 35 can generally be considered to include interleaved or successive slots and photointerrupters.

Nevertheless, if the optical signal detected at a photodetector of the optical sensor 45 is below a predetermined threshold, it can be deemed, by a controller, that the corresponding sensing beam is blocked by a photointerrupter. Conversely, a sensing beam may not be fully transmitted by a slot 36, but if the optical signal detected at the photodetector is above a predetermined threshold, it can be deemed that the corresponding sensing beam is being transmitted through one of the slots 36. In some cases, each photodetector of the optical sensor 45 can further include a slit that limits the width of the optical signal that reaches it.

This disruption in the transmission of the beams 46*a*, 47*a* is detectable by the photodetectors of the sensor 45 and can generally resemble, for example a periodic signal that is different for each photodetector, with maxima at the times where the slots 36 engage with that beam, and minima at the times where the body portion 37 engages with that beams. This is explained in greater detail for FIG. 21C. Since the beams 46*a*, 47*a* have finite cross-sectional width that can be wider or narrower than the slots 36 and body portion 37 between consecutive slots at the point of interaction, it is not necessary that the entirety of the beam is blocked by the body portion 37 when interacting with it. Similarly, it is not necessary that the entirety of the beam, by virtue of its width, passes through a slot 36. Accordingly, it is understood that the beams 46*a*, 47*a* can be deemed to be passing through a slot 36 when the detected signal at the photodetectors is above a predetermined threshold. Similarly, the beams 46*a*, 47*a* can be deemed to be blocked by the body portion 37 when the detected signal at the photodetectors is below a predetermined threshold, and not necessarily zero.

A center-to-center separation $C_e$-$C_e$ between the beams 46*a*, 47*a* can be from about 0.25 inches, 0.26 inches, to about 0.4 inches, including all values and sub-ranges in between. In some cases, the separation $C_e$-$C_e$ can be such that at least one complete slot 36 is always disposed between the beams 46*a*, 47*a* during swing motion. Generally, the result of such a separation is that when one of the sensing beams (e.g., the beam 46*a*) is centered on a slot 36 and is not blocked, the other beam (e.g., the beam 47*a*) will be on or encompass an edge of another slot 36, and transitioning from being blocked or unblocked to the other state. Similarly, if one of the sensing beams 46*a*, 47*a* is centered on a portion between slots 36, the other beam will be on or encompass an edge of another slot 36 and transitioning from blocked to unblocked or vice versa, depending on swing direction.

In some cases, the separation $C_e$-$C_e$ can be such that at least portions of two slots 36, and the body portion 37 (i.e., a photointerrupter) therebetween, are always disposed between the beams 46*a*, 47*a* during swing motion. As explained in greater detail herein, such separation $C_e$-$C_e$' can provide increased resolution of swing motion determination compared to conventional techniques.

Figure 8:
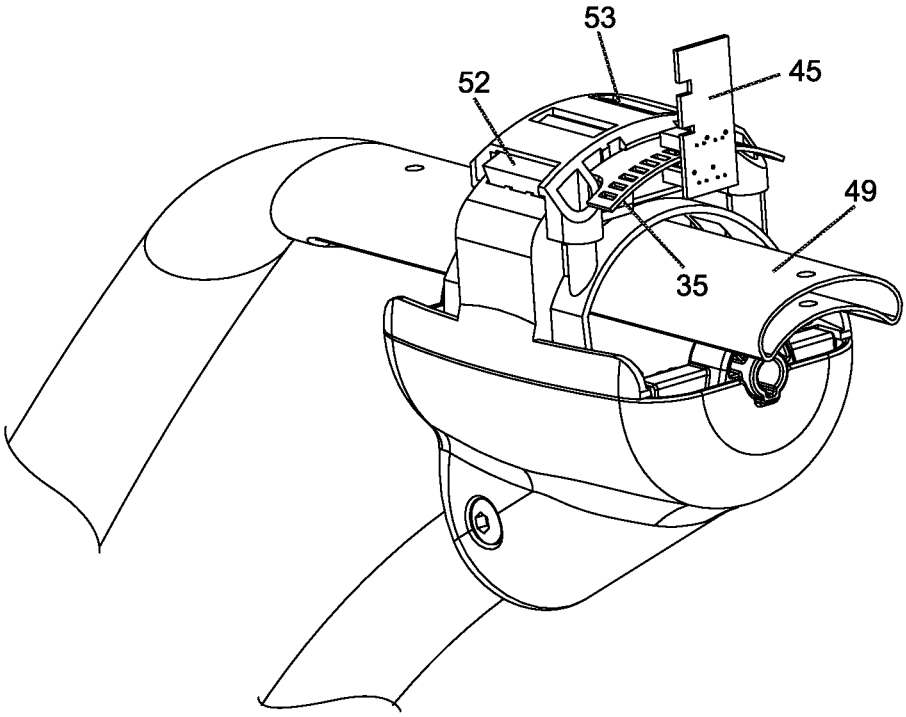
FIG. 8 illustrates the portion of the magnetic drive coupled to the swing arm, showing the positioning of optical sensors.
Figure 9:
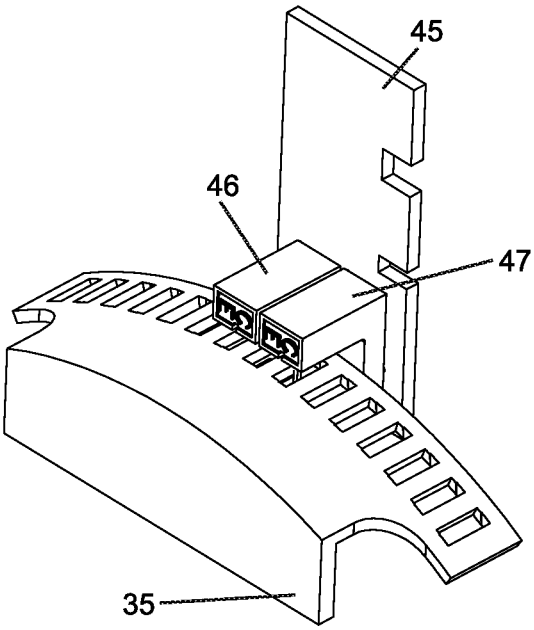
FIG. 9 is an enlarged view of the optical sensors shown in FIG. 8, also illustrates a slotted encoder movable between the light sources and detectors of the optical sensors.

FIG. 8 illustrates a hollow shield 49 formed as an extension of the frame support 14 and/or the turning member 14*a*, and mechanically supports the pivot axis shaft 19 as well as the permanent magnets 31-33. As illustrated, the shield can be curved and/or otherwise include an indentation to accommodate the pivot axis shaft 19 in part or whole. For example, the curvature of the indentation can be selected to match the curvature of the pivot axis shaft 19. The shield 49 can also provide a passageway for electrical and/or electronic wiring (e.g., to power the controller 2102, the user interface panel 22, and/or the like). Further, the shield 49 can provide a mechanical stop for the movement of the swing arm assembly 15, i.e., physically limit the swing angle. In some cases, a mechanical stop, such as a casing of the housing 21, can prevent the swing arm assembly 15 from significantly exceeding the desired maximum swing angle α, since this may make the swing apparatus 10 unstable and prone to overturning.

Several structural aspects of the magnetic drive 20 provide benefits over conventional approaches. As an example, none of the components of the magnetic drive 20 such as the permanent magnets, electromagnets, optical sensor, control circuit, and/or the like are directly formed or coupled to the seat 18. As a result the seat design is simplified and can be based on predominantly mechanical, rather than electrical or magnetic, considerations. Safety is also improved by spacing these components from a child user of the seat. Further, modularity of seat design can be achieved without bothering with how it may affect the placement of these various components. One beneficial result is the ability to seamlessly replace the seat upon damage, wear, or even when new designs of the seat are available. Additional benefits include a relatively lighter seat/seat frame that in turn makes it easily detachable and transportable, and further makes it integratable into other child products such as, for example, car seats, playards, strollers, and/or the like.

As another example, with the magnetic drive 20 removed from the seat and with the pivot axis P-P' also not associated with the seat frame, the components of the magnetic drive 20 can be placed closer to the pivot axis P-P' of rotation/rotary motion compared to conventional approaches, thereby resulting in a smaller size/less bulky casing for the magnetic drive overall. Closer placement also enables the placement of the permanent magnets 52, 53 and electromagnet 51 closer to each other. Since the magnetic forces, both attractive and repulsive, between two magnetic poles increases with increasing proximity, the result is that closer placement of the permanent magnets and electromagnets yields greater coupling and greater forces that can be exploited to provide a wider range of swing motion, i.e., for translation of the electrical energy supplied to the electromagnet 51 to magnetic forces and ultimately to mechanical swing motion. Closer placement also permits control of tolerances between the magnets 52, 53 and the electromagnet 51. Conversely, the same range of swing motion as conventional approaches can be provided with smaller and/or less strong magnets compared. This can result in spatial benefits and cost savings due to the use of smaller, weaker magnets and electromagnets. Further, no gears and/or gearboxes are employed by the magnetic drives (including magnetic drive 20) described herein, which in turn avoids the bulk and noise associated with gearbox-based drives, including DC motor drives that, while employing magnets, nevertheless also employ gearboxes.

Magnetic Drive Operation

Figure 12:
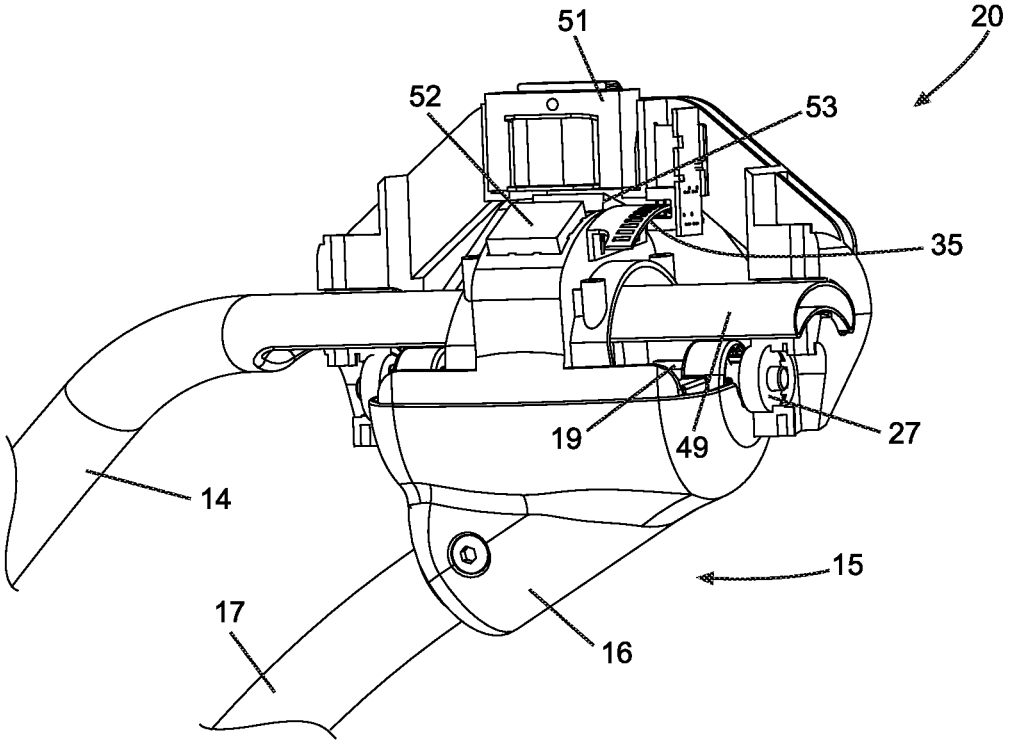
FIG. 12 is an enlarged view of the magnetic drive with the housing removed, where the magnetic drive includes two permanent magnets and one electromagnet.
Figure 13:
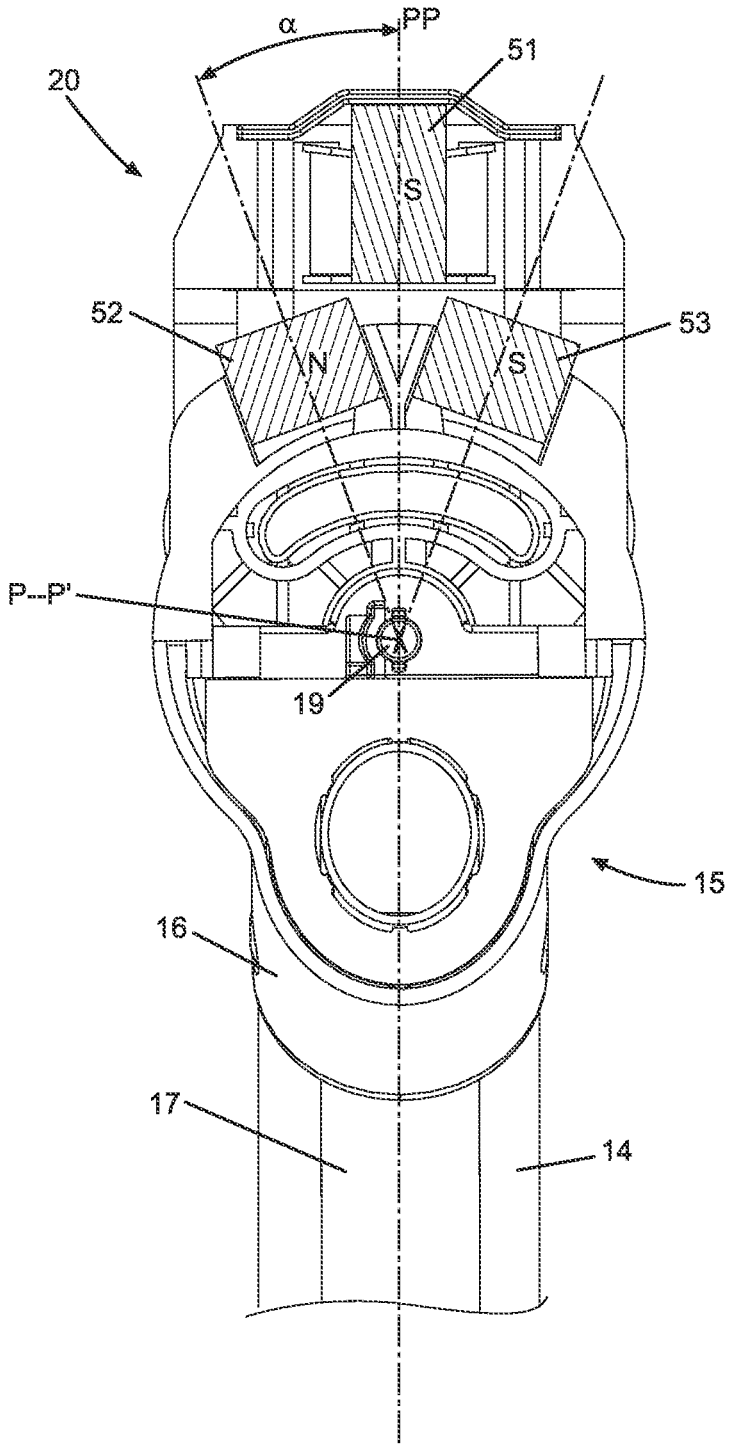
FIG. 13 is an enlarged front view of the magnetic drive illustrated in FIG. 12 in the neutral/rest position.
Figure 15:
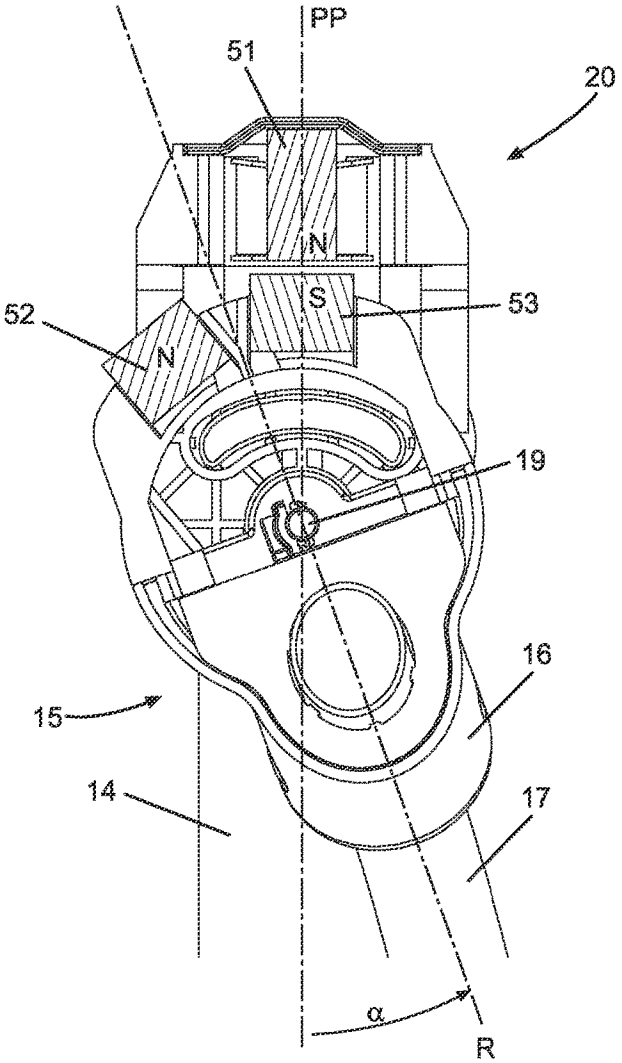
FIG. 15 is an enlarged front view of the magnetic drive as shown in FIG. 13, with the swing arm rotated to a maximum deflection/maximum swing angle to the right when viewed facing the swing seat.
Figure 14:
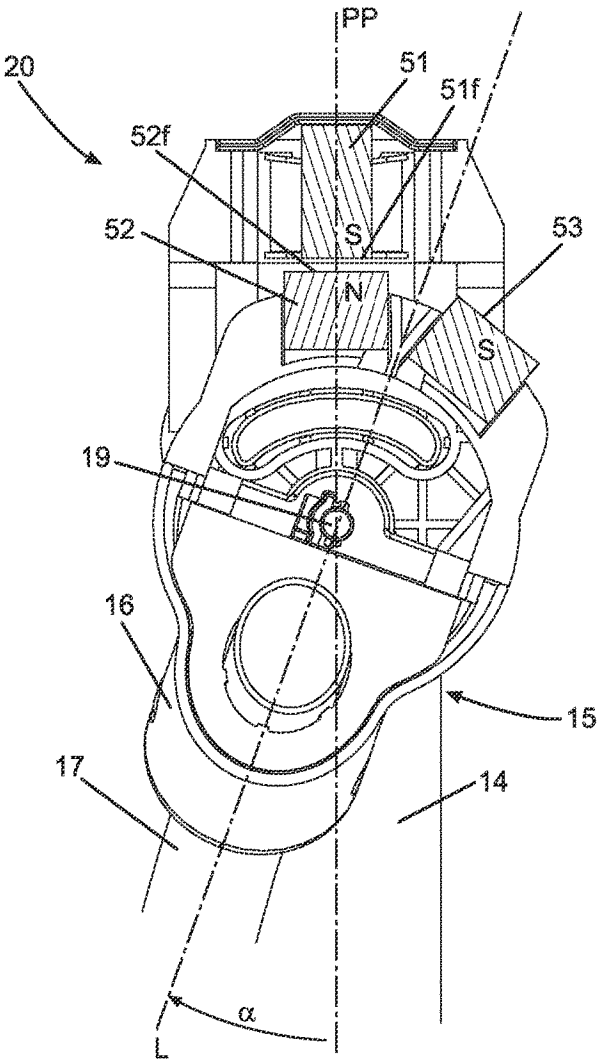
FIG. 14 is an enlarged front view of the magnetic drive as shown in FIG. 13, with the swing arm rotated to a maximum deflection/maximum swing angle to the left.

FIGS. 12-14 illustrate configurations and operation of the magnetic drive 20, with the swing arm portion 30 and the frame arm portion 40 assembled, and with the housing 21 removed for clarity. Employing the example configuration of the two permanent magnets 52, 53 (see FIGS. 4-5) and the one electromagnet 51 (see FIGS. 6, 7), when assembled and at rest or at neutral, the electromagnet 51 can be positioned angularly between (e.g., angularly mid-way between) the magnets 52, 53, with respect to the pivot axis P-P', i.e., in an interleaved manner. FIGS. 14-15 illustrate that the electromagnet 51, 42 can be positioned to be in the pivot plane PP in the neutral or rest position or state, which can be considered the position/state when no activation current is applied to the electromagnet 51, such that non-magnetic forces, such as gravity acting on the movable swing arm assembly 15, predominantly determine the positioning of the electromagnet 51 and the magnets 52, 53. It is noted that the neutral/rest position is also fleetingly attained when the swing apparatus 10 is in motion.

In the neutral/rest position (e.g., see FIG. 13), the magnets 52, 53 and the electromagnet 51 can be considered to be disposed on a side of the pivot axis P-P' (also sometimes referred to as a "first side"), whereas the seat 18 is disposed on a different side of the pivot axis P-P' (also sometimes referred to as a "second side"). For example, the seat is disposed between the pivot axis P-P' and horizontal surface (e.g., floor) that the swing apparatus 10 sits on, while the magnets 52, 53 and the electromagnet 51 are disposed in the space above the pivot axis P-P'. Such separation can provide for a more compact design, with the seat 18 as well as the electromagnet 51/magnets 52, 53 being disposable closer to the pivot axis P-P' without the other component therebetween. A compact design where the electromagnet and permanent magnets are closer to the pivot axis P-P' also allows for the use of smaller and/or weaker magnets, since the magnetic forces therebetween need be sufficient for moving the permanent magnets through a relatively smaller arc length of the swing motion.

For example, linear separation or distance between a center of mass or geometric center of the electromagnet 51 and the pivot axis P-P' can be at most about 1 inch, about 2 inches, about 3 inches, about 4 inches, about 5 inches, about 6 inches, including all values and sub-ranges in between. Additionally or alternatively, linear separation or distance between a geometric center of a face of the electromagnet 51 (e.g., the face 51*f*) and the pivot axis P-P' can be at most about 0.5 inches, about 1 inch, about 2 inches, about 2.35 inches, about 2.5 inches, about 3 inches, about 4 inches, about 5 inches, including all values and sub-ranges in between. Similarly, linear separation or distance between a center of mass or geometric center of one of the permanent magnets 52, 53 and the pivot axis P-P' can be at most about 0.5 inches, about 1 inch, 1.87 inches, about 2 inches, about 2.5 inches, about 3 inches, about 4 inches, about 5 inches, including all values and sub-ranges in between. Additionally or alternatively, linear separation or distance between a geometric center of a face of one of the permanent magnets 52, 53 (e.g., the face 52*f*) and the pivot axis P-P' can be at most from about 0.5 inches, about 1inch, 1.5 inches, about 2 inches, about 2.25 inches, about 2.5 inches, about 3 inches, about 4 inches, about 5 inches, including all values and sub-ranges in between.

As explained in greater detail below, when the magnetic drive is laid out and in an initial position as illustrated in FIGS. 12-13, and when the electromagnet 51 are energized, the attractive and repulsive forces generated between the magnets 52, 53 and the electromagnet 51 can start the swing arm assembly 15 rotating about the pivot axis P-P' in the L or R direction. During such motion, the magnets 52, 53 can pass the electromagnet 51 in close proximity (e.g., within about 0.02 inches, about 0.025 inches, about 0.03 inches, about 0.04 inches, about 0.05 inches, including all values and sub-ranges in between) without touching, maintaining an air gap as the swing arm portion 30 rotates about the pivot axis P-P' relative to the static frame arm portion 40.

A caretaker/user can initiate operation of the magnetic drive 20, and set various parameters for operation, using the panel 22. For example, a caretaker/user can use controls 23 and dial 25 to select the swing angle α (or an equivalent indicator thereof such as, for example, a level 5) for the swing arm assembly 15 and accordingly for the magnetic drive 20. The caretaker can also use the controls 23 and dial 25 to specify a duration of time the swing arm assembly, and hence the magnetic drive apparatus 20, is to be operated. In the event no selection is made for either parameter, a default value of a maximum swing angle can be employed, and with continuous operation or with a predetermined time limit (e.g., 20 minutes). The maximum swing angle α of the motion of the swing arm assembly 15 can be defined by the spatial locations of the magnets 52, 53 and more specifically, by the angular separation between each of the magnets 52, 53 and the electromagnet 51.

The permanent magnets 52, 53 have pre-established, permanent magnetic poles, as described above, and FIGS. 13-15 illustrate one such example of pre-established poles. The electromagnet 51, has no poles until energized by an electrical current (e.g., from an electrical source such as a wall outlet or batteries). With the magnetic drive in the state of FIG. 13, the swing arm assembly 15 will begin to rotate to the left direction L (see FIG. 14), since the North pole of the magnet 52 is attracted to the South pole of the electromagnet 51. This rotation is further enhanced by the repulsion between the South poles of the magnet 53 and the electromagnet 51. As shown in FIG. 14, the rotation is affected through the swing angle α and results in the attractive poles between the magnet 52 and the electromagnet 51 aligning.

Generally, alignment and attractive forces between a permanent magnet and an electromagnet, i.e., between their opposing faces/poles, can be maximal when the overlap between these opposing faces/poles is maximal. Using the magnet 52 and electromagnet 51 in FIG. 14 as a representative example that is generally applicable to any electromagnet-permanent magnet interaction as disclosed herein, the attractive force between these can maximal when they are aligned as illustrated in FIG. 14. In this alignment, the face 52*f* of magnet 52 and the face 51*f* of the electromagnet 51 are generally parallel and/or otherwise maximally aligned, and perpendicular to the pivot plane PP. The air or separation gap between the faces 51*f* and 52*f* can be about 0.3 inches or less, about 0.2 inches or less, about 0.15 inches or less, about 0.1 inches or less, about 0.05 inches or less, or about 0.025 inches or less, including all values and sub-ranges in between. The plane PP can also pass through the geometric, mass, or magnetic center of the magnet 52 and the electromagnet 51. Accordingly, some alignment that is less than the maximal alignment (also sometimes referred to as "magnetic alignment") can occur between the magnet 52 and electromagnet 51 when not in the position illustrated in FIG. 14. For example, if the maximum swing angle α is 18 degrees and a user's input (via the panel 22 and the dial 25) maps to a swing angle α of about 12 degrees, then the magnet 52 can move towards the electromagnet 51 from its resting location, but not to the extent that it attains the maximal alignment illustrated in FIG. 14. This can be achieved by modulating the energization of the electromagnet 51, which in turn affects the attractive force generated between the magnet 52 and the electromagnet 51, in accordance with the user's input for the swing angle α, as explained in more detail later.

In some cases due to inertia, the magnetic drive can overshoot past the desired swing angle α, an effect that can be counterbalanced/dampened by both the weight of the swing arm assembly (including any child in the seat frame 18) as well as the continuing attractive forces between the magnet 52 and the electromagnet 51. In some cases, due to similar weight considerations, the magnetic forces between the electromagnet 51 and the permanent magnets 52, 53 may be insufficient (e.g., too weak to overcome countervailing gravitational forces) to move the swing arm assembly 15 all the way through the swing angle α, and may move the swing arm assembly partially toward that position.

During this movement of the swing arm assembly 15, the slotted strip 35 passes through the sensing brackets 46, 47 as described above, and this motion can be employed by the controller 2102 to detect the direction of motion of the swing arm assembly 15, as well as when the direction of motion as changed. Upon detecting a change in direction of motion, the controller 2102 can then switch the poles/polarities of the electromagnet 51 (see FIG. 15) such that a North pole of the electromagnet 51 now interacts with the magnets 52, 53.

Now, the electromagnet 51 repels the magnet 52 and attracts the magnet 53. These simultaneous magnetic forces, along with gravitational forces, cause the swing arm assembly 15 to rotate in the opposite direction (i.e., the right direction R, see FIG. 15). The magnetic drive 20 may fully or partially swing through the swing angle α in the right direction R. When another change in direction is detected, the controller 2102 can again switch poles of the electromagnet 51, and the magnetic drive 20 will move towards the left direction L again.

Figure 16:
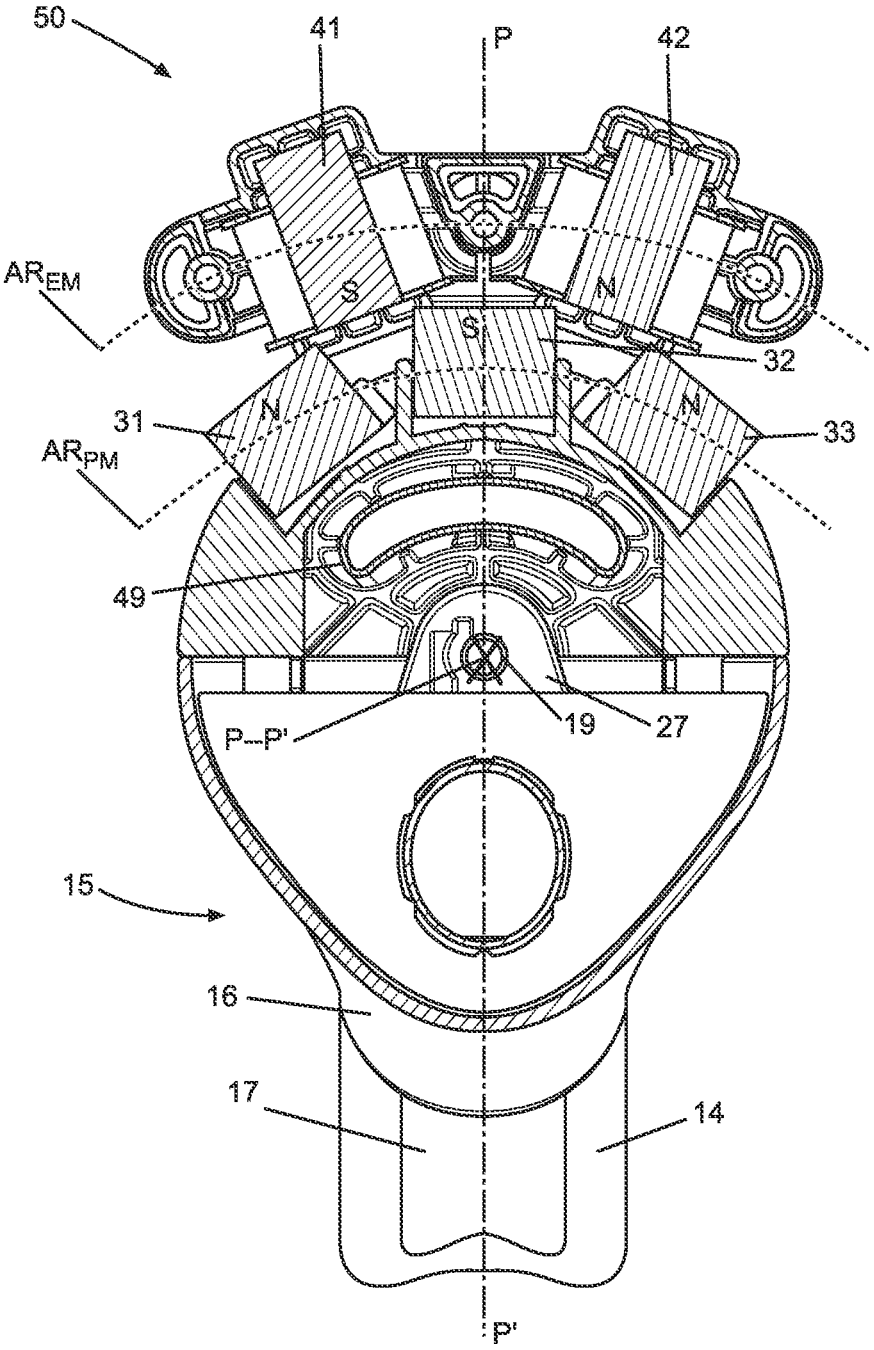
FIG. 16 illustrates another magnetic drive for a swing apparatus that includes three permanent magnets and two electromagnets.
Figure 18:
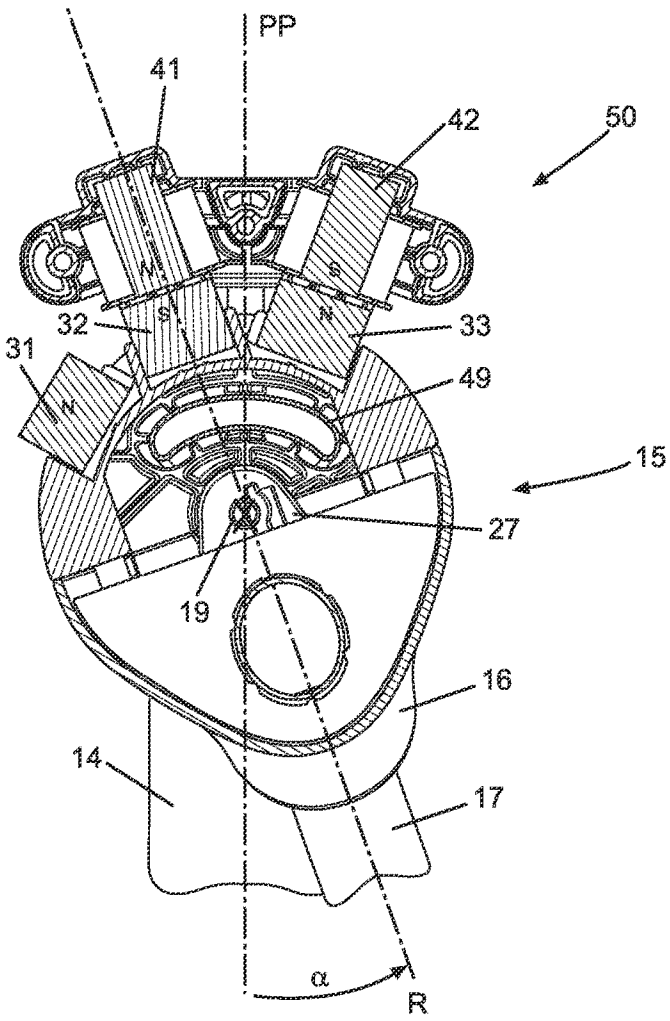
FIG. 18 illustrates the magnetic drive of FIG. 16, with the swing arm rotated to a maximum deflection/maximum swing angle to the right.
Figure 17:
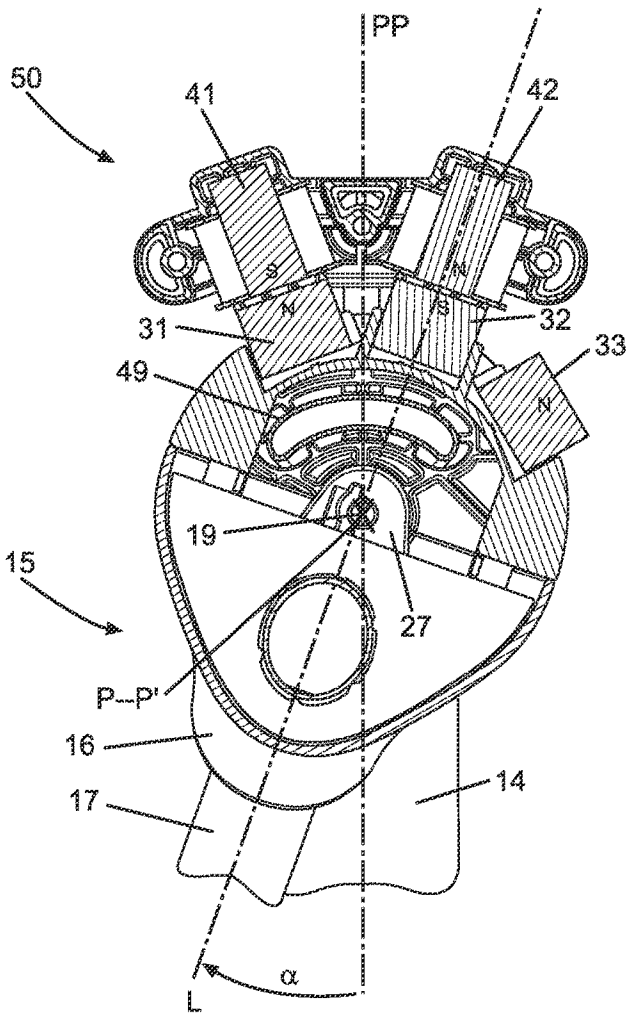
FIG. 17 illustrates the magnetic drive of FIG. 16 with the swing arm rotated to a maximum deflection/maximum swing angle to the left.

FIGS. 16-18 illustrate another swing apparatus 50. Unless expressly indicated otherwise, similarly referenced and names components may be structurally and/or functionally similar to those of the apparatus 10. In contrast to the apparatus 10 which includes a single, centrally positioned (i.e., aligned with the pivot plane PP), electromagnet 51 and a pair of permanent magnets 52, 53 angularly offset from the pivot plane PP, the apparatus 50 includes three magnets 31-33 and two electromagnets 41, 42. Similar to the magnets 31-33, the electromagnets 41, 42 can also be positioned in an arc centered on the pivot axis P-P'. Similar to the permanent magnets, each electromagnet 41, 42 can have a different angular separation from the pivot plane PP about the pivot axis P-P'. Here, FIG. 16 illustrates that, for the example two-electromagnet layout illustrated, the electromagnets 41, 42 can be equally separated from the pivot plane PP and about the pivot axis P-P' can be about half the maximum permissible swing angle α.

In the apparatus 50 as illustrated, upon initiating operation, the electromagnet 41 can be energized to have a South pole facing the magnets 31-33 and the electromagnet 42 can be energized to have a North pole facing the magnets 31-33. This results in attractive forces between the magnet 31 and the electromagnet 41 as well as between the magnet 32 and the electromagnet 42, and repulsive forces between the magnet 32 and the electromagnet 41 as well as between the magnet 33 and the electromagnet 42. This urges the swing arm assembly 15 to the left (see FIG. 17). FIG. 17 illustrates that the maximum angular deflection of the swing arm assembly 15 (i.e., the maximum swing angle α) to the left can occur when the magnet 32 is aligned with the electromagnet 42. In some cases, the magnet 32 can shoot past the electromagnet 42 due to momentum, while in other cases, the magnet 32 may not achieve the alignment illustrated in FIG. 17 such as due to, for example, weight of the child, insufficient energization of the electromagnet 51, and/or the like. FIGS. 16-18 illustrate the scenario when the user selects the maximum swing angle α resulting in maximal alignment between the electromagnets 41, 42 and the permanent magnets 31, 32 respectively (FIG. 17) during swing motion in one direction, and in maximal alignment between the electromagnets 41, 42 and the permanent magnets 32, 33 (FIG. 18) during swing motion in the other direction. As explained above for FIGS. 13-15, a user can select less than the maximum swing angle α, in which case the extent of alignment between the electromagnets 41, 42 and the permanent magnets 31-33 is lower.

FIG. 18 illustrates the apparatus 50 when the electromagnets 41, 42 are subsequently energized to have their North, South poles respectively facing the magnets 31-33, resulting in rotation of the swing arm assembly 15 towards the right. Similar to the apparatus 10, the apparatus 50 can include an optical sensor (e.g., the sensor 45) that cooperates with a slotted strip (e.g., the strip 35) and the controller 2102, such as to ascertain a change in direction of the swing motion and to switch polarities of the electromagnets 41, 42.

Generally, the configuration of apparatus 50, with two electromagnets 41, 42 and three permanent magnets 31-33, generates magnetic forces, both attractive and repulsive, of greater magnitude compared to the apparatus 10. Hence, the configuration of apparatus 20 can be employed when greater magnetic forces can be required (such as with a heavier seat and/or user), for tighter control of swing, and/or the like. In contrast, for the configuration of the apparatus 10, centering the electromagnet 51 at the pivot plane PP and having the magnets 52, 53 angularly offset from the pivot plane PP by the maximum swing angle α (e.g., twenty degrees) can provide similar operational results to the apparatus 10 but with fewer parts, and in turn at a lower cost.

Figure 19:
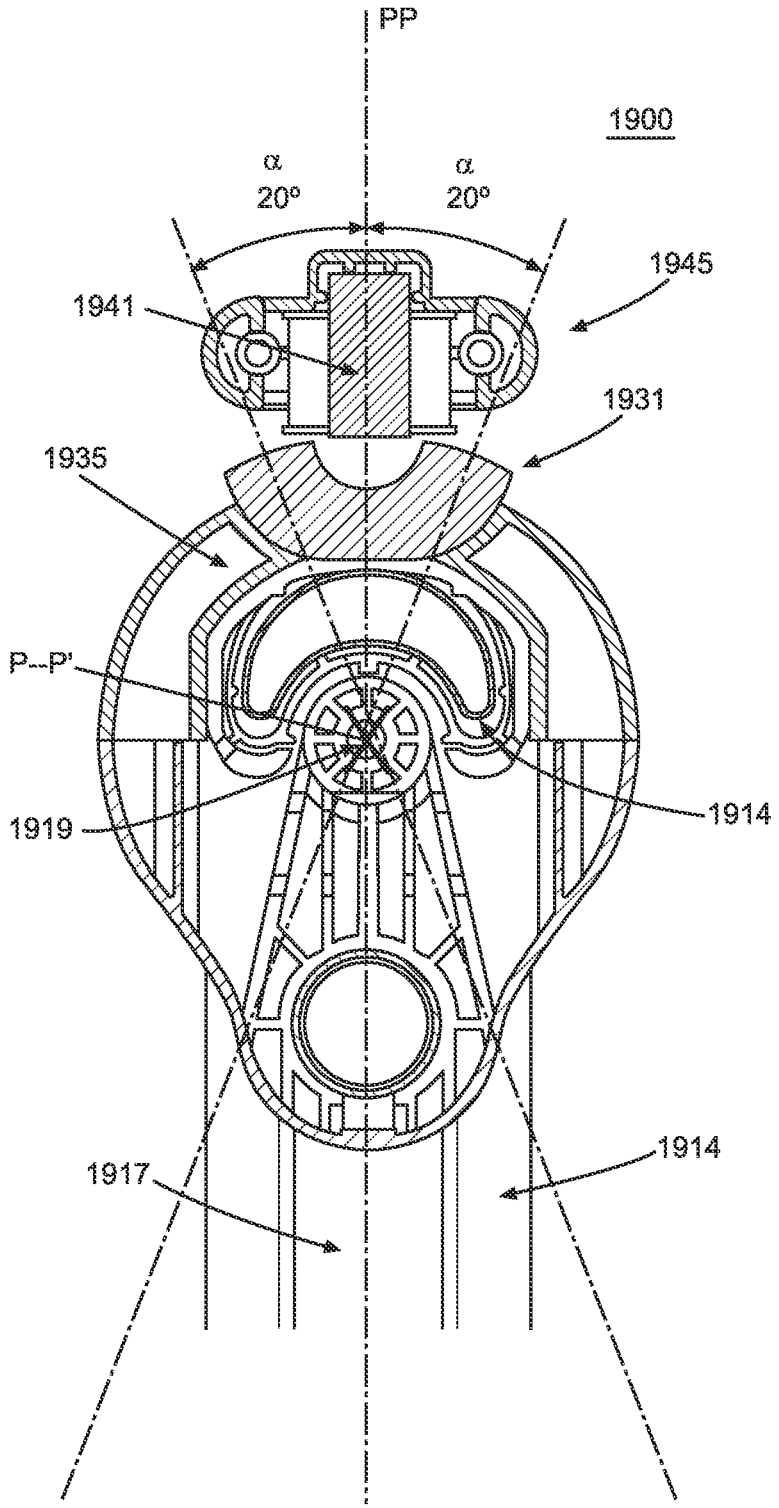
FIG. 19 illustrates another magnetic drive for a swing apparatus that includes one permanent magnet and one electromagnet.

FIGS. 19, 20A-20D illustrate another swing apparatus 1900. Unless expressly indicated otherwise, similarly referenced and names components may be structurally and/or functionally similar to those of the apparatus 10 and/or the apparatus 50. The apparatus 1900 includes an electromagnet 1941 that is mounted to the swing frame assembly 12 via an inductor bracket 1945. A permanent magnet 1931 is affixed to a magnet bracket 1935 and centered at the pivot plane PP. Here, the magnet 1931 is a curved magnet that is also geometrically centered at the pivot plane PP, but is sized and formed such that the faces of its North and South Poles 1931*a*, 1931*b* respectively, define axes (i.e., axes perpendicular to the faces of the poles and passing through the pivot axis P-P') that are angularly separated from the pivot plane PP to define the maximum swing angle α (e.g., 20 degrees, as illustrated in FIG. 19). As generally explained for the apparatus 10, the magnet 1931, and the swing arm 1917 can rotate relative to the electromagnet 1941 about the pivot axis shaft 1919.

Figure 20B:
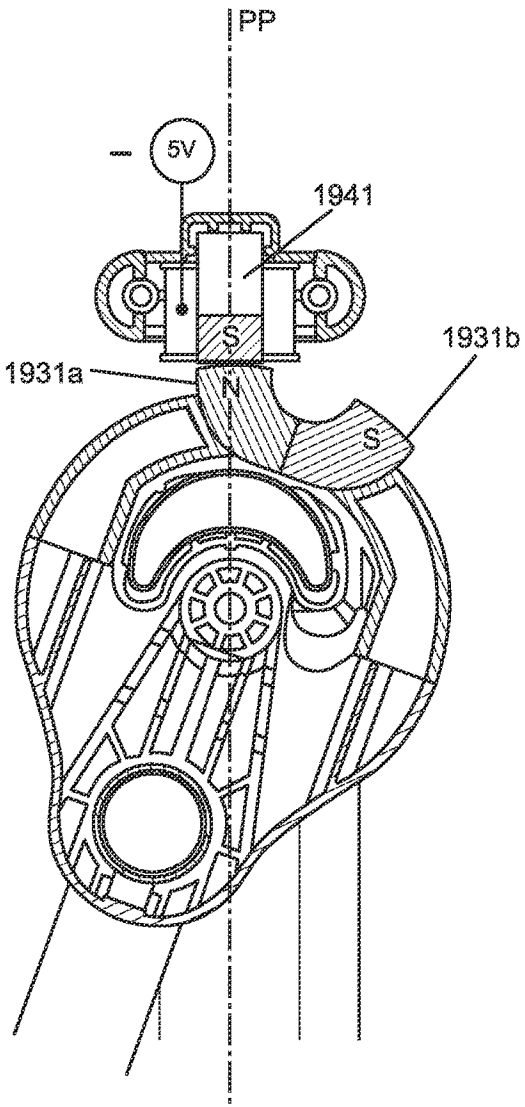
FIG. 20B illustrates the magnetic drive of FIG. 19 with the swing arm being rotated to a maximum deflection/maximum swing angle to the left.
Figure 20A:
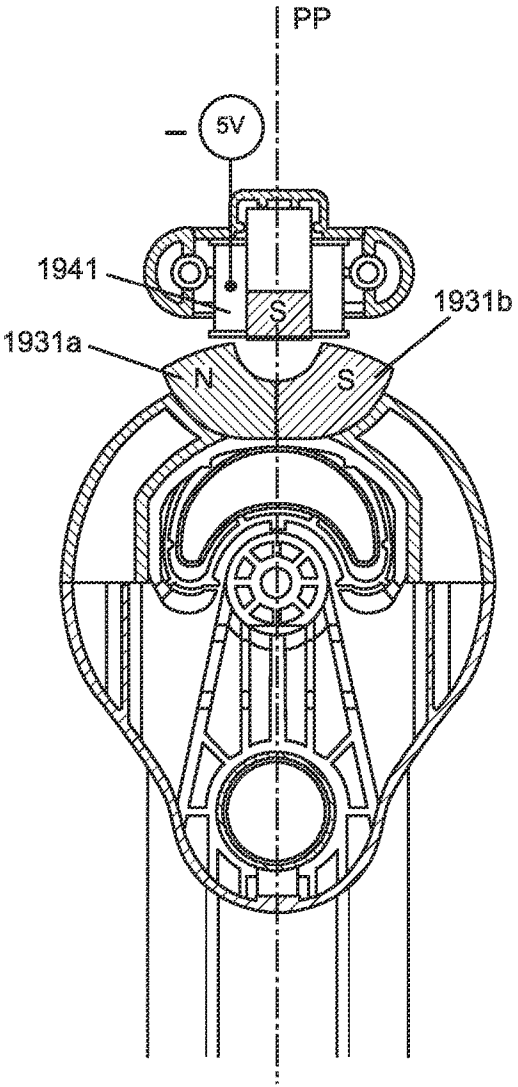
FIG. 20A illustrates the magnetic drive of FIG. 19 with the permanent magnet and the electromagnet having polarities that result in deflection of the swing arm to the left.
Figure 20D:
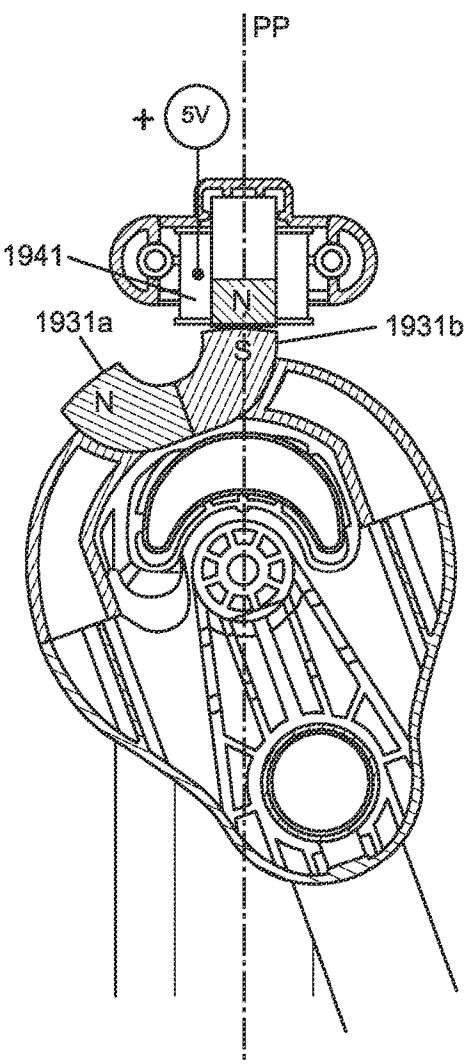
FIG. 20D illustrates the magnetic drive of FIG. 19 with the swing arm being rotated to a maximum deflection/maximum swing angle to the right.
Figure 20C:
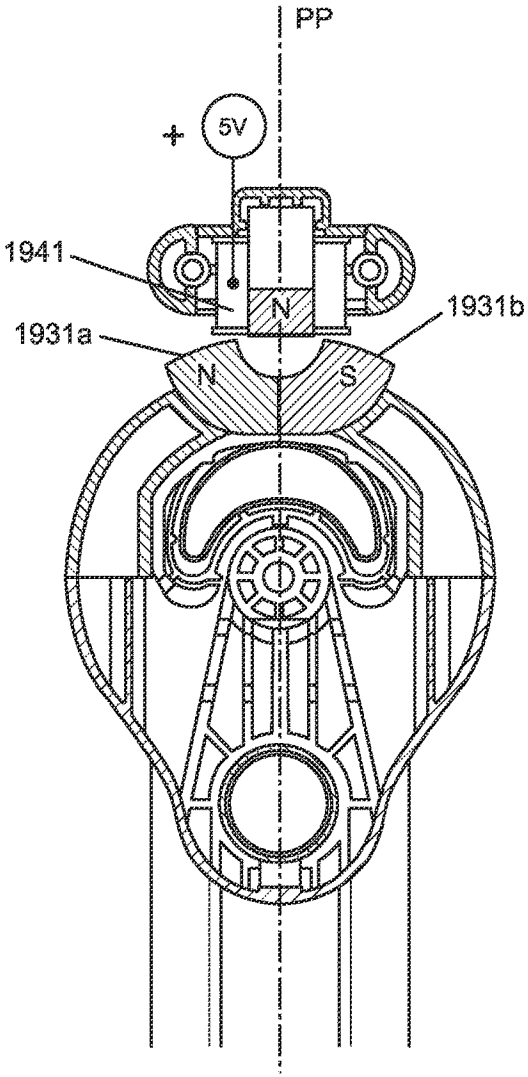
FIG. 20C illustrates the magnetic drive of FIG. 19 with the permanent magnet and the electromagnet having polarities that result in deflection of the swing arm to the right.

FIGS. 20A, 20B illustrate how rotary motion in the right direction is achieved by energizing the electromagnet 1941 such as by, as illustrated, applying a voltage of −5 v across a coil of the electromagnet, such that the electromagnet has its South pole towards the magnet 1931. The South pole of the electromagnet 1941 is attracted to the North pole 1931*a*, and is repelled by the South pole 1931*b*. These attractive and repulsive magnetic forces collectively cause the swing arm assembly to rotate/swing in the right direction, about the pivot axis P-P'. Similarly, FIGS. 20C, 20D illustrate how rotary motion in the left direction is achieved by energizing the electromagnet 1941 with a reverse voltage to that in FIGS. 20A, 20B such as by, as illustrated, applying a voltage of +5 v across the coil of the electromagnet 1941, such that the electromagnet has its North pole towards the magnet 1931. This North pole of the electromagnet 1941 is attracted to the South pole 1931*b*, and repelled by the North pole 1931*a*. These attractive and repulsive magnetic forces collectively cause the swing arm assembly to rotate/swing in the left direction, about the pivot axis P-P'. FIGS. 19, 20A-20D illustrate the scenario when the user selects the maximum swing angle α resulting in maximal alignment between the electromagnet 1941 and the face/pole 1931*a* (FIG. 20B) during swing motion in one direction, and in maximal alignment between the electromagnet 1941 and the face/pole 1931*b* (FIG. 20D) during swing motion in one direction. As explained above for FIGS. 13-15, a user can select less than the maximum swing angle α, in which case the extent of alignment between the electromagnet 1941 and the poles 1931*a*,1931*b* is lower.

The apparatus 1900 can generate fewer magnetic forces than the apparatuses 10, 50, but can be advantageous when stronger magnets are available, when a reduced housing size (e.g., of the housing 21) is desirable, when a lower range of swing angle α is provided, and/or the like.

The apparatuses 10, 50, 1900 capture the general notion that the magnetic drive includes at least one magnetic component (a permanent magnet or an electromagnet) coupled to either the swing frame assembly 12 or the swing arm assembly 15, and at least two magnetic components (permanent magnets or electromagnets) coupled to the other of the swing frame assembly 12 or the swing arm assembly 15 that are angularly offset from the at least one magnetic component. While the apparatus 1900 employs a single magnet 1931 and a single electromagnet 1941, the magnet 1931 is designed such that both its poles interact with the electromagnet 1941, effectively acting like two magnetic components.

Variations of the magnetic drives disclosed in FIGS. 12-20 are within the scope of this disclosure For example, the apparatus 10 can be modified such that the electromagnet 51 is formed on the swing arm assembly 15 and the magnets 52, 53 are formed on the frame assembly 12. As another example, a pair of electromagnets can be mounted on the swing arm assembly 15 while a single permanent magnet can be mounted on the frame assembly 12, with the electromagnets and permanent magnet interspersed as is the case for the apparatus 50. As yet another example, two electromagnets can be mounted on the frame assembly 12 and a single permanent magnet can be mounted on the arm assembly 15.

Having explained design of the example embodiments illustrated in FIGS. 12-20, a more generalized magnetic drive can be realized as explained here.

Generalized Magnetic Drive

Figure 31B:
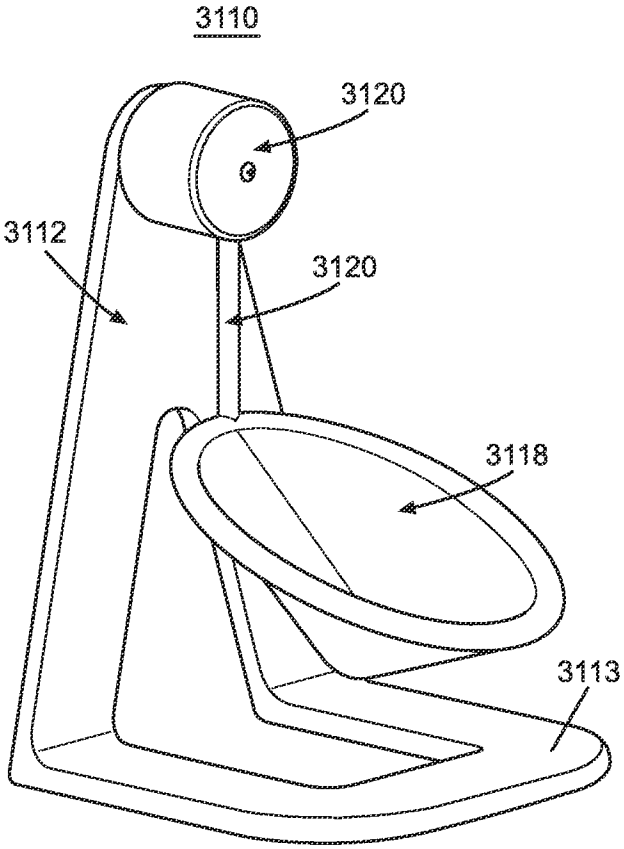
FIG. 31B illustrates a perspective view of the swing apparatus of FIG. 31A.
Figure 31A:
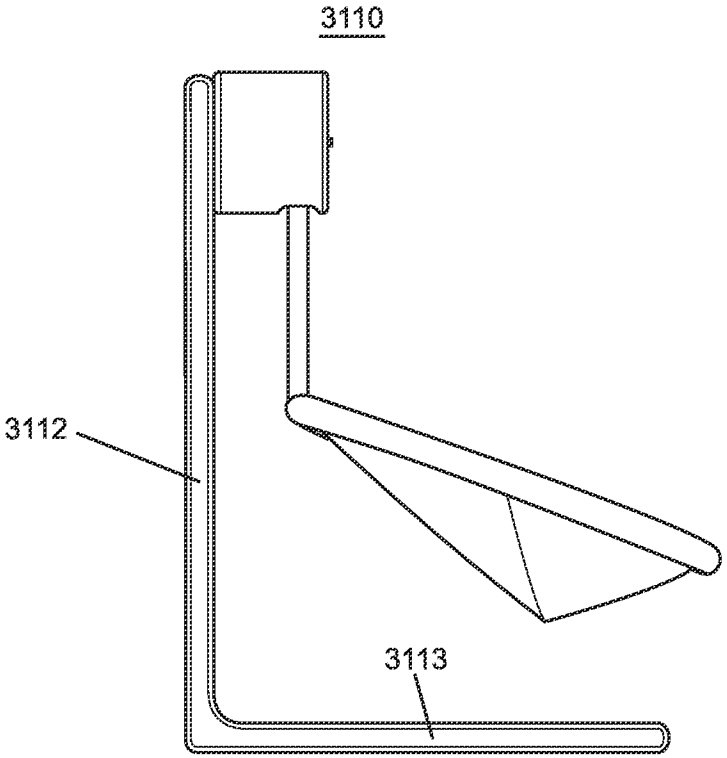
FIG. 31A illustrates a side view of a general swing apparatus with magnetic drive.

FIGS. 31A-31B illustrate a generalized swing apparatus 3110 that can be structurally and/or functionally similar to the apparatus 10, unless expressly noted otherwise. The apparatus 3100 includes a base 3113 for stability and a vertically rising frame assembly 3112 that is connected to a drive/motor 3120. The apparatus 3110 also includes a swing arm assembly 3115 that includes a swing seat 18. The swing arm assembly 3115 is suspended from and rotationally coupled to the motor 3115 in a manner that allows the swing arm assembly to swing in a pendulum-like, to-and-fro motion.

Figure 32:
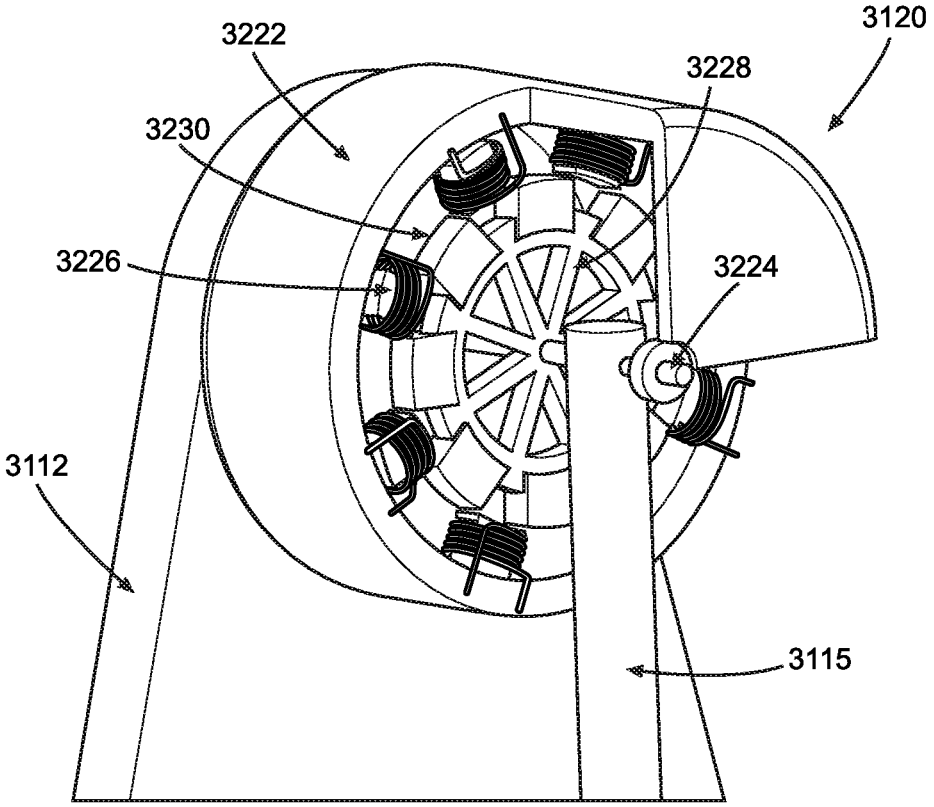
FIG. 32 illustrates an enlarged view of the motor illustrated in FIG. 31A with portions of the casing removed to show detail.

FIG. 32 illustrates additional detail for the motor 3120, which can include a brushless direct current (DC) motor, or a portion thereof, as explained herein. A stationary portion/stator 3222 of the motor 3120 is coupled to the frame 3112. A drive shaft 3224 is disposed in a center of the stator 3222 and coupled to the swing arm assembly 3115, and can define an axis of rotation, similar to the pivot axis P-P'. The stator 3222 includes a set of inductors or electromagnets 3226 (e.g., similar to the electromagnet 51) that are mounted in a rotational array about the drive shaft 3224. The motor 3120 also includes a rotating portion or a rotor 3228 that includes a set of permanent magnets 3230 (e.g., similar to the magnets 52, 53) also disposed in a rotational array about the drive shaft 3224, and are disposed closer to the drive shaft 3224 than the electromagnets 3230.

Figure 33B:
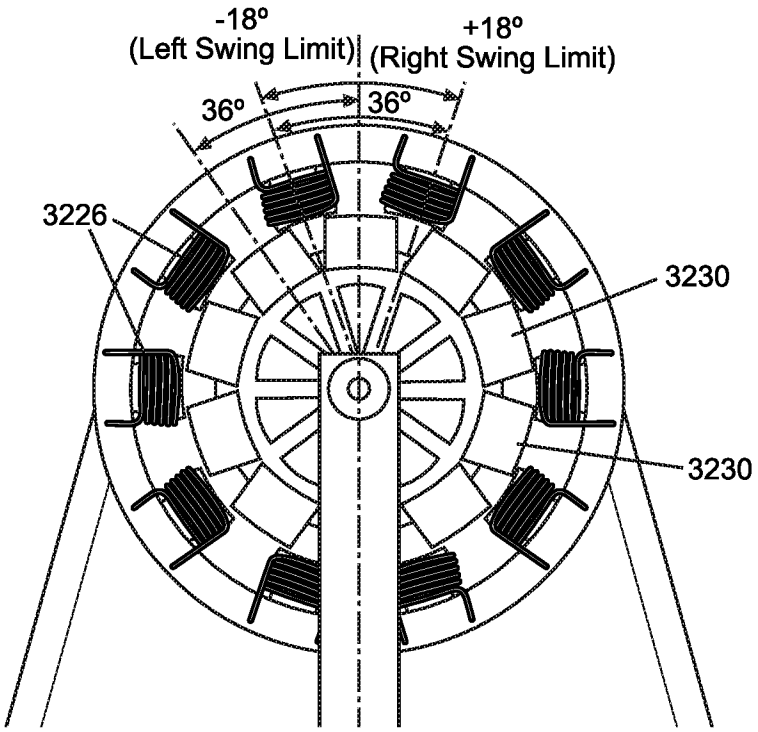
FIG. 33B illustrates an example motor for the swing apparatus of FIG. 31A, with ten permanent magnets and ten electromagnets.
Figure 33A:
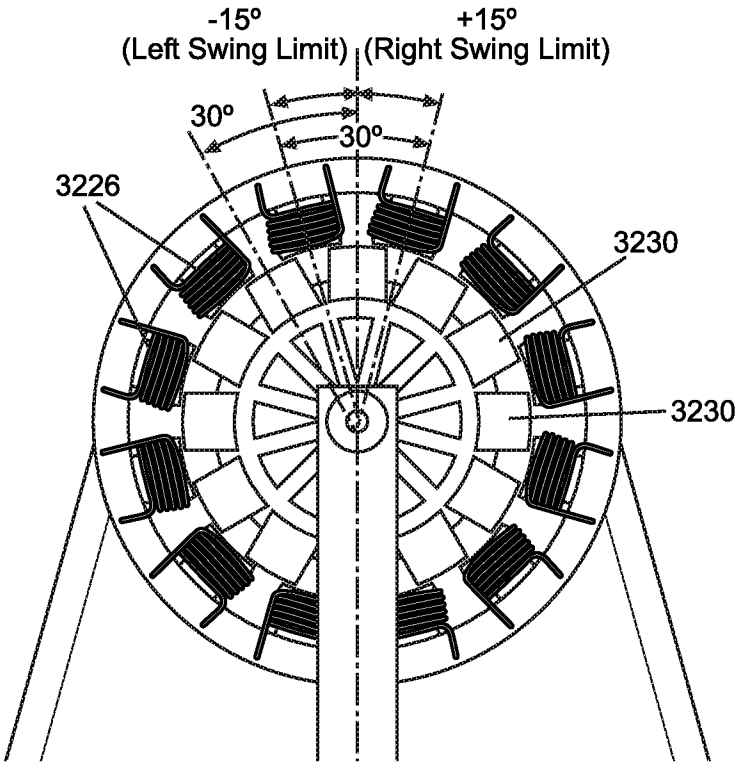
FIG. 33A illustrates an example motor for the swing apparatus of FIG. 31A, with twelve permanent magnets and twelve electromagnets.
Figure 33D:
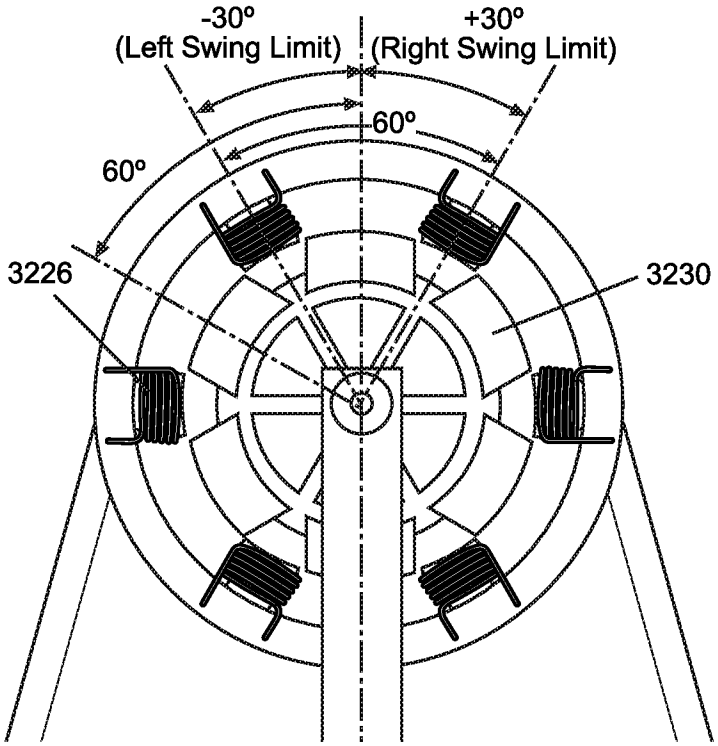
FIG. 33D illustrates an example motor for the swing apparatus of FIG. 31A, with six permanent magnets and six electromagnets.
Figure 33C:
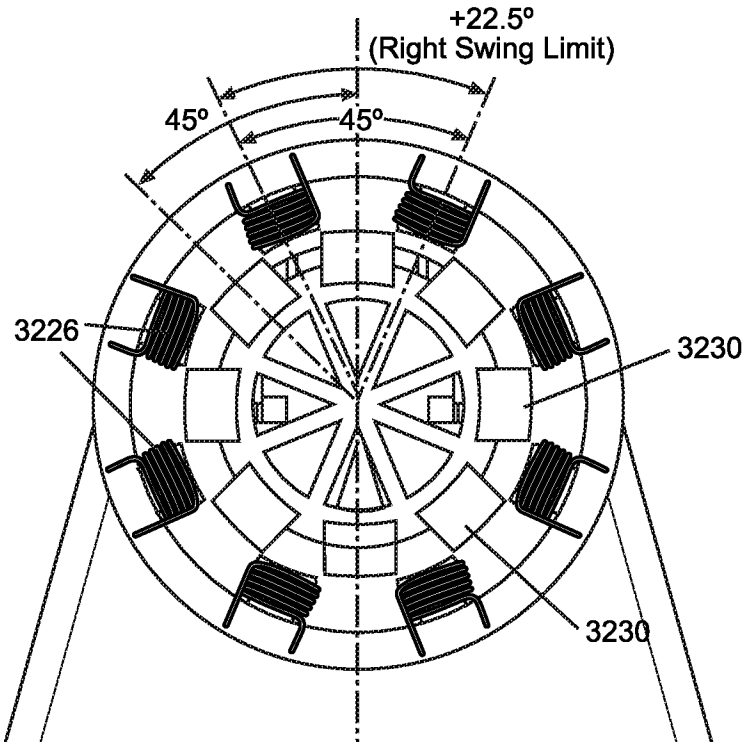
FIG. 33C illustrates an example motor for the swing apparatus of FIG. 31A, with eight permanent magnets and eight electromagnets.
Figure 33F:
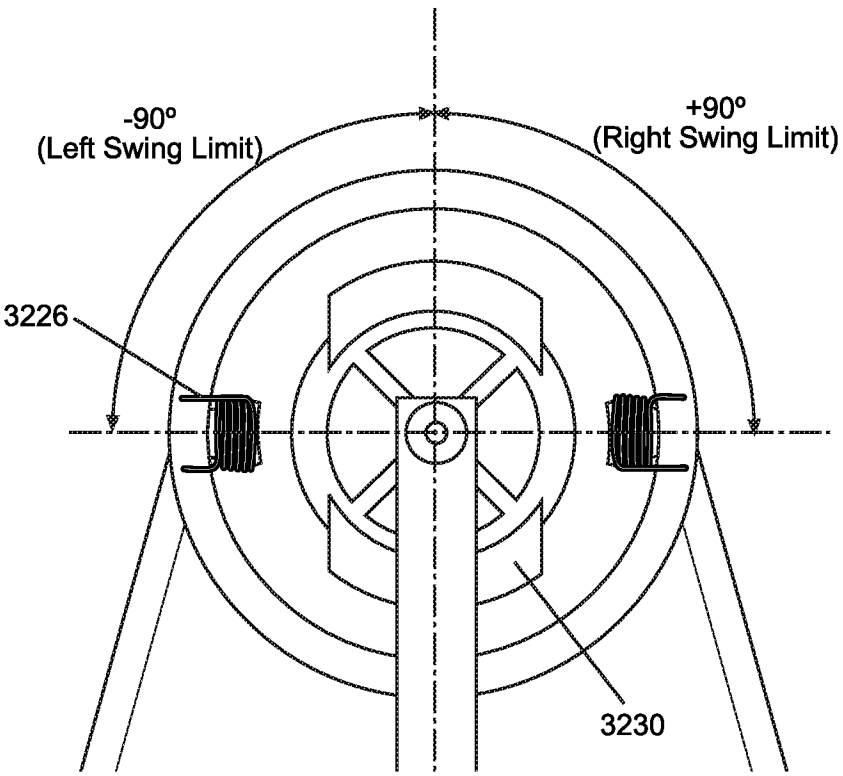
FIG. 33F illustrates an example motor for the swing apparatus of FIG. 31A, with two permanent magnets and two electromagnets.
Figure 33E:
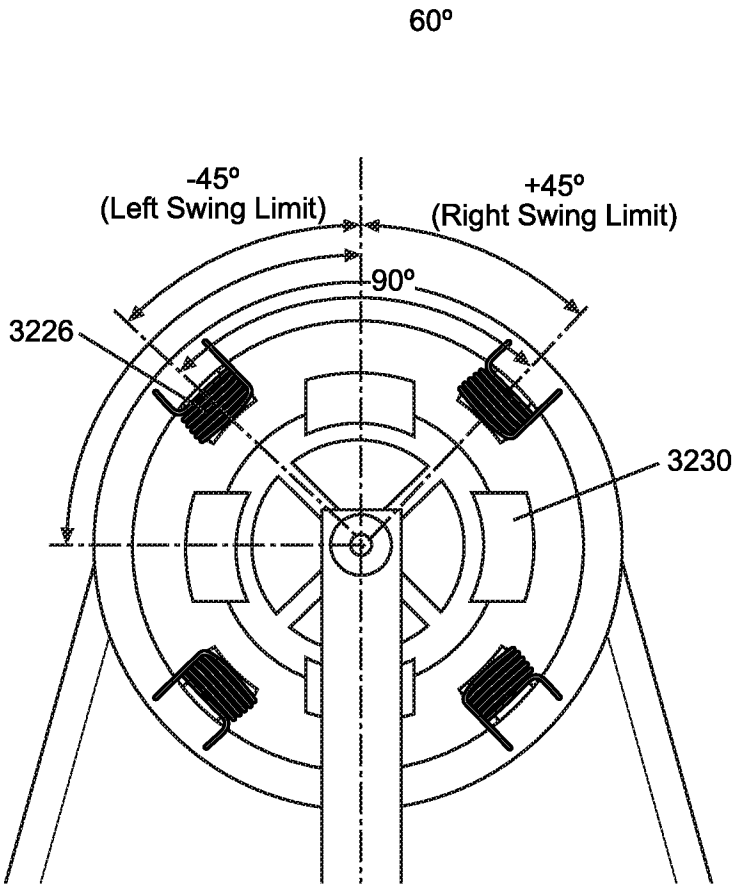
FIG. 33E illustrates an example motor for the swing apparatus of FIG. 31A, with four permanent magnets and four electromagnets.

FIGS. 33A-33F illustrate how, depending on the desired maximum swing angle, and assuming that the swing motion in any one direction will not exceed 90 degrees, the number of electromagnets 3226 and magnets 3230 can be selected. FIG. 33A illustrates how, with twelve magnets 3230 and twelve electromagnets 3226, so that the angular separation between adjacent magnets and adjacent electromagnets is about 30 degrees, the maximum permissible swing angle can be set to 15 degrees. FIG. 33B illustrates how, with ten magnets 3230 and ten electromagnets 3226, so that the angular separation between adjacent magnets and adjacent electromagnets is about 36 degrees, the maximum permissible swing angle can be set to 18 degrees. FIG. 33C illustrates how, with eight magnets 3230 and eight electromagnets 3226, so that the angular separation between adjacent magnets and adjacent electromagnets is about 45 degrees, the maximum permissible swing angle can be set to 22.5 degrees. FIG. 33D illustrates how, with six magnets 3230 and six electromagnets 3226, so that the angular separation between adjacent magnets and adjacent electromagnets is about 60 degrees, the maximum permissible swing angle can be set to 30 degrees. FIG. 33E illustrates how, with four magnets 3230 and four electromagnets 3226, so that the angular separation between adjacent magnets and adjacent electromagnets is about 90 degrees, the maximum permissible swing angle can be set to 45 degrees. FIG. 33F illustrates how, with two magnets 3230 and two electromagnets 3226, so that the angular separation between adjacent magnets and adjacent electromagnets is about 180 degrees, the maximum permissible swing angle can be set to 90 degrees.

Figure 34A:
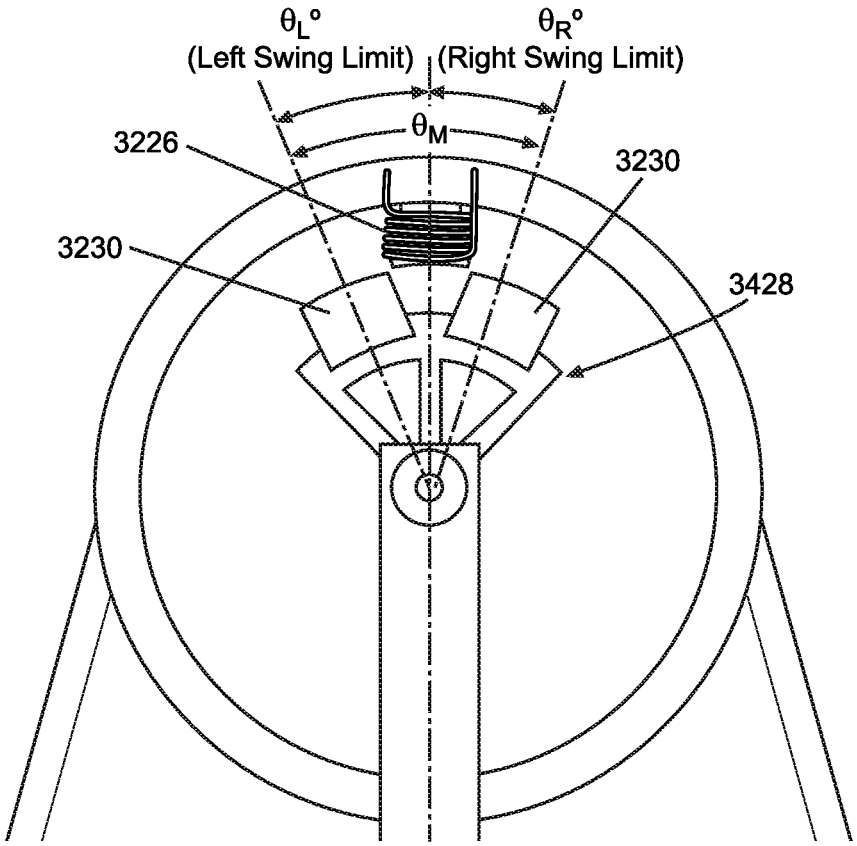
FIG. 34A illustrates an example motor for the swing apparatus of FIG. 31A, with two permanent magnets and one electromagnet.
Figure 34C:
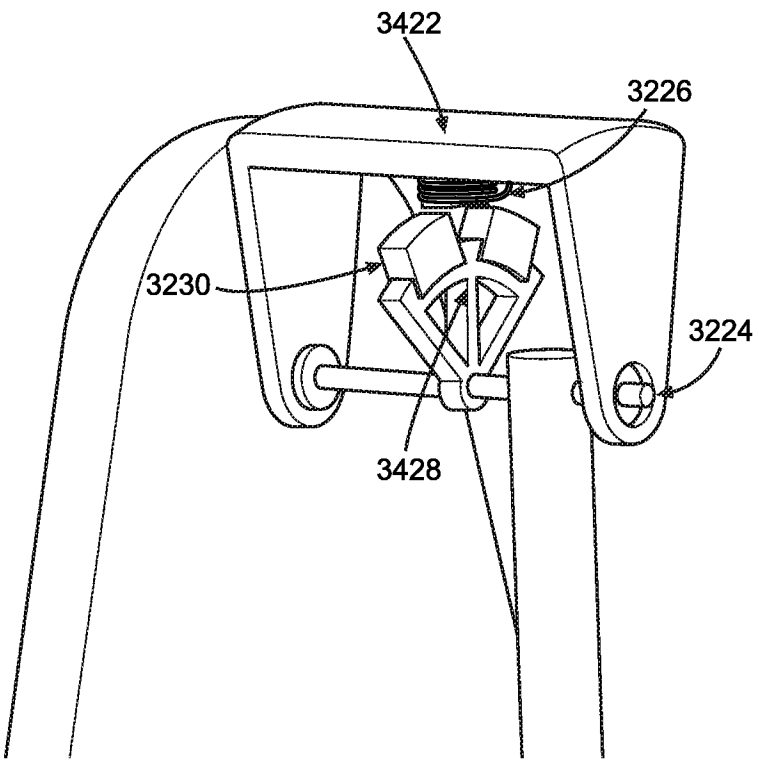
FIG. 34C illustrates the example motor of FIG. 34A with a partial stator formed as a bracket.

FIG. 34A illustrates how, since each of the magnets 3230 stay within the angular range defined by two of the electromagnets 3226 nearest to it, the designs of FIGS. 33A-33F can be minimized to employ a single electromagnet 3226 and a pair of permanent magnets 3230. As a result, the rotor can also be minimized to yield a partial rotor 3428, which in turn reduces weight of operation. As illustrated in FIG. 34A solely for example purposes, for purposes of swing designs like those illustrated in FIGS. 31A-31B, where the pivot axis is generally horizontal or close of horizontal, this design can be employed with a 30 or 60 degree separation (including all values and sub-ranges in between) between the magnets 3230, which yields a maximum swing angle of 15 or 30 degrees, respectively.

Said another way, the selection of the number of electromagnets, the number of permanent magnets, and the angular separation between adjacent electromagnets/permanent magnets can be based on the angle formed by the pivot axis relative to a surface that the swing sits on. For example, the embodiment in FIG. 33F, where a 90 degree swing angle may not be suitable when the pivot axis is generally horizontal or close to horizontal, may be extremely suitable for swings with generally vertical pivot axis. Such swings can be similar to those illustrated and described in U.S. Pat. No. 9,433,304, the entire disclosure of which is incorporated herein by reference.

Figure 34B:
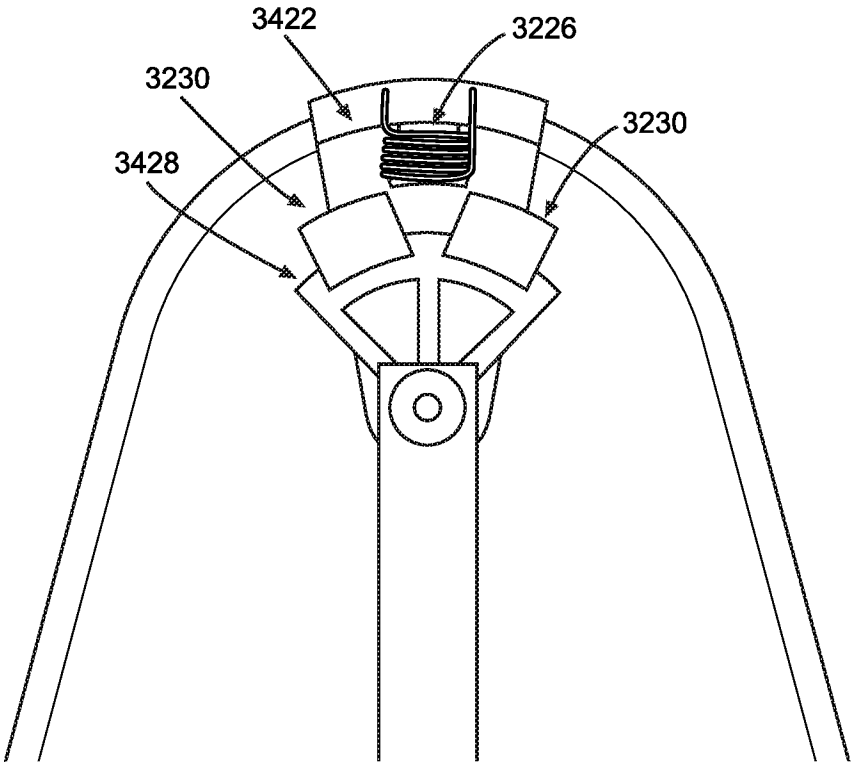
FIG. 34B illustrates the example motor of FIG. 34A with a partial stator.
Figure 35B:
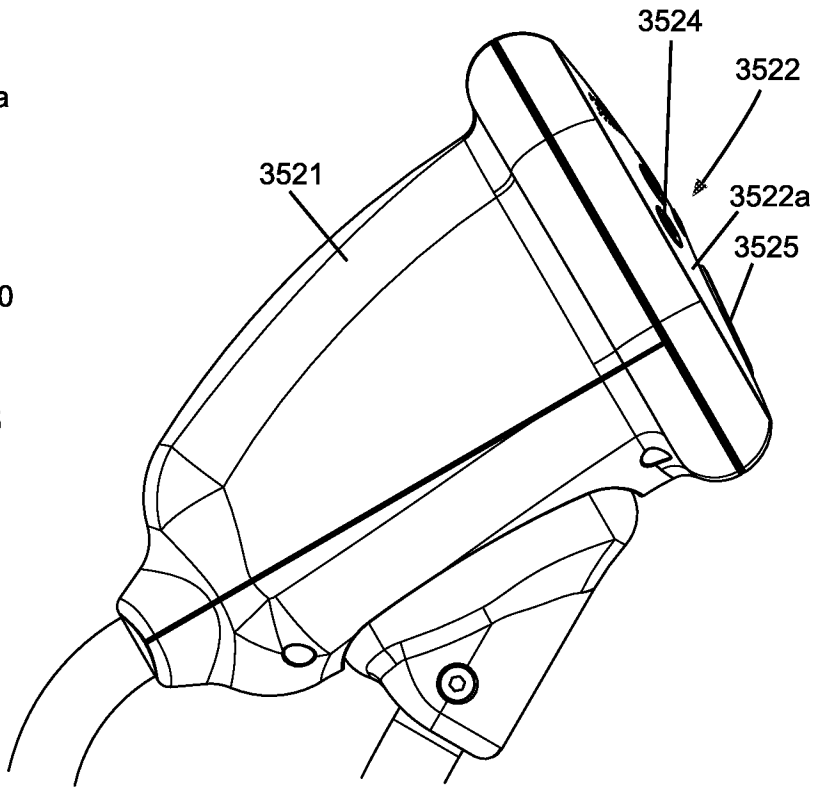
FIG. 35B is a side perspective view of the user interface panel of FIG. 35A.
Figure 35A:
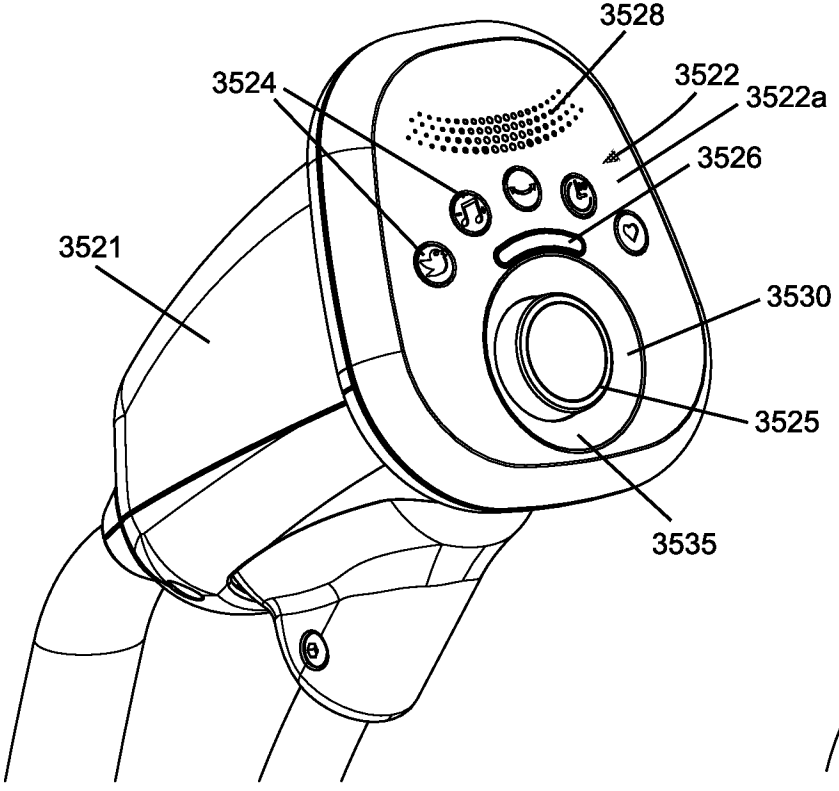
FIG. 35A is a front perspective view of a user interface panel of a swing apparatus, according to another inventive implementation.
Figure 35E:
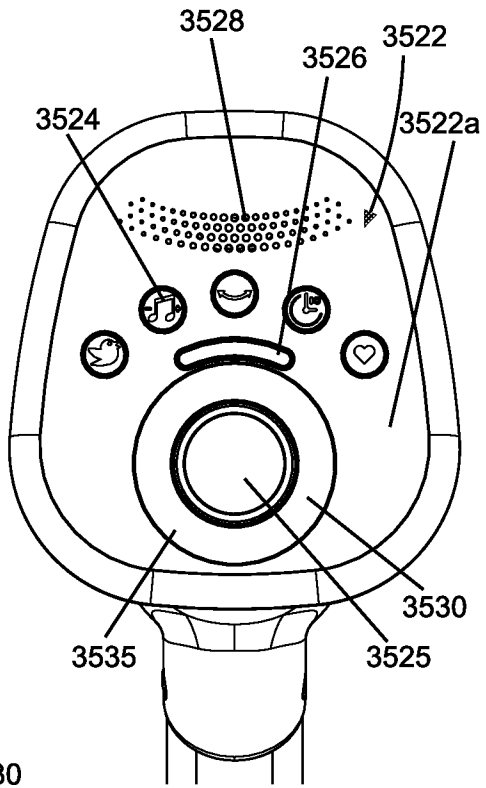
FIG. 35E is a front view of the user interface panel of FIG. 35A.
Figure 35D:
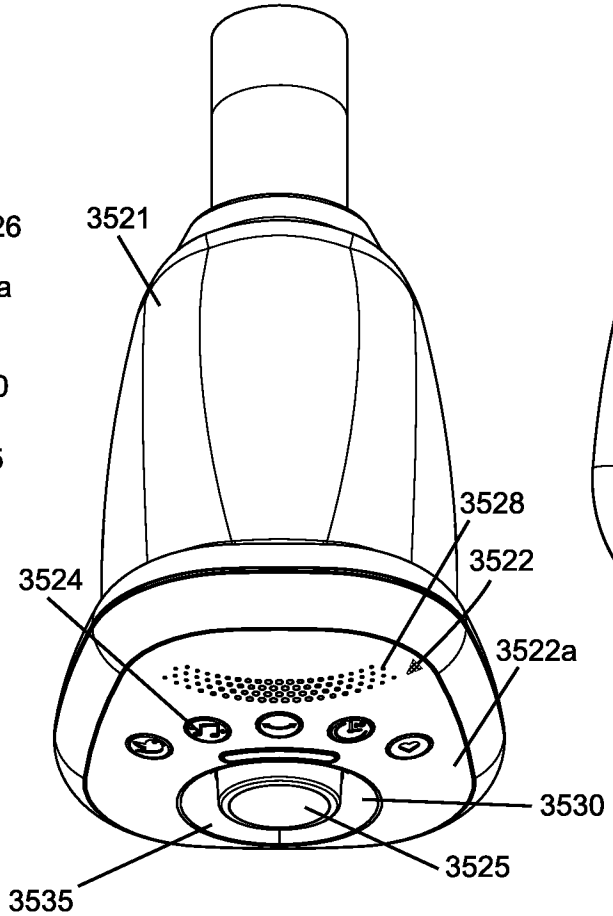
FIG. 35D is a top perspective view of the user interface panel of FIG. 35A.
Figure 35C:
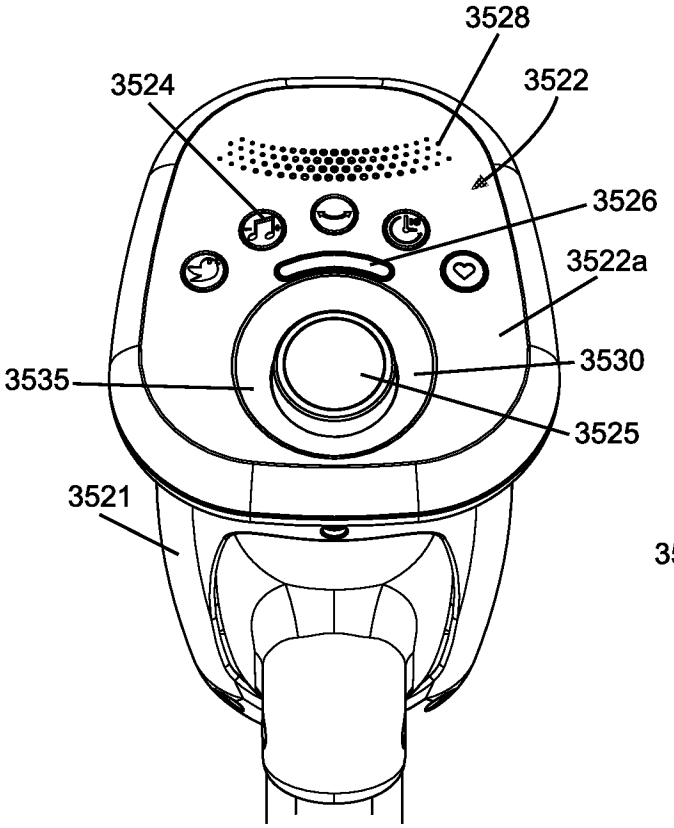
FIG. 35C is a bottom perspective view of the user interface panel of FIG. 35A.
Figure 35G:
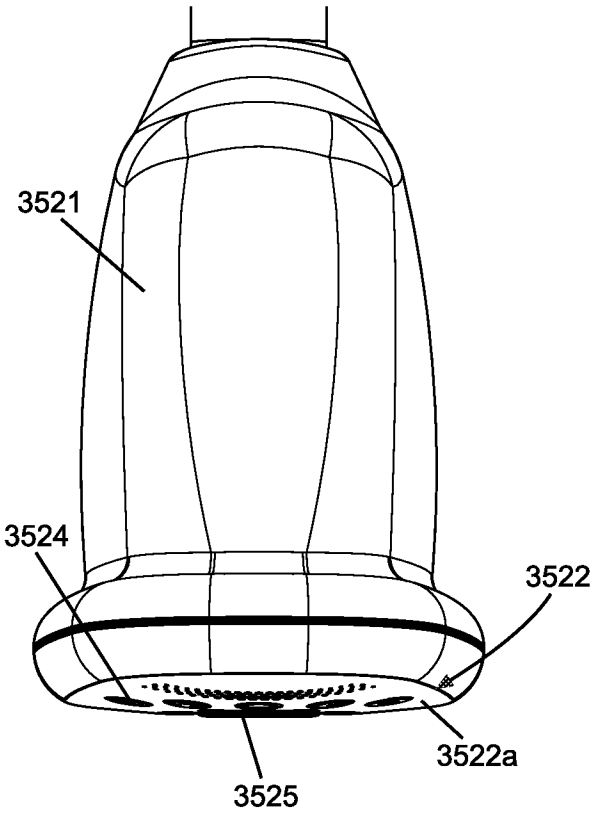
FIG. 35G is a top view of the user interface panel of FIG. 35A.
Figure 35F:
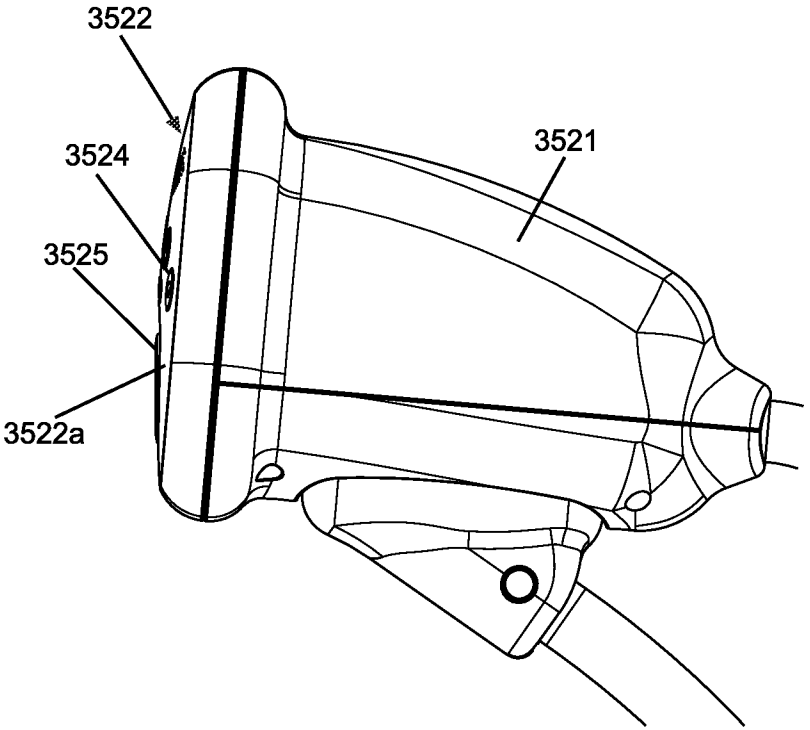
FIG. 35F is a side view of the user interface panel of FIG. 35A.

Continuing with the optimization described for FIG. 34A, FIG. 34B shows how the stator too can be minimized to yield a partial stator 3422. Further, minimization, parts reduction, and operating weight reduction can be achieved with the design illustrated in FIG. 34C, with the partial stator 3422 formed as a bracket that suspends the electromagnet 3226 over the partial rotor 3428. The stator 3422, rotor 3428, and swing arm 3115 can all be disposed on the shaft 3224. The embodiments of FIGS. 12-20 can then be regarded as example embodiments of the general embodiment of FIG. 34C.

Controller Circuit and Operation

Figure 21A:
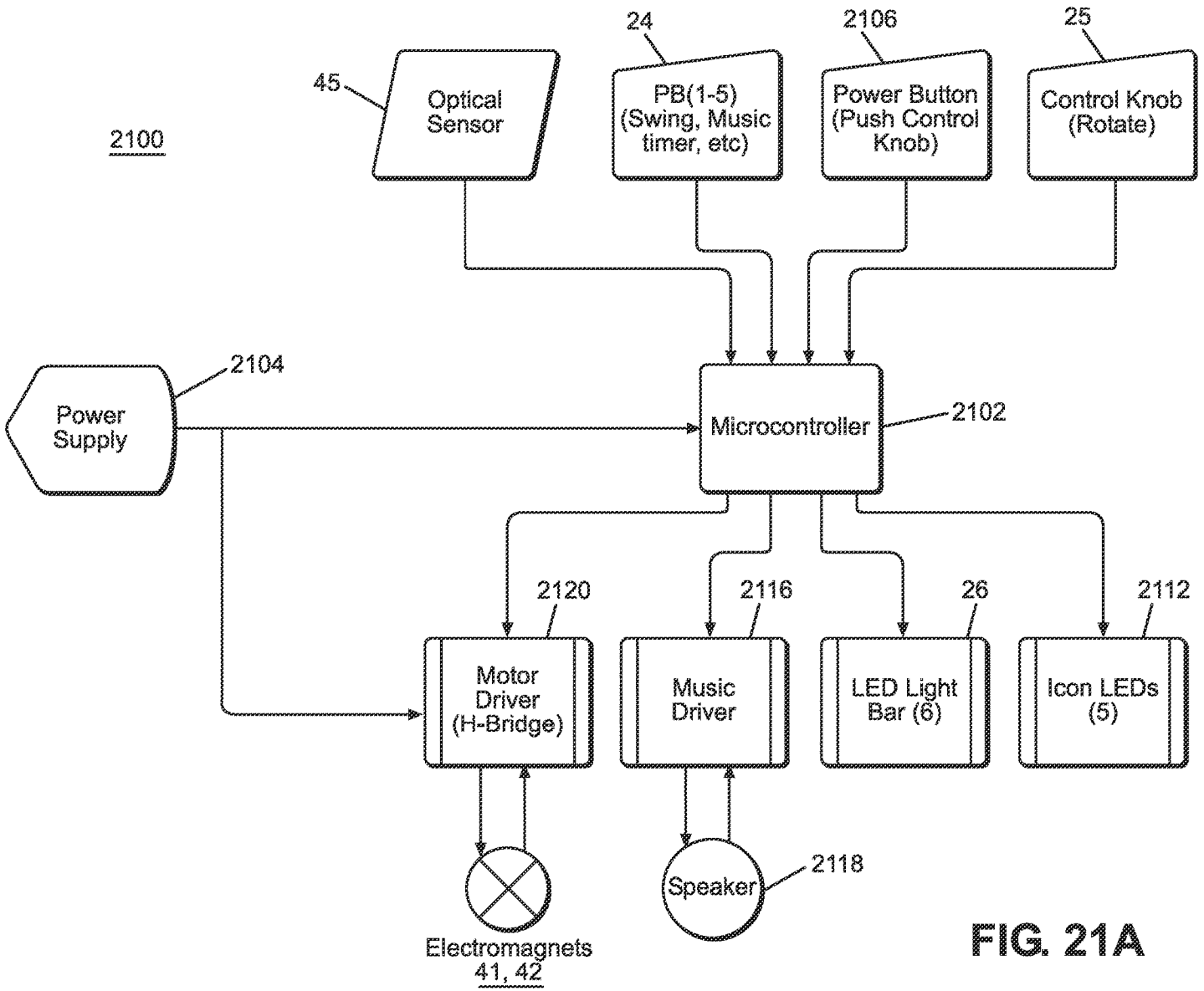
FIG. 21A illustrates a block diagram of a circuit including a controller for controlling operation of a swing apparatus with a magnetic drive.

FIG. 21A illustrates a controller circuit 2100 for controlling operation of any of the swing apparatuses (e.g., the apparatus 10, 50, 1900) disclosed herein. Explained with reference to the apparatus 10 for simplicity, portions/components of the circuit 2100 can be formed on the circuit board 29 illustrated in FIG. 3B. The circuit 2100 includes a controller 2102, and can further include a memory or database (not shown) communicably coupled to the controller. The controller 2102 can be any suitable processing device configured to run and/or execute a set of instructions or code associated with the apparatus 10. The controller 2102 can be, for example, a general purpose processor, a Field Programmable Gate Array (FPGA), an Application Specific Integrated Circuit (ASIC), a Digital Signal Processor (DSP), and/or the like.

The memory/database can encompass, for example, a random access memory (RAM), a memory buffer, a hard drive, a database, an erasable programmable read-only memory (EPROM), an electrically erasable read-only memory (EEPROM), a read-only memory (ROM), Flash memory, and/or so forth. The memory/database can store instructions to cause the controller 2102 to execute processes and/or functions associated with the apparatus 10.

The circuit 2100 can further include a network interface (not shown) for communication to one or more external devices (e.g., a remote, a Smartphone, other compute devices, and/or the like) and/or virtual assistants (e.g., Amazon Alexa), such as for remote control of the apparatus 10. The communication with the external device(s) can be direct, such as via Bluetooth, low-power Bluetooth, Near-Field Communication (NFC), Wireless Fidelity (WiFi), and/or the like. Additionally or alternatively, the communication with the external device(s) can be via one or more networks such as, for example, a local area network (LAN), a wide area network (WAN), a virtual network, a telecommunications network, and/or the Internet, implemented as a wired network and/or a wireless network. Any or all communications can be secured (e.g., encrypted) or unsecured, as is known in the art.

The controller 2102 is coupled to a power supply 2104 of the apparatus, which can be, for example, a utility power supply, a battery, a rechargeable battery, and/or the like. As an example the controller 2102 receives a 6 V DC power input from the power supply 2104. The circuit 2100 also includes a power button 2106 (e.g., disposed on the panel 22) coupled to the controller 2102 to permit the user to power the apparatus 10 on and off. The controller 2102 receives input from the buttons/switches 24 to permit the user to select apparatus parameters to manipulate as swing amplitude, swing duration, music, and/or the like. The controller 2102 also receives input from the dial/knob 25 that permit the user to manipulate a selected apparatus parameter, such the extent of swing (i.e., the swing angle α), how long the swing should run for, and/or the like. FIG. 21A also illustrates that the controller 2102 can control operation of the visual indicators 26, as well as of individual lights (e.g., LEDs) that may be formed on each of the buttons 24. The controller 2102 can also control music play via a music driver 2116 of the circuit 2100, that in turn is coupled to the speaker disposed on the circuit board 29.

The circuit 2100 also includes a driver circuit 2120 for controlling and switching the polarities of a voltage signal applied to the electromagnet 51, and thereby switching the magnetic poles of the electromagnet. The drive circuit 2120 can be, for example, an H-bridge circuit with an output voltage line to which the electromagnet 51 is coupled. When more than one electromagnet is employed (e.g., the electromagnets 41, 42), they can be connected to the H-bridge circuit in parallel, with reverse polarities to each other. Generally, whenever more than one electromagnet is employed, adjacent electromagnets can be wired in reverse to each other. As a result, the same voltage/polarity applied by the circuit 2120 will result in the electromagnets 41, 42 having opposite magnetic polarities, that are switched when the voltage polarity is switched.

Referring again to the single electromagnet 51 design, as also illustrated in FIG. 21A, the drive circuit 2120 is also coupled to the power supply 2104 to receive, for example, 6 V signal that can both power the drive circuit 2120 and provide the voltage signal to be applied to the electromagnet 51. The voltage signal can be, for example, a pulse-width modulated (PWM) signal. FIG. 21A also illustrates communicative coupling between the controller 2102 and the optical sensor 45, which enables the controller 2102 to control operation of the light sources of the optical sensor 45 as well as receive the detected optical signals from the photodetectors of the optical sensor 45.

The swing apparatus 10 can include other components (not shown) that are readable and/or controllable by the controller 2102 such as, for example: an ambient light sensor for use in controlling brightness of any of the LEDs on the housing 21, for turning the nightlight on and off; a motion sensor for turning the nightlight on and off when a user approaches it; a weight sensor coupled to the seat frame 18 for sensing whether the seat is in place or not, and/or whether a child is sitting on the seat; a tilt sensor, a gyroscope, and/or a gyrometer coupled to the seat frame 18 that can be used to turn the apparatus 10 off if the seat tilt or orientation renders it unsafe for use; and/or one or more reed switches for detecting position of the permanent magnets during swing motion. For example, one or more reed switches can be disposed on the swing frame assembly 12 at pre-set angles from the pivot plant PP with respect to the pivot axis P-P'. When the permanent magnets (e.g., the magnets 52, 53) are near the reed switch(es) during swing motion, this can be detected and utilized for sensing of the swing angle at the moment of detection.

Figure 21B:
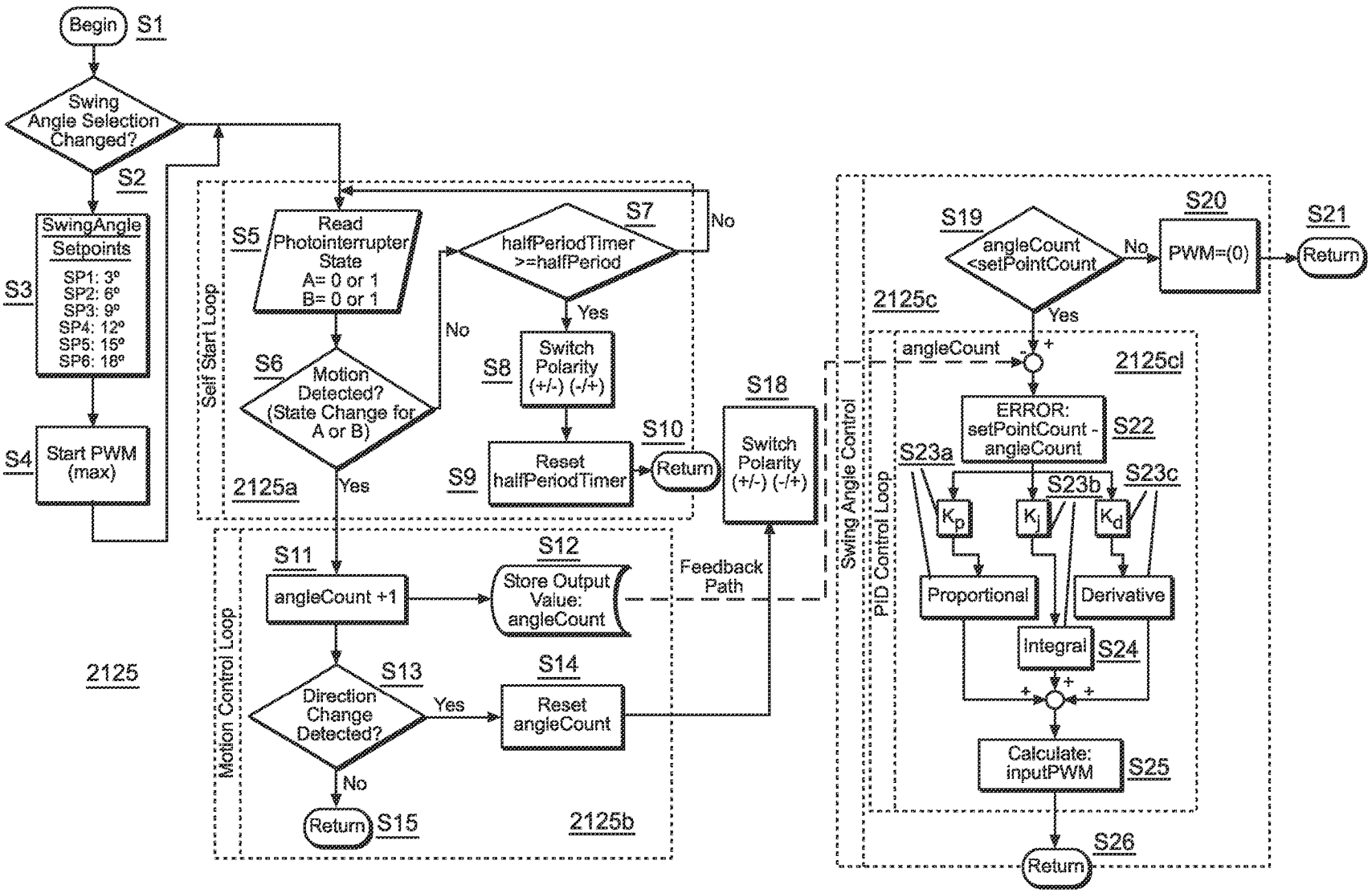
FIG. 21B illustrates a method of operating a swing apparatus with a magnetic drive.

FIG. 21B is a flowchart detailing an example method 2125 of operation of the swing apparatus 10, and that can be executed by the circuit 2100, such as by the controller 2102. The method 2125 begins at step S1 such as, for example, after the user powers on the apparatus 10 and makes a selection of a swing angle α. At step S2, a check is made if the selection of the swing angle α has changed. When this check is made at least the first time after the user makes a selection (i.e., apparatus is at rest and the swing angle is currently zero), the latest value of the swing angle is read at step S3. Step S3 here indicates six example values or "setpoints" (SPs) of swing angle that the user can set, from a SP1 of 3 degrees to a SP6 of 18 degrees, which is the maximum permissible swing angle. After the setpoint is determined at S3, at step S4, a maximal value of a voltage signal (e.g., a PWM signal, as illustrated in FIG. 21B) is applied to the electromagnets 41, 42 with a given (say, first) polarity. As explained with reference to FIGS. 13-15, in this manner, the electromagnet 51 is energized and depending on the polarity of the electromagnet, swing motion will be initiated in one direction or the other (i.e., towards the left or towards the right) without any additional input from the user, i.e., the user does not need to push the apparatus 10 to start swing motion, or do anything else other than provide a setpoint for the swing motion. Also at step S4, a clock or timer is initiated (referred to as a "halfPeriodTimer" in FIG. 21B) to reflect the duration for which the voltage signal at a given polarity has been applied.

Then the controller 2102 executes a self-start sequence/loop 2125*a* which permits the swing apparatus 10 to start swing motion upon input from the user through the interface panel 22, and without requiring, as is the case with several conventional devices, a manual push from the user. Self-start can be affected by the off-axis placement of the permanent magnets and electromagnet(s) during rest as illustrated in the embodiments of FIGS. 13, 16, and 19, such that powering the electromagnet(s) substantially immediately results in attractive and repulsive forces that can initiate swing motion. The sequence 2125*a* includes, at step S5, reading the output of the photodetectors, where a reading of '0' for a photodetector indicates that its corresponding light beam (e.g., one of the beams 46*a*, 47*a*) is blocked, while a reading of '1' indicates that its corresponding light beam is detected. At step S5, the output or state of at least one photodetector is read. At step S6, it is determined whether the output of the photodetector(s) has changed. This can be done for one of the photodetectors, or both, i.e., it is not necessary to read the output of both photodetectors for purposes of executing the self-start sequence 2125*a*. Assuming for simplicity that one photodetector is read at steps S5 and S6, a change in its output is indicative of some movement of the magnetic drive induced by the application of the maximum voltage signal to the electromagnet at step S4. When the separation between two adjacent slots 36 of the slotted strip 35 is about two degrees, the swing motion corresponding to a change in state for a photodetector is from about just greater than zero degree (e.g., when the light beam 46*a* is positioned just inside a slot and adjacent a slot edge, and the swing motion pushes it outside that adjacent slot edge) to about one degree (e.g., when the light beam 46*a* is positioned just inside a slot and adjacent a slot edge, and the swing motion moves the light beam 46*a* across the slot and pushes it out the opposing slot edge), with an average of about 0.5 degrees, of about 1 degree, of about 2 degrees, of about 3 degrees, of about 4 degrees or more, including all values and sub-ranges in between.

If this motion/state change is not detected at step S6, then at step S7, the timer started at step S4 is checked against a predetermined time period (illustrated in FIG. 21B as a "halfPeriod") to determine if a time duration of application of the voltage signal at the first polarity is greater than the time period of, for example, 700 ms. Generally, the time period can be from about 400 ms to about 900 ms, including all values and sub-ranges in between. In some cases, the time period can be about 700 ms. If the timer value is greater than or equal to the predetermined time period, then at step S8, the polarity of the voltage signal applied to the electromagnet 51 is switched such as, for example, from the polarities in FIG. 14 to that in FIG. 15. At step S9, the timer is reset, and step S10, control passes back to step S1. Regularly passing control back to step S1, as done at step S9 and at various other times during the method 2125 (explained later) enables any user changes to the swing angle/setpoint to be quickly accounted for at steps S2-S4; if the user has made no such change, control returns to the self-start sequence 2125*a*, and to step S5.

If the timer value is less than the predetermined time period at step S7, then the time value continues to increment, and the self-start sequence 2125*a* loops back to step S5. In this manner, during the self-start sequence 2125*b*, the controller 2102 will periodically switch at step S8, with the periodicity based on the predetermined time period, the polarity on the electromagnet 51 until some swing motion is underway, as detectable at step S5.

Once some swing motion is detected per the analysis at step S6, the controller 2102 can execute a swing motion control sequence/loop 2125*b*. At step S11, a swing angle measure (illustrated in FIG. 21B as a "AngleCount"), which is set to zero at start up, is incremented by one degree as an initial estimate of the swing motion achieved during the self-start sequence 2125*a*. The updated swing angle measure is stored at step S12, for use during the swing angle control sequence/loop 2125*c*, described later.

Figure 21C:
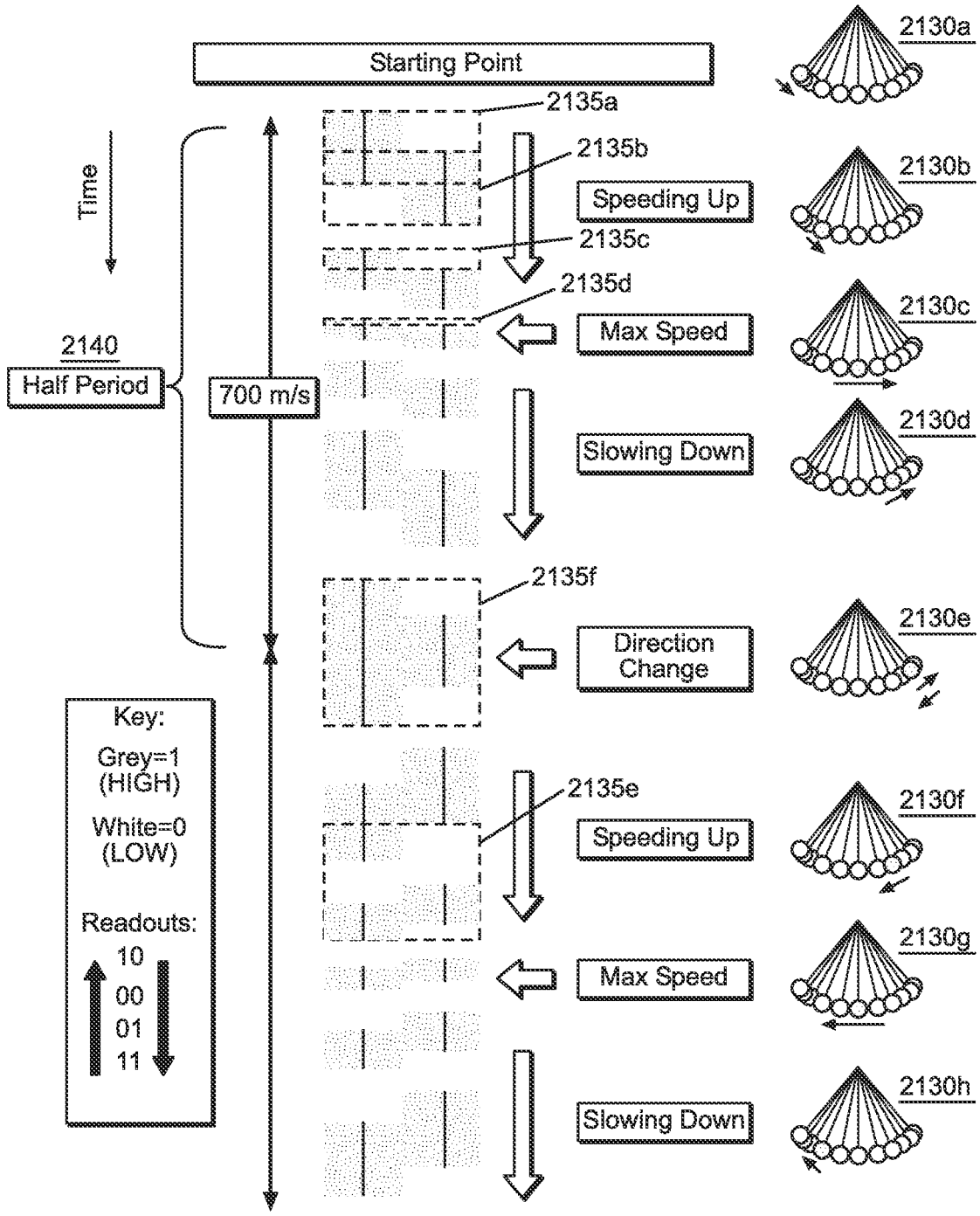
FIG. 21C illustrates example operation of the dual optical sensor illustrated in FIGS. 8-11, including detection of change of swing direction.

At step S13, the photodetectors of the optical sensor 35 are continuously read or monitored by the controller 2102 to determine the direction of swing and whether it has changed, as illustrated in more detail in FIG. 21C. Referring to FIG. 21C now, for ease of explanation, direction change is explained when the swing motion starts at one end of the swing motion as represented by the state 2130*a* ("starting point"), at which the swing angle is maximum, and swing speed is substantially zero. The swing apparatus 10 then moves through state 2130*b* to state 2130*c*, where the swing angle is substantially zero and swing speed is maximum. During this motion, the sensing beams 46*a*, 47*a* will be differently blocked and transmitted by the slotted strip 35, which can be detected by the controller 2102 as a '0' (or 'LOW', when that beam is blocked) or a '1' (or 'LOW', when that beam is not blocked and is detectable), as also illustrated in the legend of FIG. 21C. For example, the controller can detect a '10' (generally illustrated as a readout/readout block 2135*a*) when swing motion is between states 2130*a* and 2130*b*, i.e., when the beam 46*a* is not blocked and the beam 47*a* is blocked.

The swing motion then continues through a readout of '11' to a readout of '01' (see readout 2135*b*), to '00', and then back to '10' (see readout 2135*c*). Since the swing motion is speeding up from state 2130*a* though 2130*b* to 2130*c*, the readout 2135*c* has a shorter duration (i.e., reduced thickness, as illustrated in FIG. 21C) than 2135*a*, and the readout 2135*d*, at state 2130*c*, has an even shorter duration due to the swing motion being at maximum speed.

As illustrated in the legend of FIG. 21C, any one of these transitions between readouts can be used to ascertain the direction of swing motion. When the readouts transition in the opposite direction then, i.e., from '10' to '00', to '01', to '11', and back to '10' as illustrated in the readout block 2135*e*, it can be determined that the swing motion is in the opposite direction (here, from states 2130*e* to state 2130*f*). In this manner, the sizing of the slots in the slotted strip 35 and the separation $C_s$-$C_s'$ between the beams 46*a*, 47*a* can be selected so that there is one full slot 36 between the beams 46*a*, 47*a*, which in turn permits the readout-based direction determination as explained herein. Further, a change in the readout of just one of the beams 46*a*, 47*a* is sufficient to determine swing direction. As explained above with respect to the self-start sequence 2125*a*, this determination can be made within about 0.5-4 degrees of swing motion on average.

Accordingly, the controller 2102 can determine a direction change (e.g., from clockwise/CW to counter-clockwise/CCW or vice versa) has occurred when the cyclical transition between the readouts reverses. As illustrated in the readout block 2135*f*, when the swing motion is in state 2130*e*, it will reverse direction. This is detected by the controller 2102 as a transition from a '10', to '11', and then back to a '10'. If there was no direction change, on the other hand, the transition would have been from '10' to '11' to '01', i.e., similar to that explained for the readouts 2135*a*, 2135*b* above.

FIG. 21C also generally illustrates the notion of a half period 2140 (e.g., about 300 ms, about 500 ms, about 700 ms as illustrated, about 900 ms, about 1 s, about 1.2 s, about 1.5 s, including all values and sub-ranges in between), which is the time it takes, during steady state motion to move from one end of the motion (state 2130*a*), through the swing angle $\alpha$ to center (state 2130*c*), and through the swing angle $\alpha$ to the other end of the motion (state 2130*e*). It then takes another half period for the motion to progress from the state 2130*e*, through state 2130*f* to center 2130*g*, and then through state 2130*h* back to the state 2130*a*. The determination of a swing direction change, which is a fleeting instantaneous state that occurs between half periods, is generally made at the beginning of the next half period since that is when a reversal of readouts is detectable as explained above for the readout block 2135*f*.

Referring again to FIG. 21B, if there is no swing direction change determined at step S13, then at step S15 control returns to step S1 which as explained before, is beneficial for reassessing whether the user has changed the swing setpoint. Since the apparatus is now in motion and the motion detection criterion at step S6 is readily satisfied, control returns quickly to the motion control sequence 2125*b*, where the swing angle measure continues to be incremented at step S11, since the apparatus 10 continues to swing in the same direction.

If a swing direction change is determined at step S13, then the swing angle measure is reset to zero at step S14. Since the apparatus 10 is now swinging in the reverse direction, polarity of the electromagnet 51 can be switched (e.g., such as between FIGS. 14 and 15), and this is done at step S18, in a manner similar to that explained for step S8. Subsequently, the controller 2102 can execute a swing angle control sequence/loop 2125*c* to determine if the extent of swing motion is commensurate with the setpoint specified by the user at step S3, and this is accomplished as follows. At step S19, the stored value of swing angle measure from step S12 (since the current value of swing angle measure has been reset at step S17) is compared against desired setpoint specified at step S3. If the swing angle measure is equal to or exceeds the desired setpoint, this indicates the swing motion has exceeded or will exceed that specified by the user. In such a scenario, at step S20, the voltage signal applied to the electromagnet (e.g., as a PWM signal) is set to zero and/or turned off, to permit the swing motion to dampen of its own accord. At step S21, control then returns to step S1.

If it is determined, at step S19, that the swing angle measure is less than the setpoint specified by the user at step S3, it indicates that swing apparatus 10 is still gaining angular motion towards achieving the desired setpoint, but has not done so yet. In such a scenario, the controller 2102 can execute a control loop 2125*c*1 that modulates the voltage signal applied to the electromagnet 51 with the goal of obtaining oscillatory convergence between the swing angle measure and the desired setpoint over time, accounting for and permitting a gradual buildup of swing motion towards the desired swing angle. In this manner, the voltage signal applied to the electromagnet 51 upon polarity change accounts for the last swing motion completed in a specific direction.

The control loop 2125*c*1, illustrated and explained here as a proportional-integral-derivative (PID) control loop, can be any other suitable feedback loop (e.g., controlled damping) capable of estimating a magnitude of the voltage signal to be applied to the electromagnet 51 to reduce the differential between the desired setpoint and the observed swing angle. Here, at step S22, a difference or error value is calculated as the difference between the desired setpoint and the observed swing angle. The error value is used to calculate a proportional term at step S23*a* based on a predetermined proportional coefficient $K_p$. Generally the calculated proportional term is based on the current error value, i.e., that calculated immediately prior at step S22. The error value is also used to calculate an integral term at step S23*b* based on predetermined integral coefficient $K_i$. Generally the calculated integral term is based on the current and past error value, i.e., that calculated immediately prior at step S22, as well as at step S22 during previous execution of the control sequence 2125*c*1. In some cases, the control sequence 2125*c*1 can also encompass calculating a derivative term at step S23*c* based on the error value, and reflects a rate of change in the error value. The terms calculated at steps S23*a*, S23*b*, and optionally at S23*c*, are then summed at step 24 to generate a control output. At step 25, the control output is employed to determine the magnitude of the voltage signal to be applied to the electromagnet 51, in addition to the change in polarity affected at step S18. At step S26, control is returned to step S1.

In this manner, aspects of the method 2125 are useful for attaining and maintaining the desired swing angle based on detecting change of direction, and without the need for ascertaining a center of the swing motion, as is common in conventional approaches. This is especially beneficial when the swing apparatus 10 may be placed on a tilted, inclined, and/or generally non-level surface, such that a center of the swing motion may be different than a geometric center of the apparatus. In some cases, the apparatus 10 also does not detect and/or otherwise evaluate speed of the swing motion.

Figure 21D:
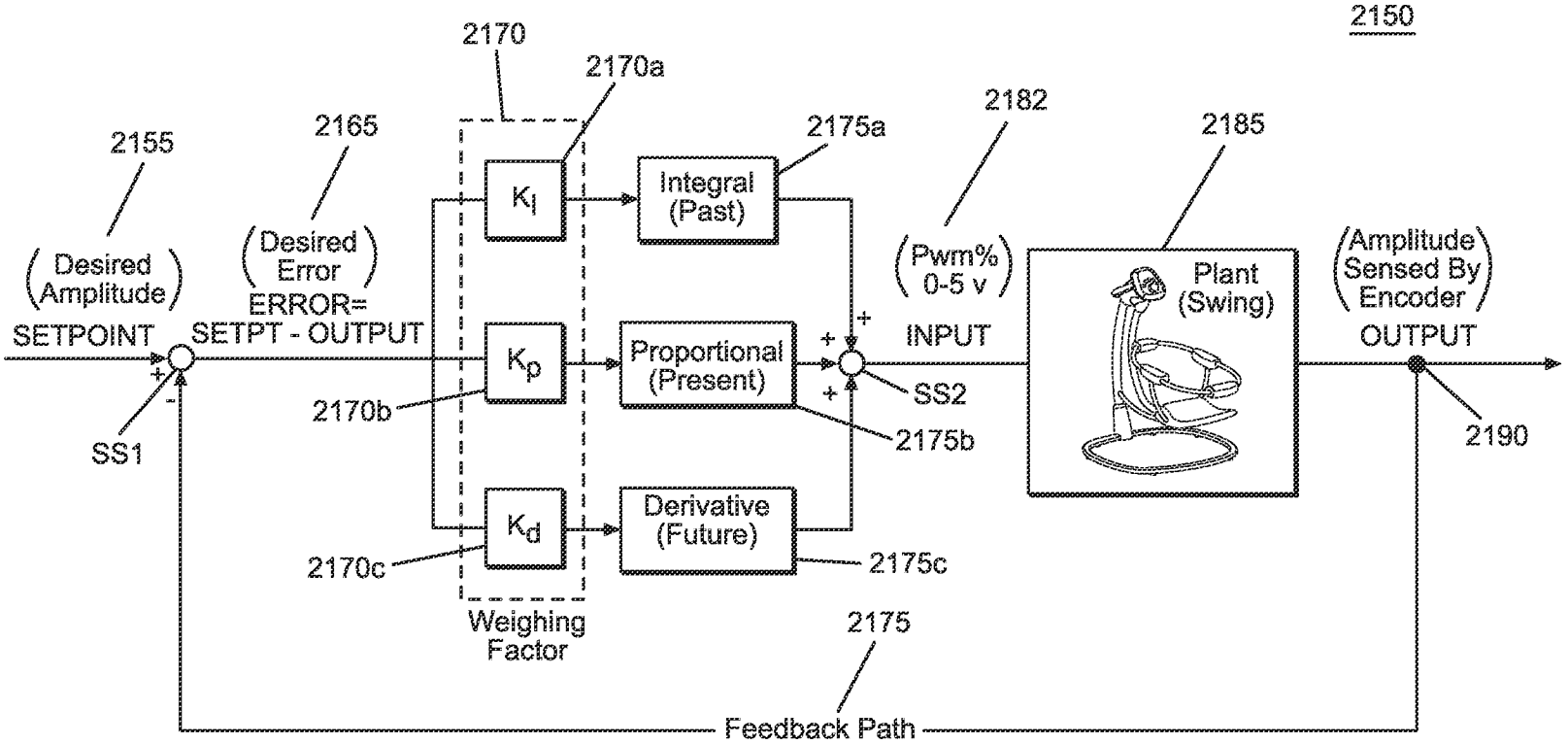
FIG. 21D illustrates an example control loop of a proportional-integral-derivative (PID) controller for controlling operation of a magnetic drive of a swing apparatus.

FIG. 21D illustrates a control sequence/loop 2150 executable by the controller 2102 to manage the swing control. Unless noted otherwise, aspects of the control sequence may be similar to the control sequence 2125*c*1 and other aspects of the method 2125. At step SS1, a desired swing angle, setpoint, or "desired" amplitude 2155 that was previously selected by the user (e.g., such as at step S3) is compared against the observed swing or output swing amplitude 2140 that is determined based on the optical sensor 45, generating an error value 2115. As described above for FIG. 21B, if the swing amplitude 2140 is greater than or equal to the desired swing angle, the power to the electromagnet can be shut off If the swing amplitude is less than the desired swing angle, the error can be input to a PID algorithm, with coefficients 2170 (integral coefficient 2170*a*, proportional coefficient 2170*b*, derivative coefficient 2170*c*) that are combined with the proportional, integral, derivative terms 2175*a*, 2175*b*, 2175*c* respectively to generate, at step SS2, an indication of an output voltage and/or input power (e.g., a relatively increased input PWM duty cycle) 2182 that can be applied to the electromagnet 51. This can cause the swing amplitude 2190 to increase until the setpoint amplitude 2155 is reached.

Swing Base

Figure 36A:
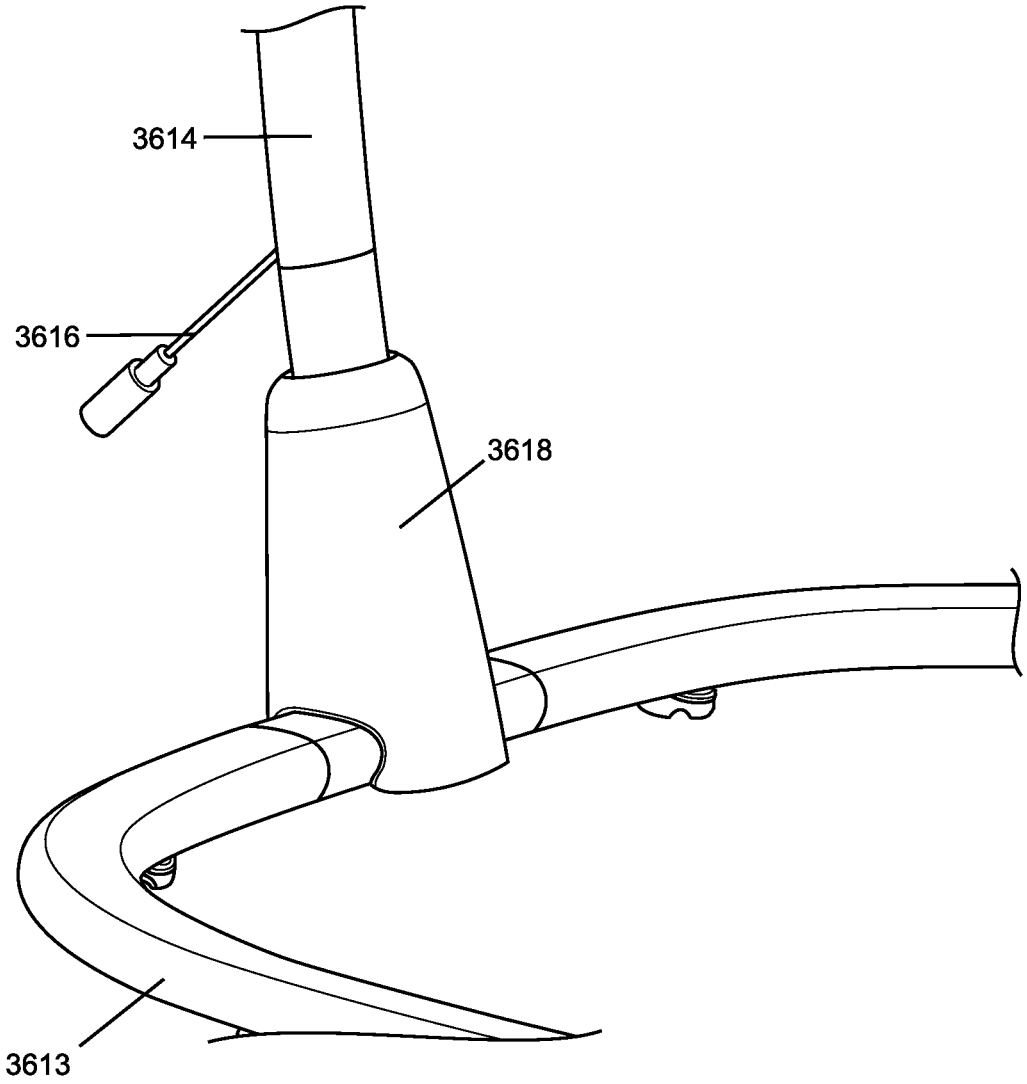
FIG. 36A illustrates a connection between the swing frame arm and a base member of a swing apparatus as disclosed herein.
Figure 36B:
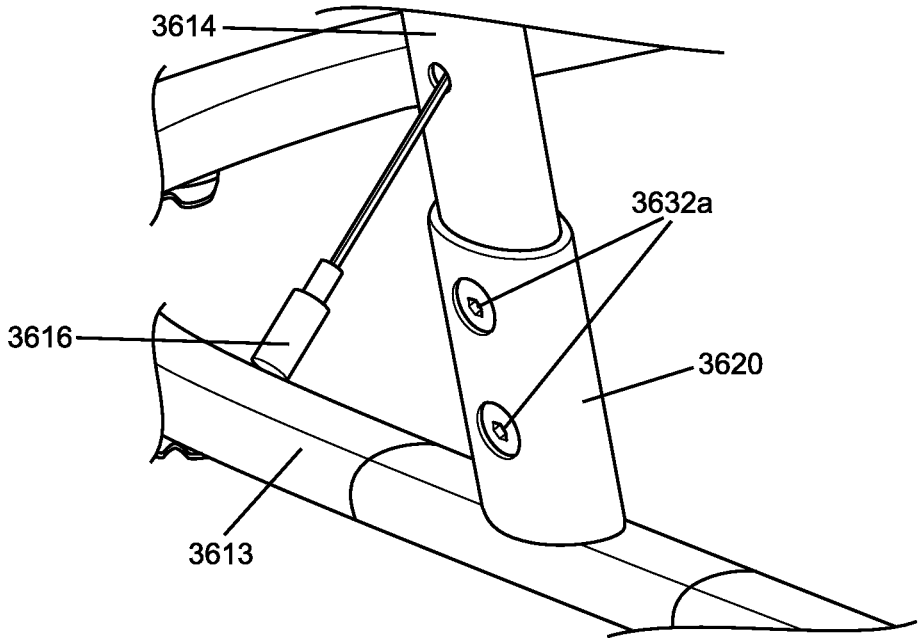
FIG. 36B illustrates the connection of FIG. 36A with the cover removed.
Figure 36C:
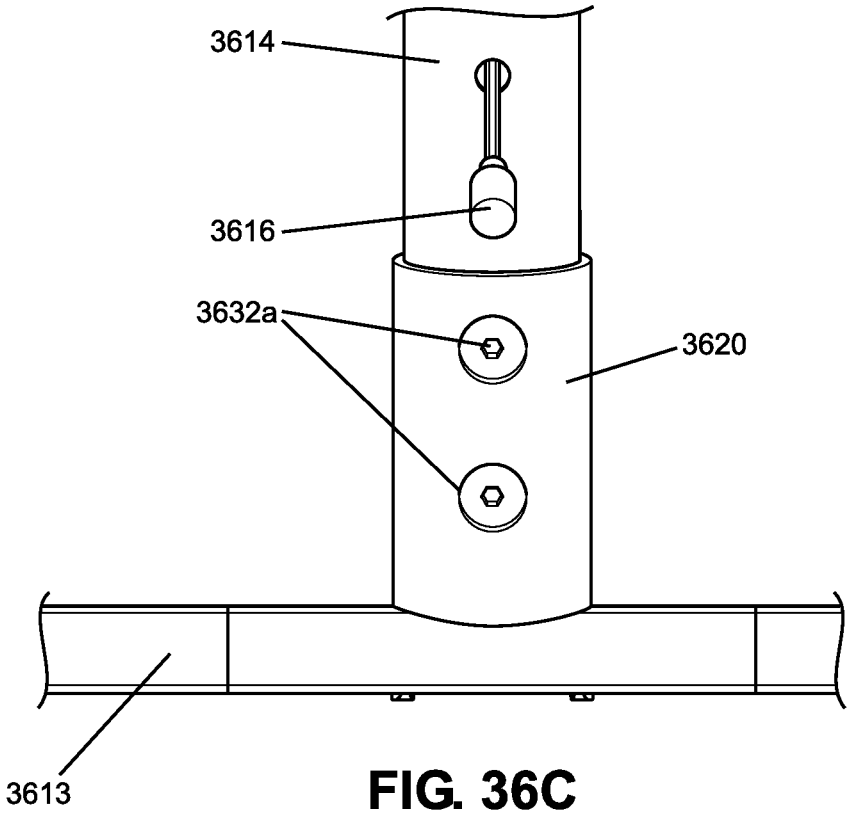
FIG. 36C is another view of the connection of FIG. 36A with the cover removed.
Figure 36D:
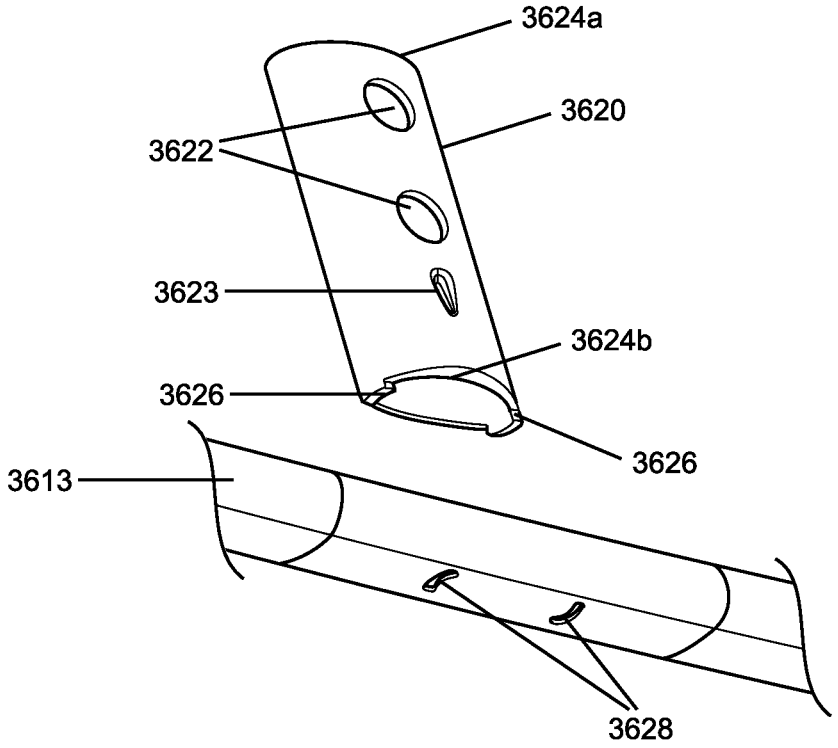
FIG. 36D illustrates details of the stalk and base member useful to form the connection illustrated in FIGS. 36A-36C.
Figure 36E:
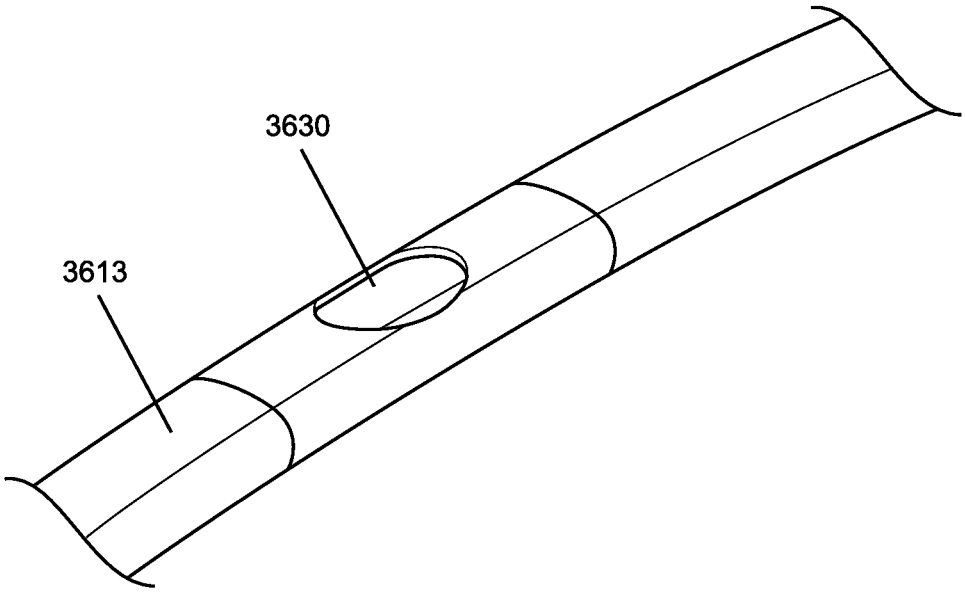
FIG. 36E illustrates another view of the base member and shows a cutout for receiving the stalk.
Figure 36F:
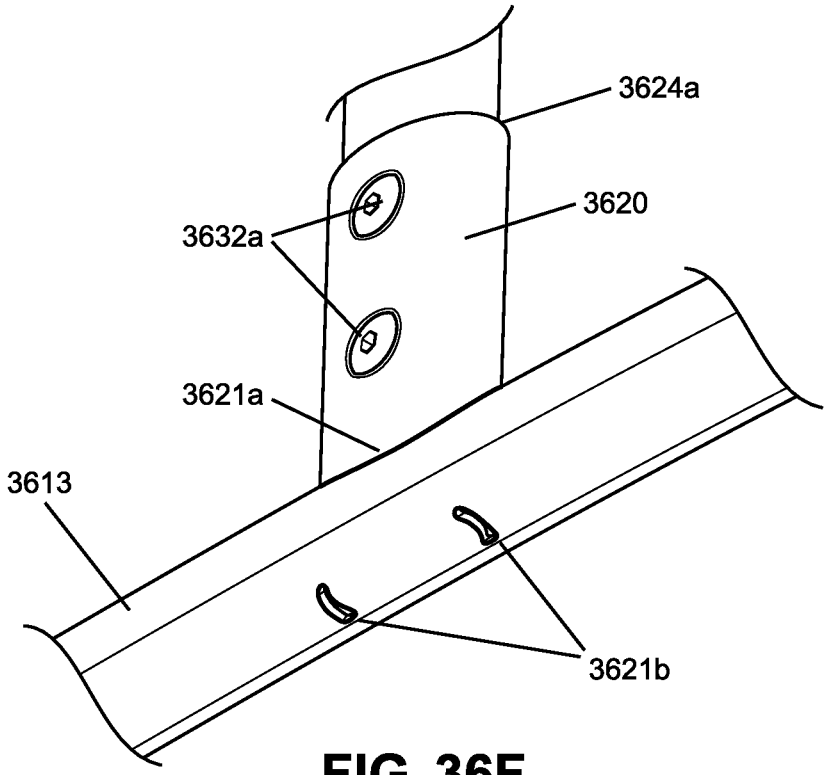
FIG. 36F illustrates areas of weld formation to secure the stalk to the base member.

FIGS. 36A-36H illustrate how a connection is made between the swing frame arm 3614 (e.g., similar to the frame arm 14) and the base member 3613 (e.g., similar to the base member 13). FIG. 36D illustrates detail of a stalk 3620 that can be inserted into the base member 3613, and in turn receive the frame arm 3614. Specifically, a first end 3624*a* of the stalk 3620 can receive the frame arm 3614, while the other/second end 3624*b* can be sized and configured for insertion into the base member 3613.

Referring to the coupling between the stalk 3620 and the base member 3513, the stalk 3620 can include, formed at its second end 3624*b*, a pair of tabs 3626. The base member 3613 can include a stalk opening 3630 to receive the second end 3624*b*, and to permit insertion of the second end into the inner volume of the base member 3613 in a fitted manner. More or fewer tabs can be employed, and in some cases, the tabs can be absent.

The base member 3613 also includes a pair of tab openings 3628 to permit the tabs 3626 to pass through. The number of tab openings can generally be selected based on the number of tabs, and in cases where the tabs are absent, there may be no tab openings, or there may be a singular opening substantially similar to the stalk opening 3630.

Figure 36G:
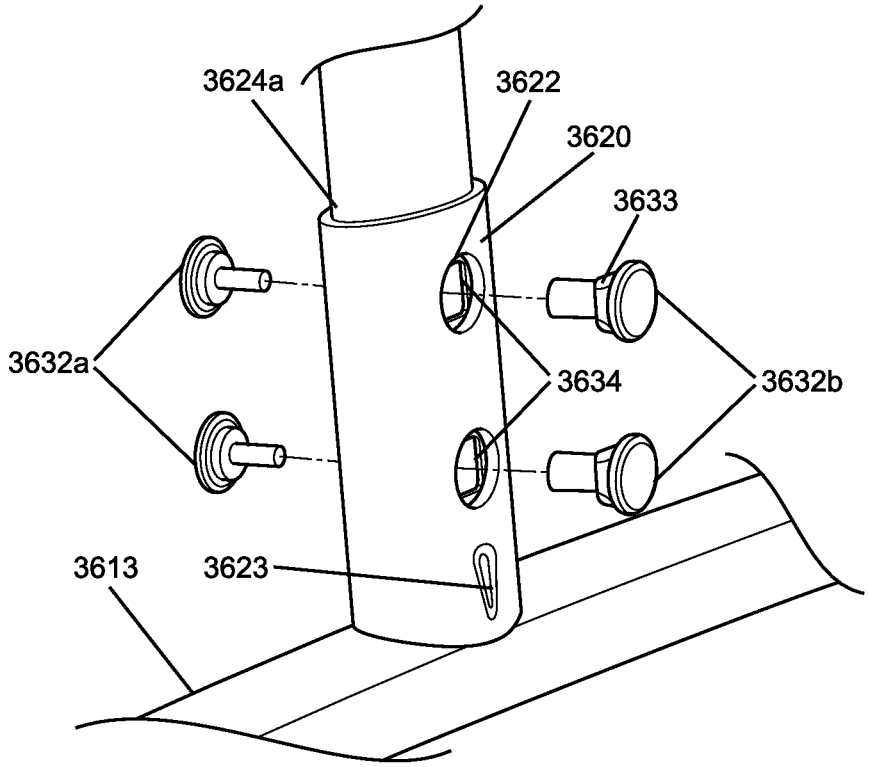
FIG. 36G illustrates, prior to insertion, bolts useful to secure the frame arm to the stalk.
Figure 36H:
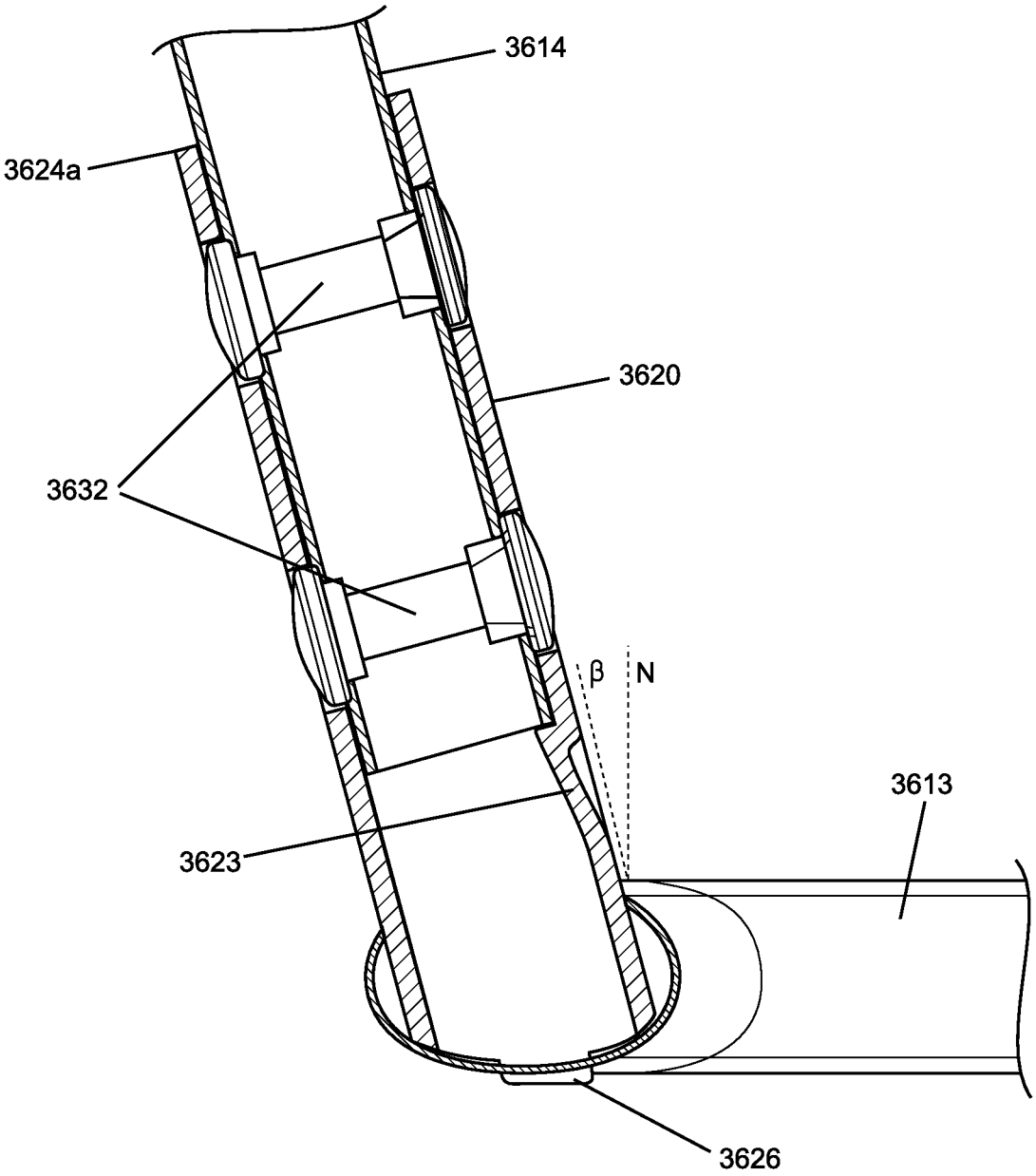
FIG. 36H illustrates a cutout view of the connection illustrated in FIGS. 36A-36C, and shows detail of the connection as formed between the frame arm, the stalk, and the base member.

After insertion, a first weld 3621*a* (e.g., a full perimeter weld) can be made at the stalk opening 3630 between the stalk opening and the body of stalk 3620, and a pair of second welds 3621*b* can be made between the tabs 3626 and the tab openings 3621*b* to secure the stalk 3620 to the base member 3513. As best illustrated in FIG. 36H, when inserted, the stalk 3620, or at least the portion of the stalk 3620 that engages with the base member 3513 as illustrated, is disposed at a stalk angle β with respect to a normal axis N, where the axis N can be orthogonal to a surface that the base member 3613 is placed on. The stalk angle β can be about 5 degrees, about 10 degrees, about 15 degrees, about 20 degrees, about 25 degrees or more, including all values and sub-ranges in between.

During assembly by a user, as described in greater detail in the next section, the user can insert the frame arm 3614 into the first end 3624*a* of the stalk 3620. The frame arm 3614 and the stalk 3620 can be sized such that the inserted frame arm 3614 can travel in a fitted manner inside the stalk 3620 until it engages with a ledge 3623 within the stalk 3620, which prevents further travel of the swing frame arm 3614 into the stalk. The ledge 3623 also encompasses a notch formed on the outer surface of the stalk 3620, which can serve as a visual guide to the user for the correct insertion of the stalk 3620 into the base member 3513.

The stalk 3620 can include a pair of stalk holes 3622 formed therethrough to permit insertion of bolts during assembly. The stalk holes 3624 can be substantially round as illustrated. Similarly, the frame arm 3614 can include a pair of arm holes 3634 formed therethrough that, upon insertion of the swing arm 3614 into the stalk 3620 such that the swing arm engages with the ledge 3623, can align with the stalk holes 3622. As best illustrated in FIG. 36G, the arm holes 3634 facing the center of the swing apparatus can be shaped to prevent rotation of the bolts 3632*b* once inserted through the stalk holes 3622 and the arm holes 3634. As an example, the arm holes 3634 are illustrates as being square or rectangular shaped.

Each of the bolt assemblies 3632 can include a first bolt 3632*a* that can include a head and an outer thread, and a second bolt 3632*b* that can include a head and an inner thread that can matingly receive the outer thread of its corresponding first bolt 3532*a* during assembly. The second bolt 3632*b* can also include a boss 3633 that is shaped to engage with the arm holes 3624 to prevent rotation of the second bolts 3632*b* once inserted. This permits the user to, once the second bolt 3632*b* is in place, to screw in its corresponding first bolt 3632*a* without having to hold the second bolt 3632*a* in place.

When the bolts assemblies 3632 are tightened (e.g., by screwing the first bolt 3632*a* into the second bolt 3632*b*), this can put pressure on the swing frame arm 3614 and lead to its expansion within the stalk 3620, which in turn can create a tighter, more rigid connection between the swing frame arm 3614 and the stalk 3620, and in in turn with the base member 3613. A tight connection between the swing frame arm 3614 and the stalk 3620 also prevents or mitigates rotational losses during swing motion.

FIG. 36A illustrates how, after assembly, a cover 3618 (e.g., a plastic cover) can be placed over the connection that substantially encapsulates the stalk 3620 to prevent any damage from mechanical impact or other issues.

Swing Stability

Figure 37:
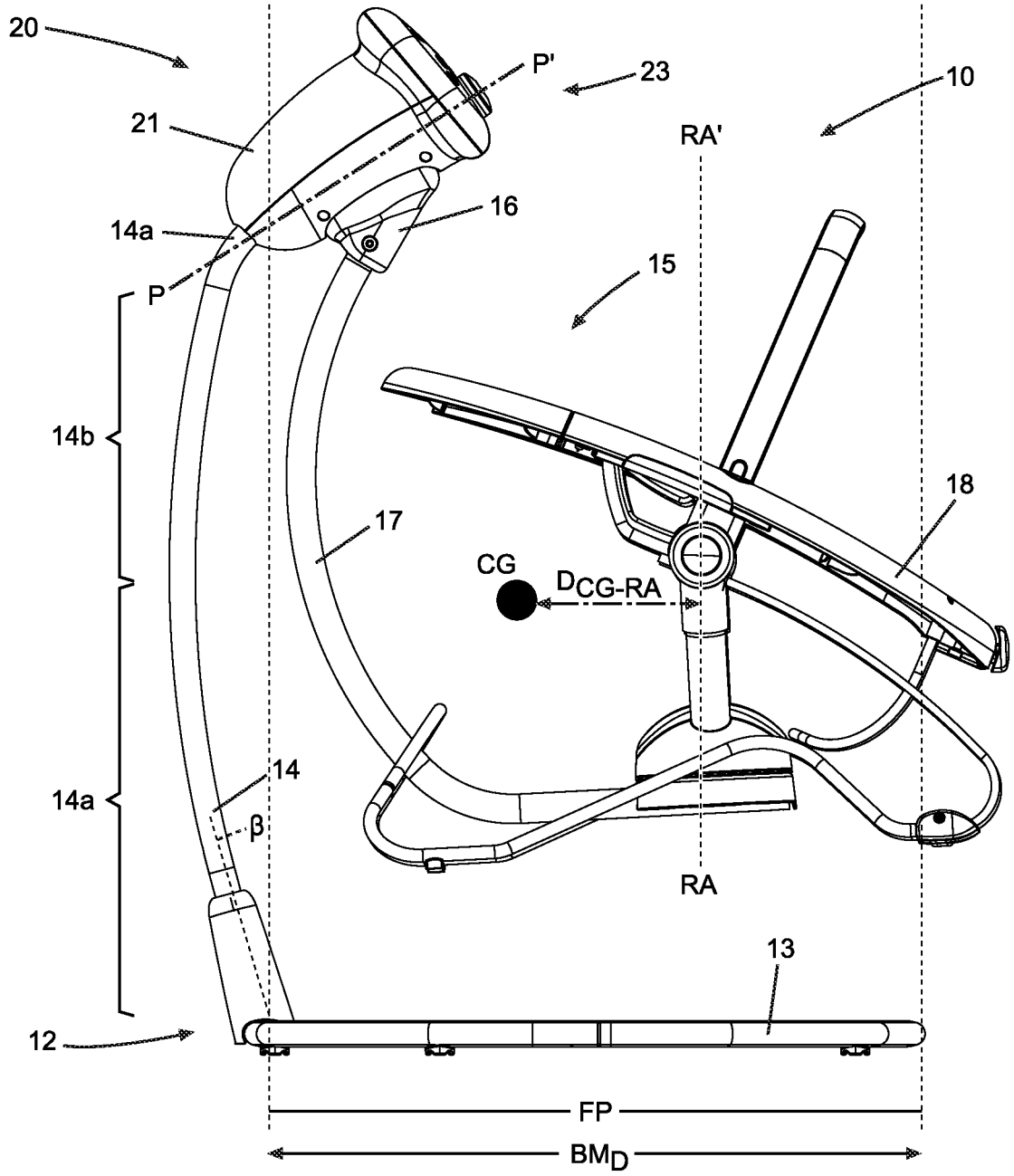
FIG. 37 illustrates the side view of FIG. 2 and references additional aspects of the swing apparatus.

FIG. 37 illustrates how the stalk angle β and the curved design of the swing frame arm 14 permit for a relatively smaller base member 13 while still providing a structurally sound design for the swing apparatus 10. A smaller base member 13 can encompass a base member with a smaller width, a smaller length, a smaller perimeter, and/or a smaller area than a corresponding design that includes a straight frame arm 14. The base member 13 defines a vertical footprint FP on the level floor/surface/ground that it rests on, i.e., the footprint FP can be considered a vertical projection of the frame of the base member 13 extending directly upwards from the floor. The swing frame arm can be curved as illustrated, and considered to include two portions 14*a*, 14*b* that are generally continuous. The first swing arm portion 14*a* defines the stalk angle β at its point of interconnection with the stalk 3620, and curves away from the footprint FP such that the portion 14*a* lies entirely outside the footprint. The second swing arm portion 14*b* curves back in towards the footprint FP. FIG. 37 illustrates that the entirety of the second swing arm portion 14*b*, and a portion of the housing 21, lies outside the footprint FP. In some cases, at least a portion of the second swing arm portion 14*b* can be within the footprint FP, such that the entirety of the housing 21 can lie inside the footprint FP.

The curvature of the frame arm 14 also permits for curvature in the swing arm 17 as illustrated, which in turn permits the seat 18 to be disposed relatively closer to the center of the swing apparatus 10. The use of a single frame arm 14, as opposed to two or more swing arms as seen in some conventional approaches, minimizes any space issues with the frame arm curving outwards from the base. Additionally, sufficient clearance is provided for mounting and removal of the seat 18 by virtue of the curved frame arm 14 and curved swing arm 17, while permitting the user interface panel 14 to nevertheless be disposed deeper within the footprint FP to permit ease of access to an adult/caregiver.

The curved frame arm 14 (and optionally, the curvature of the swing arm 17) also permits for not only a smaller footprint FP of the base member 13, but nevertheless maintains an overall center of gravity of the swing apparatus 10 closer to (for example) a geometric center of the footprint compared to the use of (for example) a straight frame arm. The stability is established and maintained when the seat 18 extends outside the footprint FP in rest position as illustrated, when a child/user is disposed in the seat 18, when the seat 18 is repositioned to be placed sideways, and even when seat 18 moves outside the footprint FP to a greater extent during swing motion as well.

More specifically, and as illustrated in FIGS. 1 and 37, the base member 13 can define the footprint FP, a base width $BM_W$, and a base depth $BM_D$. At rest, at least some portion of the seat 18 extends outside the footprint FP, along the depth $BM_D$ of the base member 13. When in swing motion, the horizontal travel of the seat 18 (i.e., the swing motion as projected onto the floor the swing sits on) can further result in additional portions of the seat 18 moving outside the footprint FP, along the width $BM_W$, at least at the ends of the swing motion. In some cases, the maximum swing angle α can be limited such that the seat 18 does not swing outside the footprint FP at ends of the swing motion. In some cases, the horizontal travel or lateral distance between the extents of the swing motion can be about 1 foot, about 1.5 feet, about 2 feet, about 2.5 feet, about 3 feet or more, including all values and sub-ranges in between.

These stated features of the swing also provide for a reduced separation between the center of gravity of the swing with a user/child in the seat 18 and a rotation axis defined by the seat 18. FIG. 37 illustrates, solely for purposes of explanation, a rotation axis RA-RA' defined by the seat 18, and an example center of gravity CG of the swing, recognizing that a center of gravity of the apparatus 10 need not lie within the components of the apparatus. Even with an anthropomorphic test device (ATD) disposed in the seat 18, a linear separation/offset $D_{CG\text{-}RA}$ between CG and the axis RA-RA' can be at most 0.5 inches, at most 1 inch, at most 1.5 inches, at most 2 inches, at most 5 inches, including all values and sub-ranges in between.

Based on all these features at least in part, the swing apparatus 10 can maintain upright positioning without tipping when placed on a 20 degree inclined surface and having an ATD (e.g., a newborn test dummy, a six-month old infant test dummy, and/or the like, per American Society for Testing and Materials (ASTM) specifications)) disposed in the seat 18.

Swing Apparatus Assembly

To permit for user self-assembly, a swing apparatus as disclosed herein can be manufactured, packaged, sold, and/or delivered as a kit including multiple components, with instructions for assembly by the user. Explained with reference to the swing apparatus 10 for simplicity, the kit can include a first component that includes the swing frame assembly 12 with the magnetic drive 20 already mounted thereto. Given the tight and critical coupling between the frame assembly 12 and the magnetic drive 20, this minimizes any user error and potential damage when assembling these parts. The magnetic drive 20 can already have coupled thereto the hub 16.

The first component can also include a power delivery circuit such as, for example, a power cable 3616 (see FIGS. 36A-36H) with a wall plug or adapter, that can be used to connect the magnetic drive 20 to an electrical wall socket.

The power cable 3616 can be partially disposed within the hollow shield 49 and pass through the swing frame assembly 12 to exit the assembly near the base of the assembly, i.e., near the floor/surface that the swing apparatus 10 is placed on. Wholly disposing the power delivery mechanism/circuit within the first component in this manner prevents user access to the magnetic drive components and ensures power delivery to the magnetic drive 20 without any user effort.

The first component can also include the cover 3618 pre-disposed on the frame arm 14 (e.g., taped or otherwise held in place on the frame arm at a location above the arm holes 3634). In this manner, after the caregiver bolts the frame arm 14 to the stalk 3620, the cover can be slid down to cover the stalk.

The kit can further include the swing arm 17 as a second, separate component that can be coupled to the magnetic drive 20, and more specifically to the hub 16. Further, the kit can include, as a third, separate component, the seat/seat frame 18 that in turn can be latched in place by the user, as explained for FIGS. 26A-26C.

In some cases, for ease of user assembly, there is no electrical coupling between the first component and the other components. For example, by obviating the need for electrical coupling between the first component and the seat 18, a user does not have to deal with drawing wires through the hub 16, the swing arm 17, etc. If the seat 18 does have a power requirement such as, for example, a motor drive (or more generally, any power consuming component) to vibrate the seat 18 during use, the seat 18 can include its own power source that is independent of the power delivery circuit of the first component. For example, the seat 18 can be configured to use AA batteries, AAA batteries, plug-in power input, and/or the like, to power the power consuming component. The kit may include such additional power sources.

The kit can also include the base member 13 as a single base (e.g., as a fourth component), or as two base parts (e.g., as fourth and fifth components) of generally the same or differing sizes. For example, each base part can be generally C-shaped and have telescoping ends that mate with the telescoping ends of the other base part. As explained above with respect to FIGS. 36A-36H, the base member 13 can include welded thereto a stalk, such as the stalk 3620, that can serve as a receptacle for the swing frame arm 14 of the swing frame assembly 12. The kit can also include additional components such as, for example, the bolts 3632*a*, the bolts 3632*b*, and/or the like.

Glide Swing With Magnetic Drive

Figure 22B:
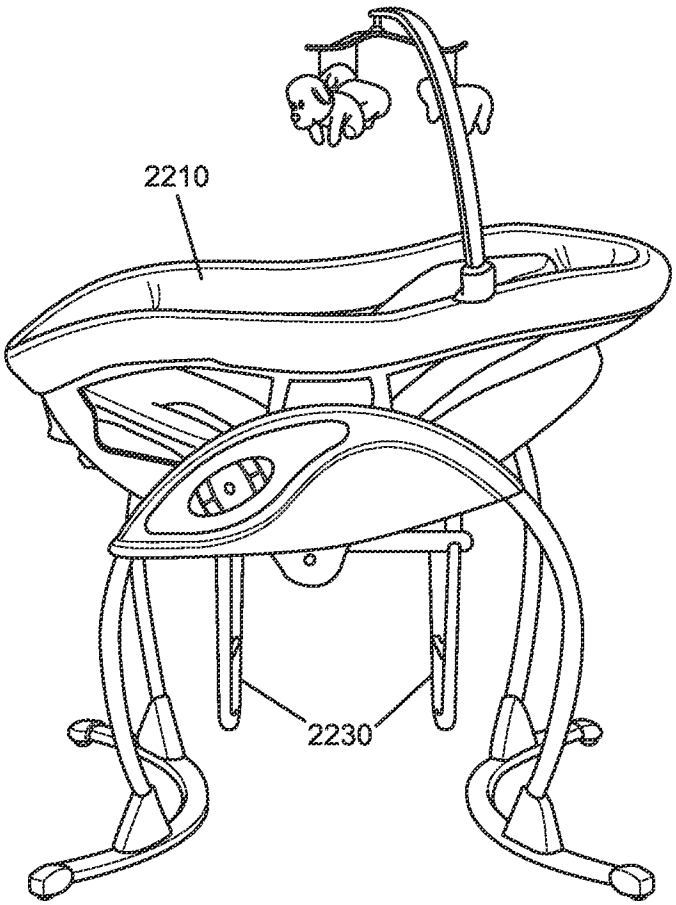
FIG. 22B illustrates a side view of the glider swing apparatus of FIG. 22A.
Figure 22A:
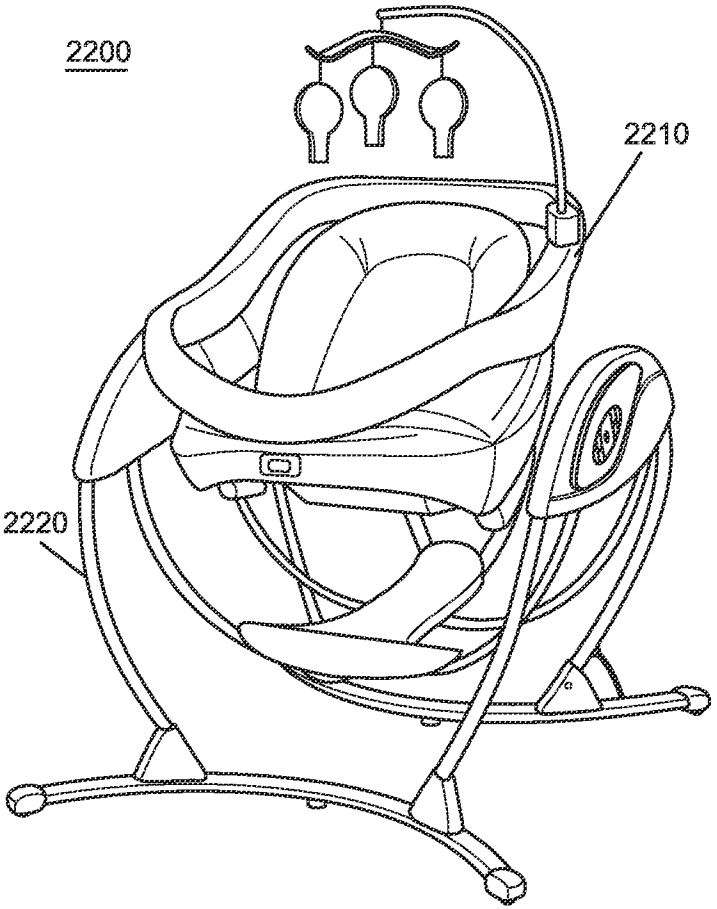
FIG. 22A illustrates a glider swing apparatus including a magnetic drive.
Figure 23A:
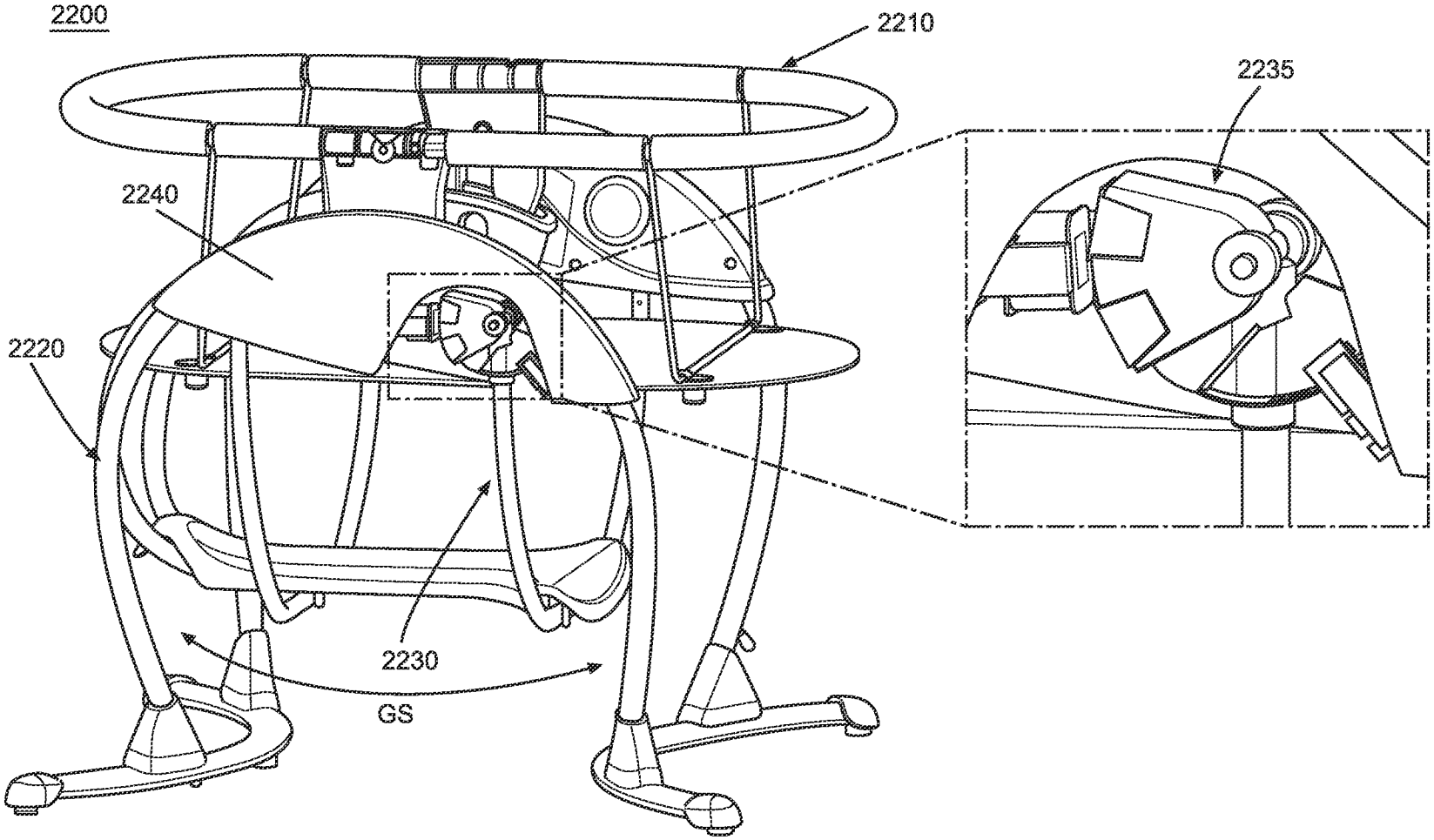
FIG. 23A illustrates a perspective view of the glider swing apparatus of FIG. 22A, including an exploded cutaway view of a portion including the magnetic drive to show inner detail.

FIGS. 22A, 22B show a glide swing apparatus 2200 with magnetic drive and control as described herein. Unless expressly indicated otherwise, similarly referenced and names components may be structurally and/or functionally similar to those of any other apparatus disclosed herein such as, for example, the apparatus 10. The apparatus 2200 includes a frame 2220 which holds and/or otherwise supports a seat 2210, arms 2230, and a set of two housings 2240 that are suspended from the frame 2220. As illustrated in FIGS. 22A, 22B, 23A, a magnetic drive 2235 is disposed inside one of the housings 2240. The magnetic drive 2235 is illustrated as having (similar to the apparatus 10) two magnets 2260 and one electromagnet 2265, though it is understood that the magnetic drive 2235 can be formed as having three magnets and two electromagnet as described for FIGS. 16-18, as having one curved magnet and one electromagnet as described for FIGS. 19 and 20A-20D, and/or the like.

As illustrated, the magnetic drive 2235 can drive one of the four swing arms 2230 suspended from the frame 2220, though it is understood that two or more of the swing arms 2230 can be attached to the magnetic drive 2235, and that more than one magnetic drive can be employed to drive two or more of the swing arms. For example, a magnetic drive 2235 can be disposed in each housing 2240.

Figure 23B:
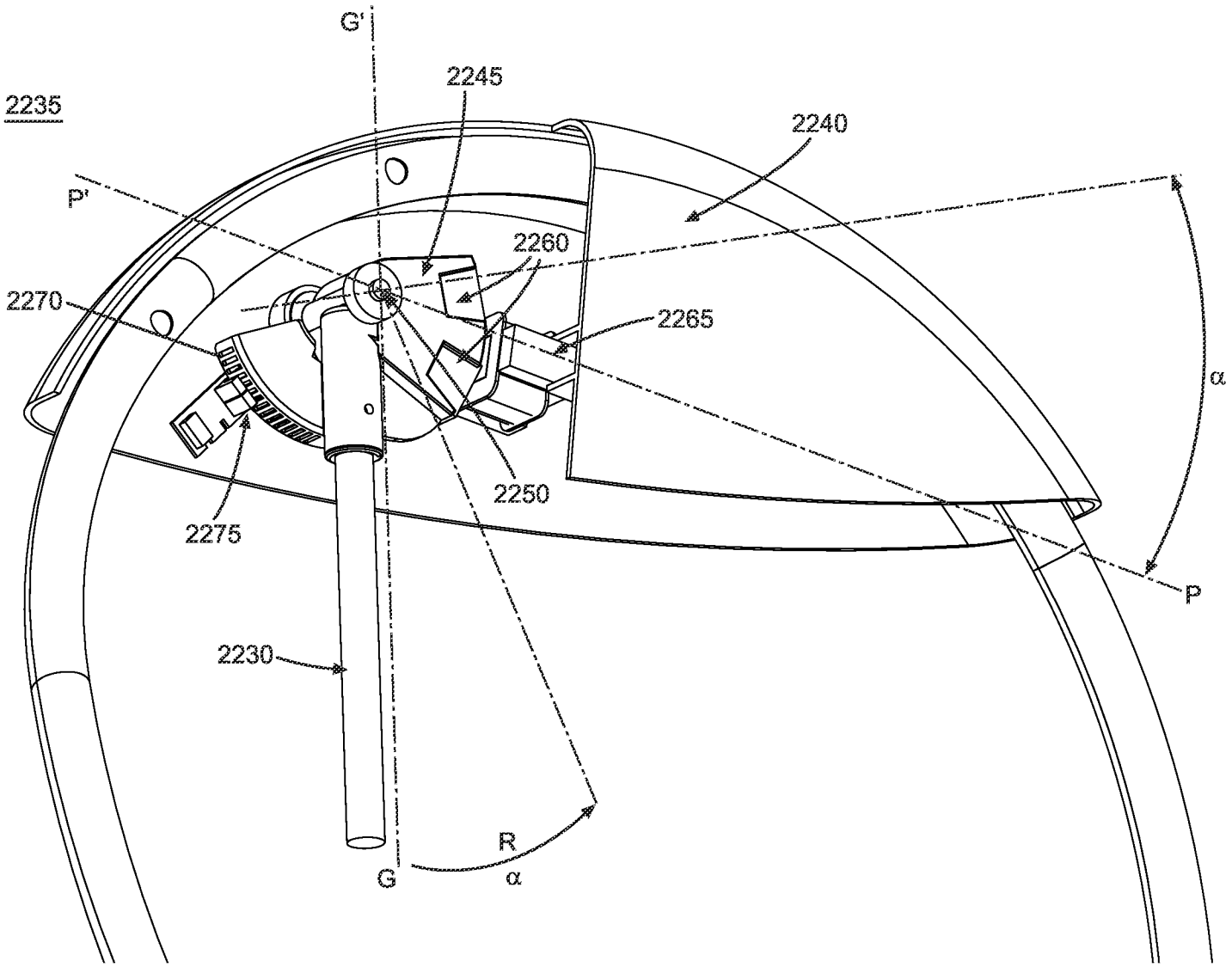
FIG. 23B illustrates a magnified view of the magnetic drive of the glider swing apparatus of FIG. 22A.

FIG. 23B illustrates one swing arm 2230 being rotationally coupled to the frame 2220 about the pivot axis shaft 2250 and two bearings (not shown) that are mounted to the housing 2240. Similar to the apparatus 10, the electromagnet 2265 is disposed on the pivot axis P-P', and the permanent magnets 2260 are each angularly separated from the pivot axis P-P' by the swing angle $\alpha$. This rotational coupling allows the glider swing arm 2230 to pivot freely and swing front-to-back or back-to-front in a reciprocating, gliding motion relative to the glider swing frame 2220, as generally illustrated by the arc GS (see FIG. 23A).

The electromagnet 2265 is mounted to the glider frame 2220 via the housing 2240, and the magnets 2260 are mounted on a magnet bracket 2245, which in turn is also coupled to the swing arm 2230. Similar to the apparatus 10, an encoder strip 2270 with multiple slots is connected to the bracket 2245, or to one of the magnets 2260. An optical sensor 2275 is mounted to the glider housing 2240 and can generally be similar to the sensor 35.

During use such as, for example, when a user initiates operation of the swing apparatus 2200 via a user interface (not shown), the electromagnet 2265 is energized in a cyclical manner similar that described for the apparatus 10. This results in the swing arm 2230 rotating through the swing angle $\alpha$ (shown for the right direction R in FIG. 23B), and in turn resulting in the swing apparatus rocking the seat 2210 back and forth along the arc GS, as illustrated in FIG. 23B by rotation of the swing arm 2230 and its corresponding longitudinal axis G-G', which passes through the pivot axis P-P', through the swing angle $\alpha$ in the right direction R. Similar to the apparatus 10, a controller similar to the controller 2102 controls and monitors operation of the magnetic drive 2235.

Swing Apparatus With Removable Seat

FIGS. 25A-25D illustrate a swing apparatus 2500 that includes a removable seat 2518. Unless expressly indicated otherwise, similarly referenced and names components may be structurally and/or functionally similar to those of any other apparatus disclosed herein such as, for example, the apparatus 10.

As a preliminary matter, while the seat 2518 is illustrated as positioned such that a child/user in the seat faces away from the swing arm assembly 2512 during use, it is understood that the seat may be repositionable, i.e., be removable and re-mountable to have the child/user face a different direction. For example, the seat can be positioned as illustrated, or sideways such that the swing arm assembly 2512 is to the left or to the right of the child/user during use. The seat 2518 can also encompass a bouncer mechanism such as, for example, a spring-like mechanism that, once an adult/caregiver pulls the seat forwards, permits the seat to bounce/spring back and forth till the motion dampens. The seat 2518 can also include an adjustable recline feature (e.g., between three reclining positions).

Figure 25A:
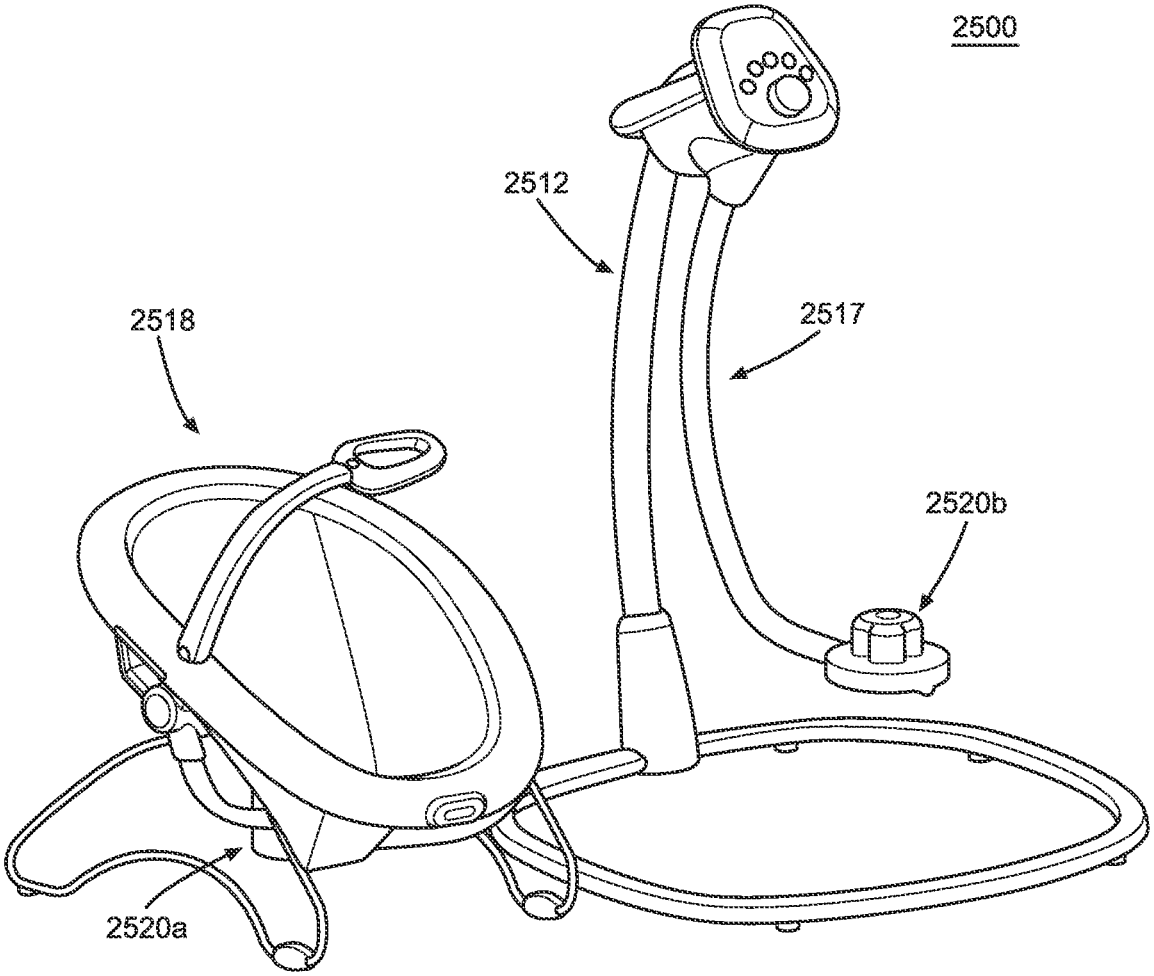
FIG. 25A illustrates a swing apparatus with a removable, stand-alone seat, and with the seat removed from the rest of the swing apparatus.
Figure 25B:
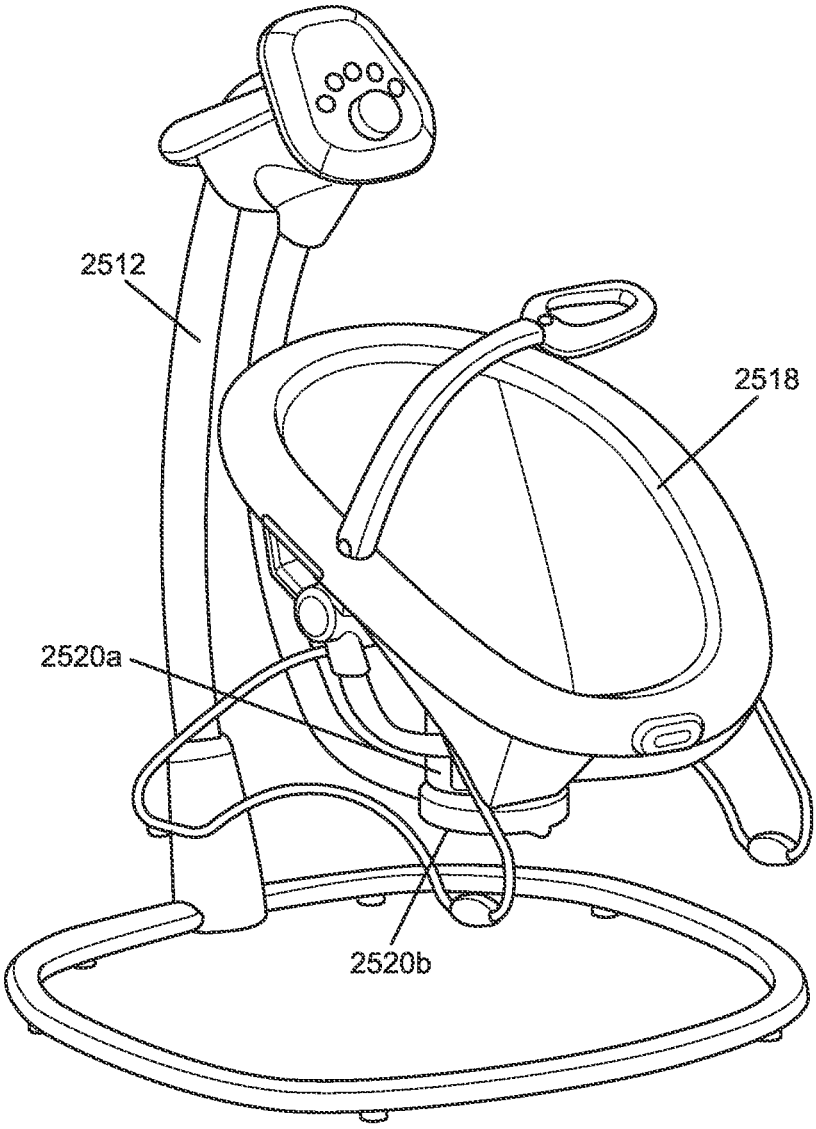
FIG. 25B illustrates the swing apparatus of FIG. 25A, with the seat coupled to the rest of the swing apparatus.
Figure 25D:
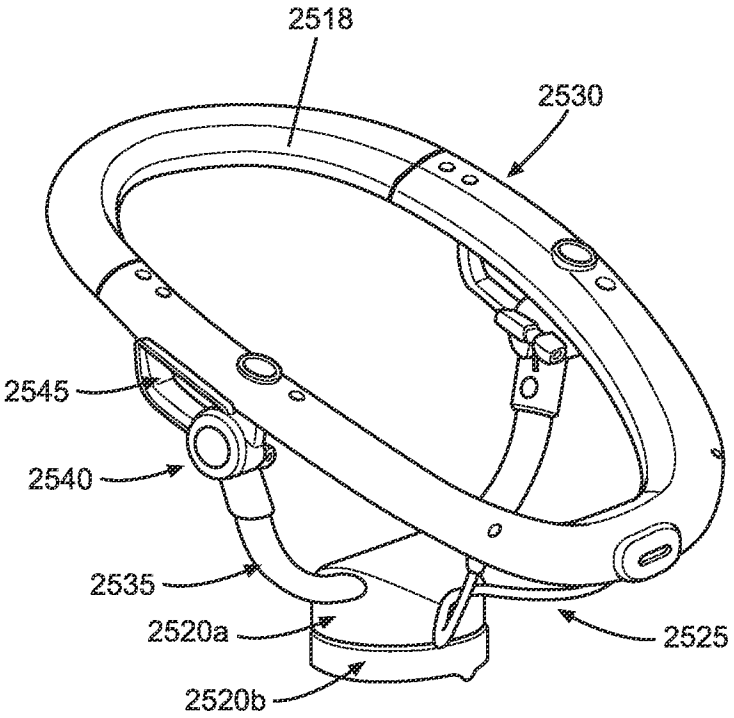
FIG. 25D illustrates the seat of FIG. 25C with a toy bar, swing arm, and a seat base further removed to show structural detail.
Figure 25C:
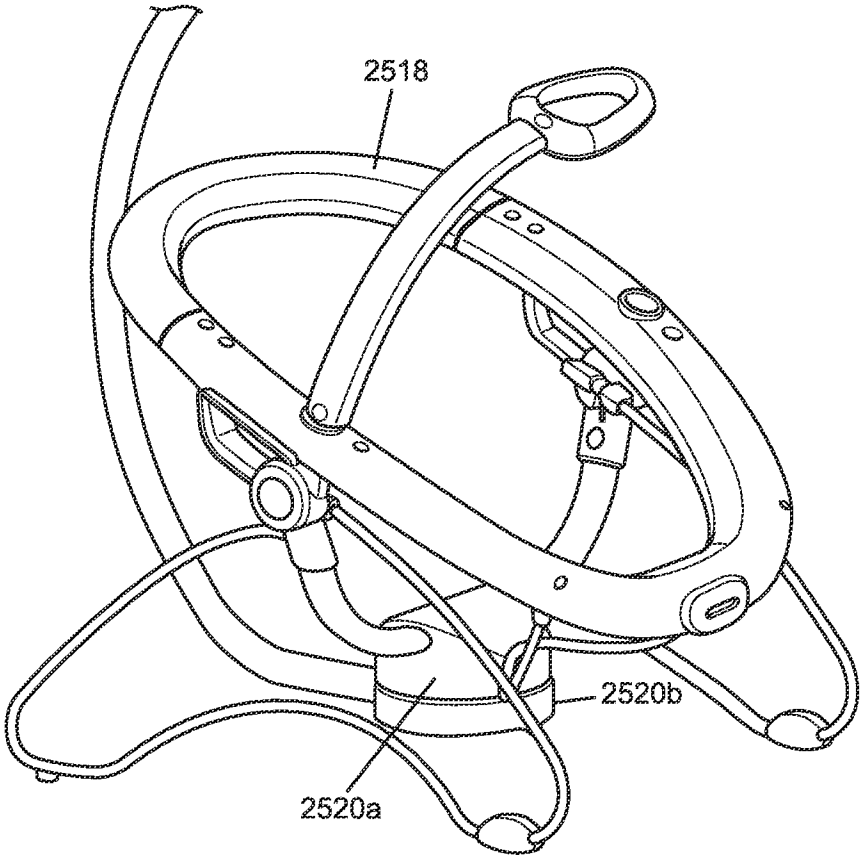
FIG. 25C illustrates an exploded perspective view of the seat of the swing apparatus of FIG. 25A, with the soft goods removed to show structural detail.

The seat 2518 can be mounted to the swing arm 2517 (FIG. 25B) or used as a standalone seat (FIG. 25A). The seat 2518 includes a seat mount/connector 2520*a* that can be aligned with a swing mount/connector 2520*b* for removable attachment of the seat to the swing arm 2517. Although the mount 2520*b* is illustrated as a plug-like connector and the mount 2520*a* is illustrated as a receptacle-like connector, the reverse can be the case, and generally any other suitable mating connector designs can be employed. When attached to the swing mount 2520*b*, the seat 2518 can be reversibly latched and/or otherwise fastened in place and cannot be removed unless the latch/fastener is released. FIGS. 25C, 25D illustrate additional details of the latching mechanism of the seat 2518 with the soft goods, toy bar, swing arm and seat base hidden. The operation of the latching mechanism is explained with reference to FIGS. 25A-25D, and 26A-26C, which also illustrate additional detail of the mounts 2520*a*, 2520*b* that permit latching.

The latch/latch mechanism includes an actuator/switch 2545 (e.g., a depressible button, a lever, a slider, and/or the like) that is pivotally coupled to the seat ring 2530, and allows the caretaker/user to actuate a latch/fastener 2555. A cable 2550 is connected to the switch 2545 at one end and routed through a curved tube 2535 to the mount 2520*a*, where the tube 2535 is curved to accommodate a child during use and also serves to connects the seat ring 2530 to the seat mount 2520*a*. It is also understood that while the latch mechanism is illustrated here as a single mechanism formed on one of the tubes 2535 of the seat 2518, it can be similarly formed on an opposing tube (see FIGS. 25C, 25D) of the seat as well.

Figure 26A:
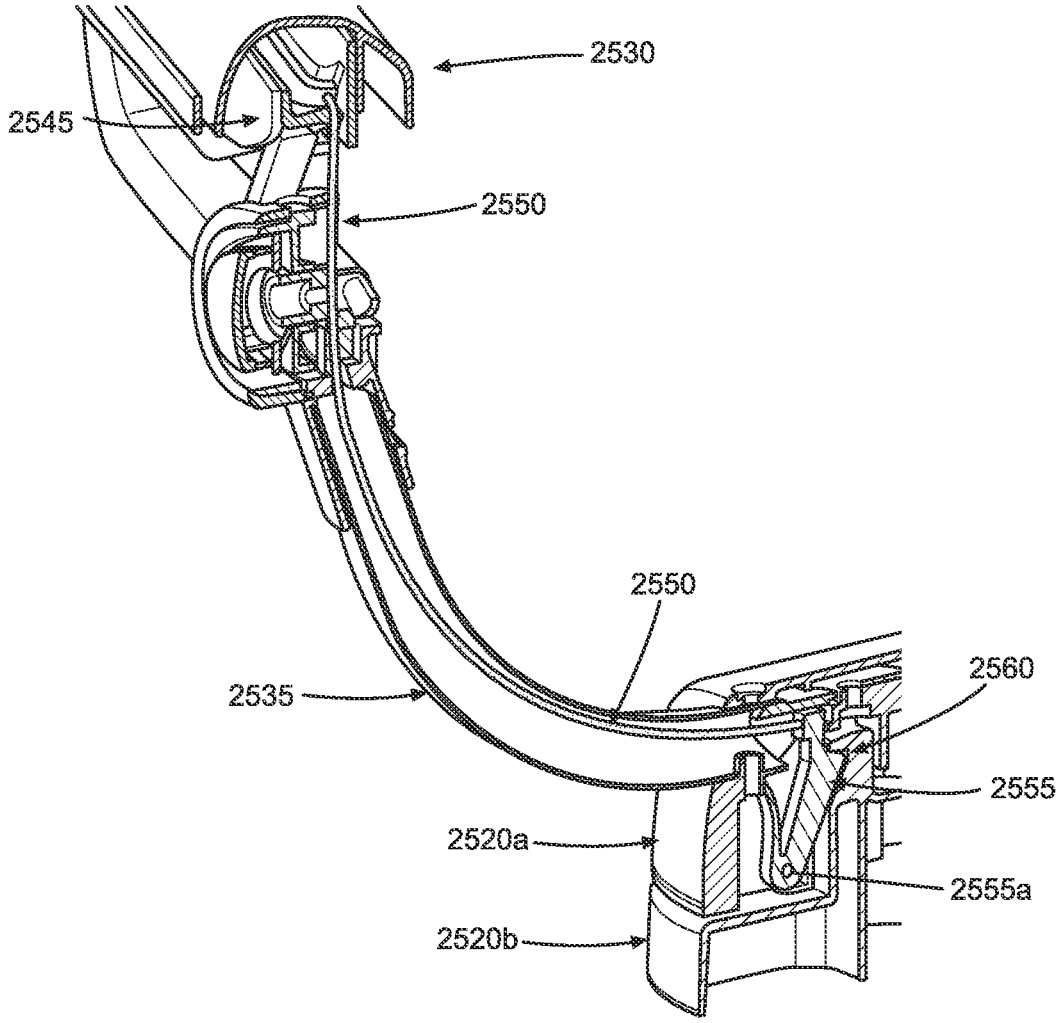
FIG. 26A illustrates a cross-section of a latch mechanism for the removable seat of FIG. 25A.
Figure 26C:
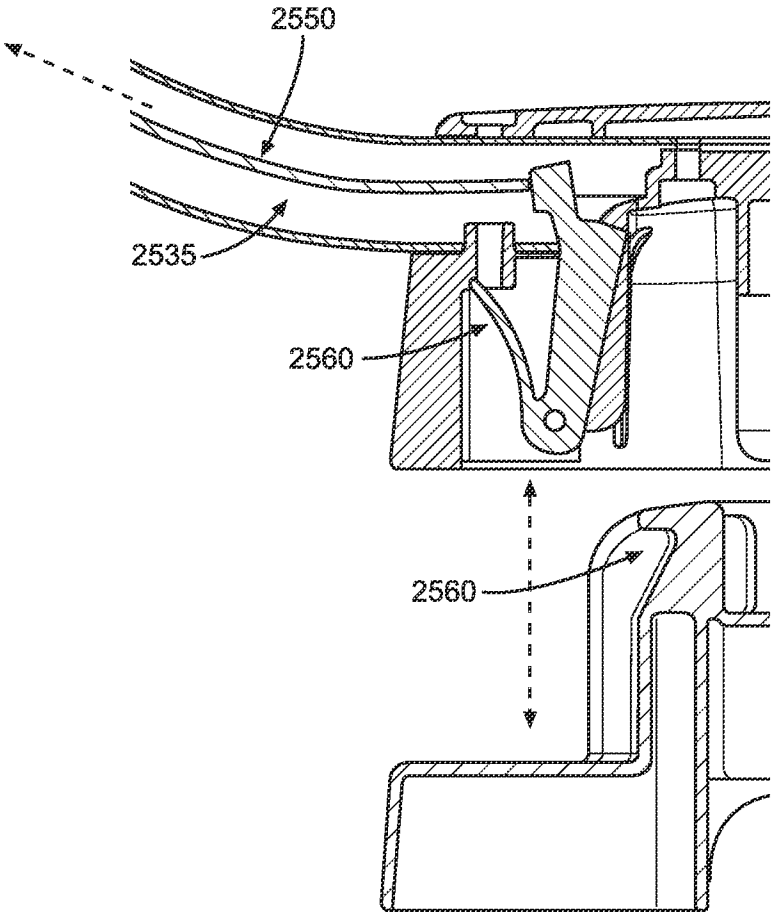
FIG. 26C is a magnified view of the latch mechanism of FIG. 26A, with the latch disengaged.
Figure 26B:
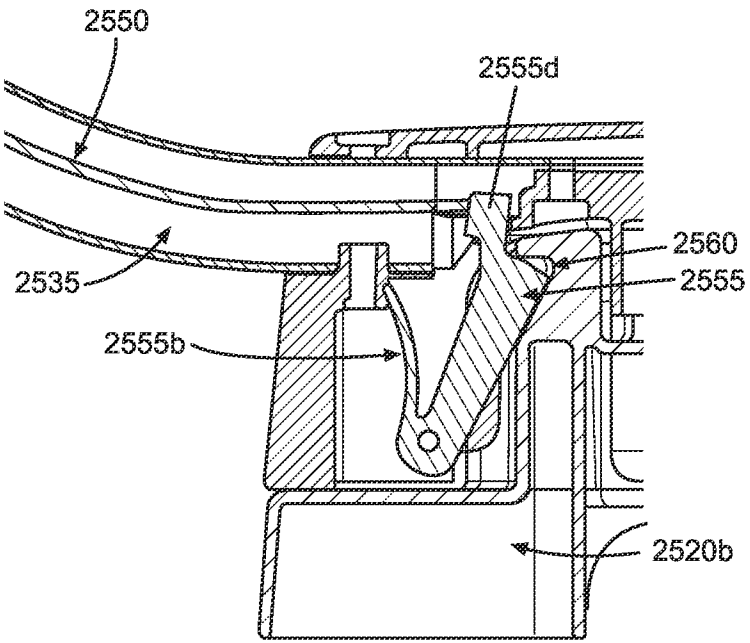
FIG. 26B is a magnified view of the latch mechanism of FIG. 26A, with the latch engaged.

The second end of the cable 2550 is attached to the latch 2555, illustrated here as a V-shaped fastener that pivots about its base 2555*a*, i.e., the base is rotatably fixed to the seat mount 2520*a* and the latch 2555 can rotate back and forth as the caretaker squeezes and releases the switch 2545. The V-shaped latch 2555 also includes a first arm 2555*b* and a second arm 2555*c*. The second end of the cable 2550 attaches to a hook end 2555*d* of the second arm 2555*c*. When the seat 2518 is mounted onto the rest of the apparatus (see FIG. 26B) a user is not engaging the switch 2545, the latch 2555 is held against the swing mount 2520*b* by pressure applied by the first arm 2555*b*, which can be a resiliently flexible finger/spring. The second arm 2555*b* of the latch 2555 protrudes into a latch pocket 2560 formed on the swing mount 2520*b*, which prevents the swing arm mount 2520*b* from being separated and/or pulled apart from the seat mount 2520*a* (FIG. 26B). To remove the seat 2518 from the seat mount 2520*a*, a caretaker can squeeze or otherwise engage the switch 2555, which in turn which pulls on the cable 2550, and which in turn pulls the latch arm 2555*c* out of the latch pocket 2560. With the latch 2555 disengaged in this manner, the swing mount 2520*b* and seat mount 2520*a* can be separated (FIG. 26C).

Magnet Design

Figure 27B:
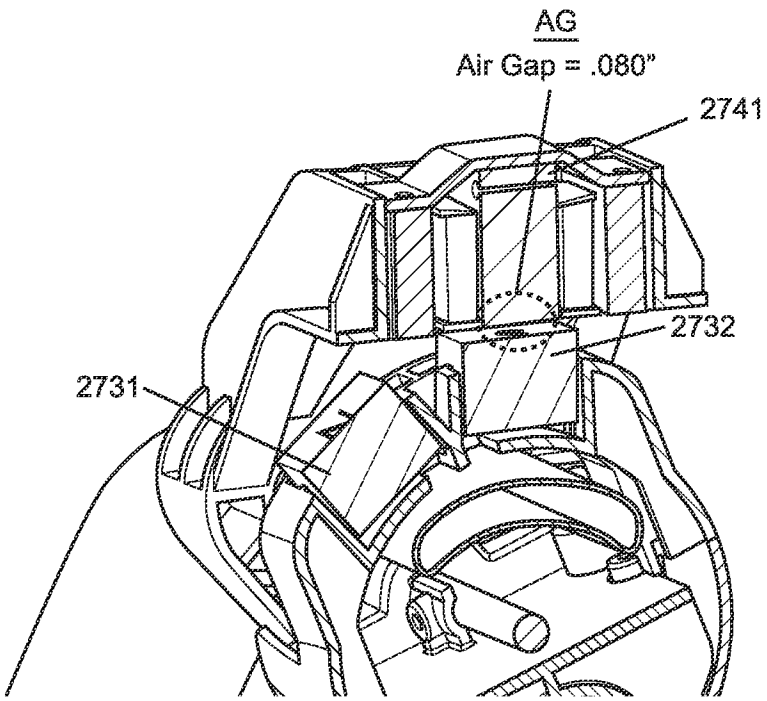
FIG. 27B illustrates another example air gap between the permanent magnets and electromagnets for the swing apparatus of FIG. 1.
Figure 27A:
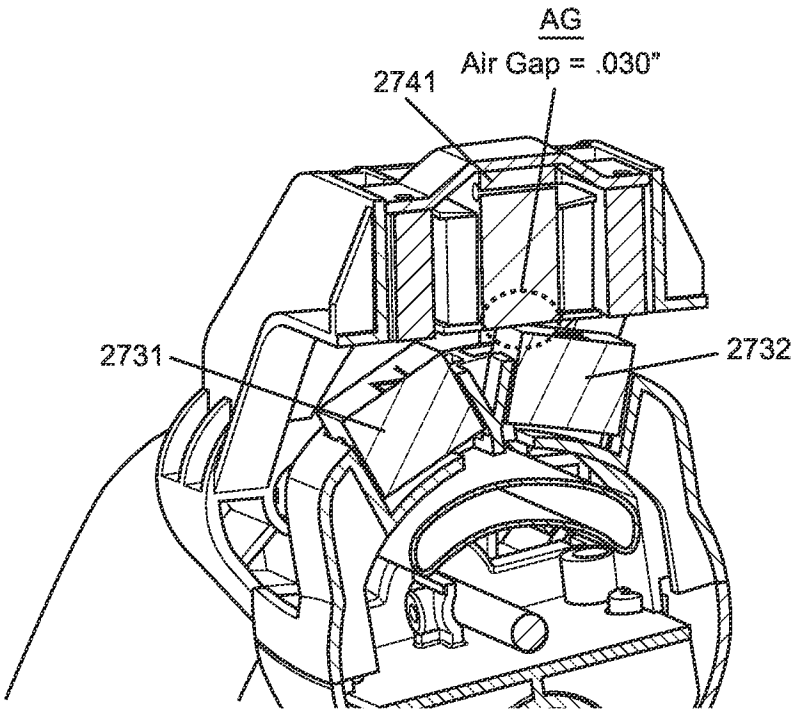
FIG. 27A illustrates an example air gap between the permanent magnets and electromagnets for the swing apparatus of FIG. 1.

FIGS. 27A, 27B illustrate how permanent magnets with flat faces, such as the magnets 52, 53 illustrated for the apparatus 10, may not maintain a consistent air gap with the electromagnets. Explained another way, flat surfaces on the magnets and the opposing electromagnets that are moving along arcs result in differential spaces between them not only at different extent of alignments, but between different portions of their respective poles/faces. As shown in these figures, as a magnet 2732 rotates about the pivot axis P-P' and across the opposite face of the electromagnet 2741, the variation in the air/separation gap AG therebetween can vary within a range of +/−0.025 inches, depending on the rotational position of the magnet 2732 and the permanent magnet 2741. Variable air gaps between the permanent magnet(s) and electromagnet(s) can result in variable magnetic forces between them that are reduced at points and times where the air gap is larger, and vice versa.

Figure 28:
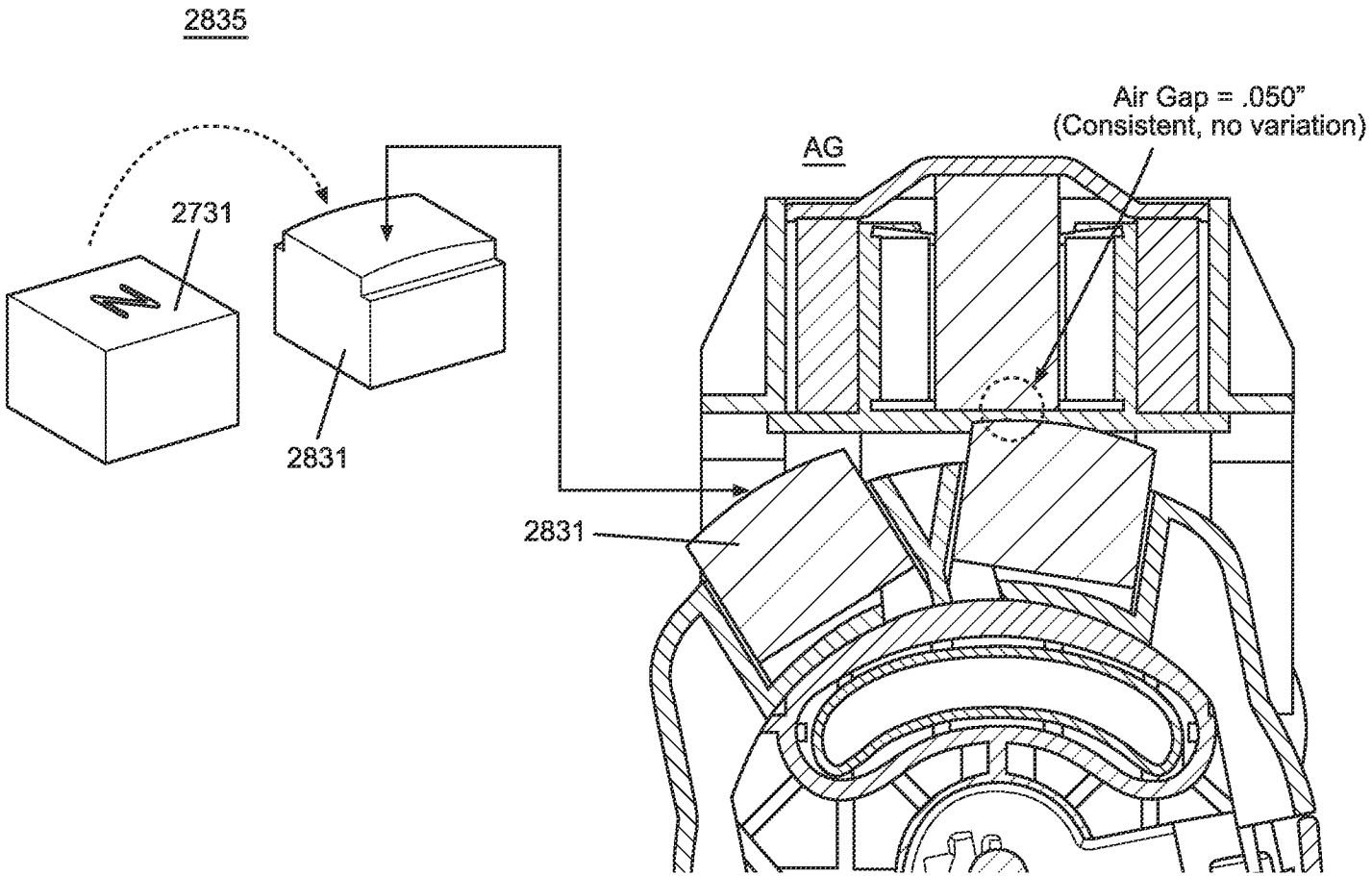
FIG. 28 illustrates a permanent magnet with a curved face when used with any swing apparatus as disclosed herein.

FIG. 28 illustrates an example approach to eliminate and/or minimize variation in the air gap AG. Here, it is illustrated that any of the magnets 2731-2733 can be modified to include a curved face 2835, resulting (here) in the magnet design 2831. The curvature of the curved face 2835 can be generally concentric with the pivot axis P-P'. The separation gap AG between the magnet 2831 and the electromagnet 2742 is then substantially consistent, about 0.050", as the magnet 2831 rotates about the pivot axis. In some cases, the electromagnet 2742 can also have a corresponding curvature that is concentric with the pivot axis P-P', which can lead to additional uniformity in magnetic interaction between the magnet 2831 and the electromagnet 2742.

Figure 29:
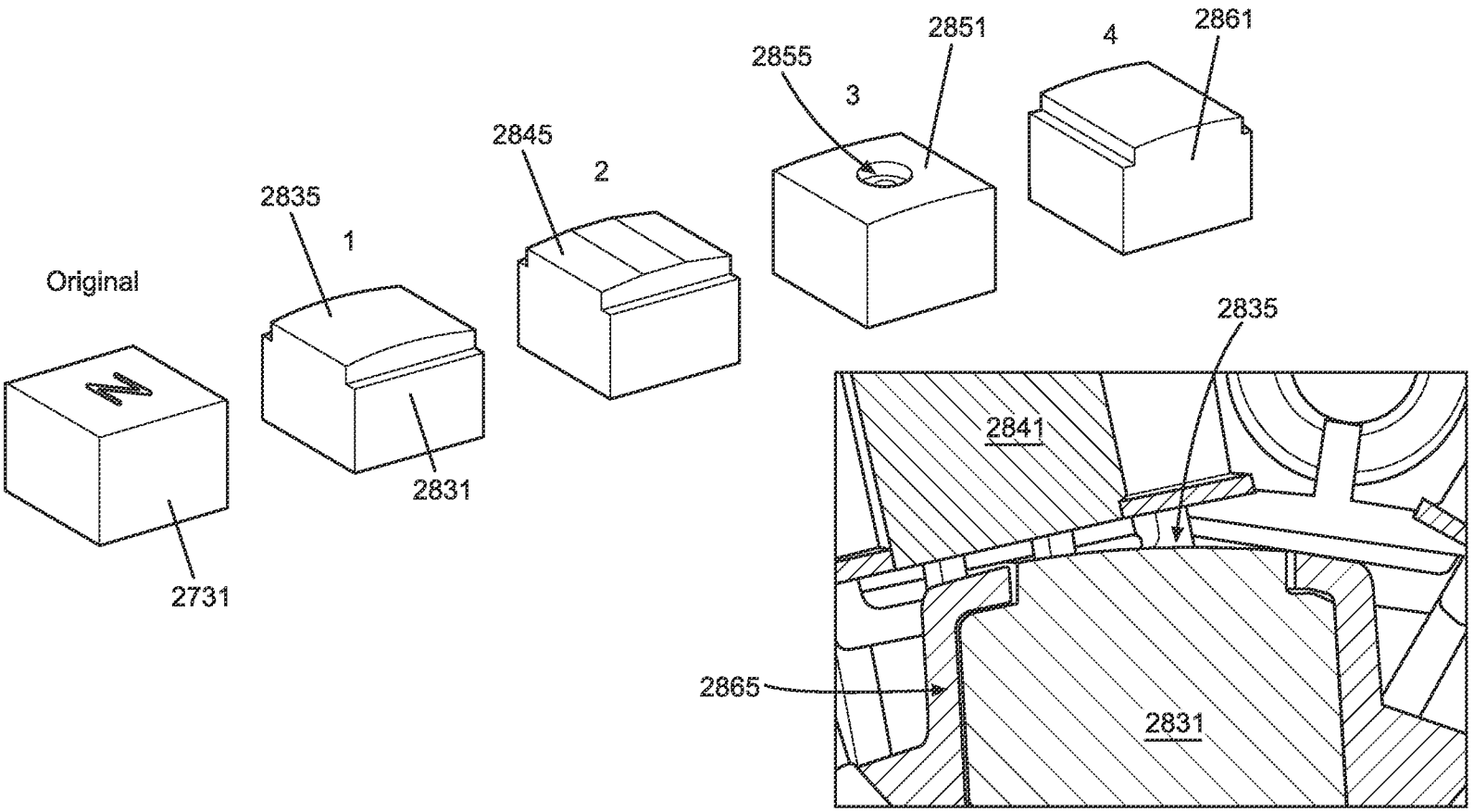
FIG. 29 illustrates permanent magnets with varied face designs, when used with the swing apparatus of FIG. 1.

FIG. 29 illustrate additional designs and design variations for the representative magnet 2731 which can aid in maintaining a consistent air gap AG. The magnet 2831 includes a curved face 2835, as explained for FIG. 28. The magnet 2841 has a chamfered face 2845, i.e., instead of a smooth and continuous curved face, its face is composed of multiple planar components that meet at edges to define a discontinuous curve. In another design, the magnet 2851 includes a curved face as well as a hole 2855 for screw-mounting of the magnet 2851 onto a frame/support of a magnetic drive as described herein. FIG. 29 also illustrates the magnets 2831, 2841, and 2861 as having a detent/rib 2848 on their top face, without any part of it protruding past the magnet's curved face. The magnet 2861 can be similar to the magnet 2831 with the curved face 2835 except that the rib 2858 on the magnet 2861 is formed on different sides relative to the magnet 2831. As illustrated in FIG. 29 for the magnet 2831, the detent 2848 can engage with a containment rib 2865 of a magnetic drive to securely hold the magnet 2831 in place during use.

Figure 30:
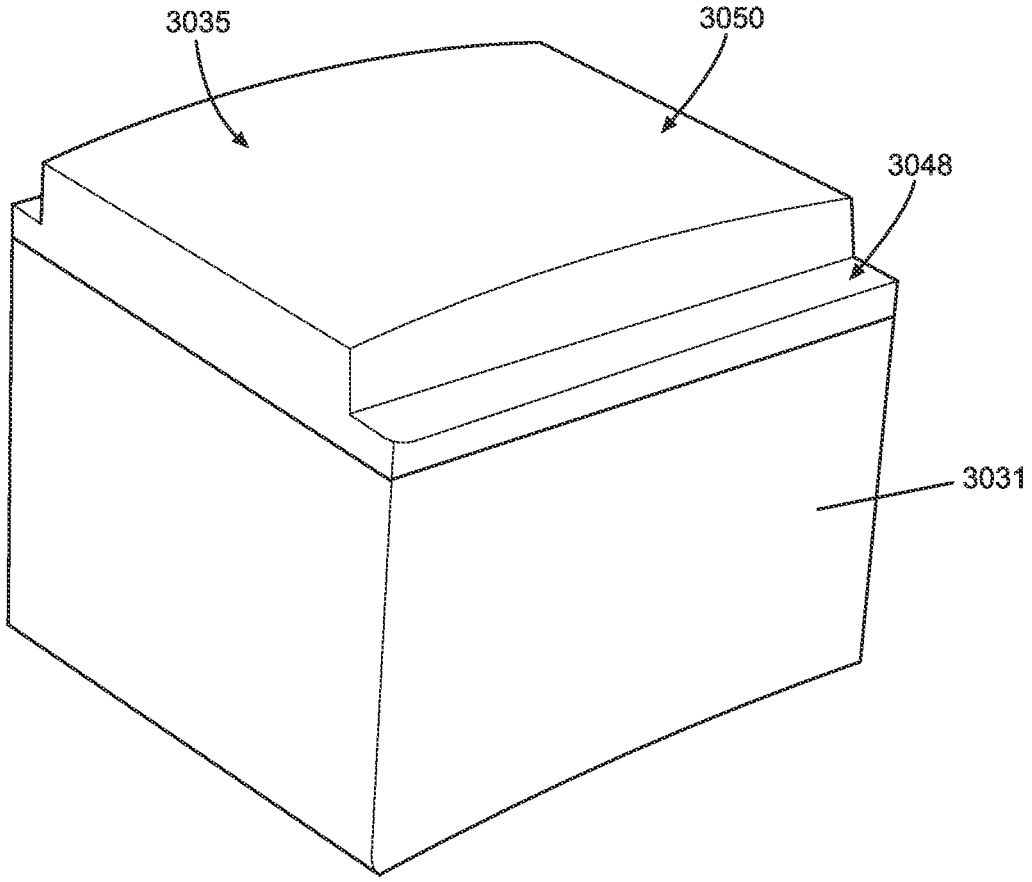
FIG. 30 is an image of a permanent magnet with a removable metal cap formed as a curved surface.

FIG. 30 illustrates that, instead of a magnet formed with a curved face, a curved metal cap 3050 may be employed as a lid over a flat face of a permanent magnet. In this manner, existing flat-faced magnets can be converted into magnets with curved faces for use in a magnetic drive as disclosed herein, and permit a consistent separation gap AG between that magnet and electromagnets of the magnetic drive. The metal cap 3050 can be sized and shaped such that upon assembly a detent 3048 is formed on the flat face of the magnet, which as explained for FIG. 29, is useful for fastening the magnet to the magnetic drive assembly. While illustrated here to yield a curved-face magnet similar to the magnet 2831 of FIG. 29, it is understood that such caps can be designed to yield the magnet(s) 2841, 2851, and/or 2861.

Conclusion

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A swing apparatus, comprising:

a magnetic drive including an electromagnet and a plurality of permanent magnets; and a controller coupled to the electromagnet to activate the electromagnet by applying an activation current having a polarity selectable from a first polarity and a second polarity and thereby initiating a motion of at least a portion of the swing apparatus, the controller being configured to:

A1) apply the activation current having one of the first polarity and the second polarity;

A2) determine if at least the portion of the swing apparatus has moved at least a predetermined amount;

A3) if, after a predetermined time period, at least the portion of the swing apparatus has not moved by at least the predetermined amount, then switch the polarity of the activation current to the other of the first polarity and the second polarity; and A4) repeat A2) and A3) until it is determined, at A2), that the swing apparatus has moved by at least the predetermined amount.

2. The swing apparatus of claim 1, further comprising:

a plurality of optical sensors coupled to the controller, the plurality of optical sensors comprising:

a first light source to emit a first light beam propagating along a first optical path;

a first detector, spaced from the first light source and disposed in the first optical path to detect the first light beam;

a second light source to emit a second light beam along a second optical path substantially parallel to the first optical path and offset from the first optical path by a separation distance;

a second detector, spaced from the second light source and disposed in the second optical path to detect the second light beam; and an optical encoder strip disposed in the first optical path and the second optical path to modulate detection of the first light beam by the first detector to affect a change in state of the first detector, and to modulate detection of the second light beam by the second detector to affect a change in state of the second detector, wherein the controller is further configured to determine, at A2), if at least the portion of the swing apparatus has moved at least a predetermined amount by detecting a change of state of at least one of the first detector and the second detector.

3. The swing apparatus of claim 1, wherein the controller is further configured to, when it is determined at A2) that the swing apparatus has moved by at least the predetermined amount:

A5) determine if the portion of the swing apparatus has changed direction of swing motion.

4. The swing apparatus of claim 3, wherein the controller is further configured to, when it is determined at A5) that the portion of the swing apparatus has not changed direction of swing motion, repeat A2) and A3).

5. The swing apparatus of claim 3, wherein the controller is further configured to, when it is determined at A2) that the swing apparatus has moved by at least the predetermined amount:

A6) increment a swing angle measure associated with the motion of the portion of the swing apparatus.

6. The swing apparatus of claim 5, wherein the controller is further configured to, when it is determined at A5) that the portion of the swing apparatus has changed direction of motion:

A7) switch the polarity of the activation current being applied to the electromagnet.

7. The swing apparatus of claim 6, wherein the controller if further configured to, after A7):

A8) if the swing angle measure exceeds a predetermined setpoint, set the activation current to zero.

8. The swing apparatus of claim 7, wherein the controller is further configured to, after the activation current is set to zero at A8), repeat A2) and A3).

9. The swing apparatus of claim 7, wherein the controller is further configured to, after A7):

A9) if the swing angle measure is less than the predetermined setpoint, modulate the activation current.

10. The swing apparatus of claim 9, wherein the controller is further configured to modulate the activation current at A9) by:

computing an error value based on the swing angle measure and the predetermined setpoint;

computing one or more of a proportional term, a derivative term, or an integral term based on the error value; and modulating the activation current based on the one or more of the proportional term, the derivative term, or the integral term.

11. The swing apparatus of claim 9, wherein the controller is further configured to, after the activation current is modulated in A9), repeat A2) and A3).

12. The swing apparatus of claim 3, wherein the controller is further configured to determine when the portion of the swing apparatus changes direction during the motion without determining when the portion of the swing apparatus passes through an equilibrium position of the motion.

13. A swing apparatus, comprising:

an electromagnet;

a plurality of permanent magnets positioned proximate to the electromagnet such that, upon electrical activation of the electromagnet, magnetic forces are generated between the electromagnet and each permanent magnet of the plurality of permanent magnets; and a controller coupled to the electromagnet, to electrically activate the electromagnet and thereby initiate swing motion of the swing apparatus without manual intervention by a user of the swing apparatus, wherein in a neutral position, the electromagnet is disposed in a pivot plane that includes a pivot axis, and each permanent magnet of the plurality of permanent magnets is disposed outside the pivot plane.

14. The swing apparatus of claim 13, wherein neither the electromagnet nor any of the plurality of permanent magnets is formed on the seat.

15. The swing apparatus of claim 13, wherein adjacent permanent magnets of the plurality of permanent magnets are arranged to have opposing polarities facing the electromagnet, and wherein, upon electrical activation, the electromagnet attains a predefined polarity on a face of the electromagnet facing the plurality of permanent magnets, and such that attractive magnetic forces and repulsive magnetic forces are concurrently generated between the electromagnet and the plurality of permanent magnets.

16. A swing apparatus, comprising:

an arm assembly including a seat;

a frame assembly coupled to the arm assembly and defining a pivot axis about which the arm assembly rotates during operation of the swing apparatus;

an electromagnet disposed on the frame assembly; and a plurality of permanent magnets disposed on the arm assembly and positioned to define an arc centered on the pivot axis, wherein, when the seat is in a neutral position, the electromagnet has a first angular offset relative to a pivot plane that includes the pivot axis.

17. The swing apparatus of claim 16, wherein neither the electromagnet nor any of the plurality of permanent magnets is formed on the seat.

18. The swing apparatus of claim 16, wherein adjacent permanent magnets of the plurality of permanent magnets are arranged to have opposing polarities facing the electromagnet.

19. The swing apparatus of claim 18, further comprising:

a controller electrically activating the electromagnet such that the electromagnet attains a first magnetic polarity on a face of the electromagnet facing the plurality of permanent magnets, and such that attractive magnetic forces and repulsive magnetic forces are concurrently generated between the electromagnet and the plurality of permanent magnets.

20. The swing apparatus of claim 16, further including a further electromagnet offset positioned so that, when the seat is in the neutral position, the further electromagnet has a second angular offset relative to the pivot plane, the second angular offset being offset from the pivot plane in a direction opposite the first angular offset.

21. The swing apparatus of claim 20, wherein the first angular offset is equal in magnitude to the second angular offset.

22. The swing apparatus of claim 20, wherein the first angular offset is different in magnitude to the second angular offset.

23. The swing apparatus of claim 16, wherein the first angular offset is equal to one half of a maximum swing angle by which the arm assembly rotates about the pivot axis.

* * * * *